US008681082B2

(12) United States Patent
Toyomura et al.

(10) Patent No.: US 8,681,082 B2
(45) Date of Patent: Mar. 25, 2014

(54) DISPLAY DEVICE AND DRIVE METHOD THEREFOR, AND ELECTRONIC UNIT

(75) Inventors: Naobumi Toyomura, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 763 days.

(21) Appl. No.: 12/917,031

(22) Filed: Nov. 1, 2010

(65) Prior Publication Data

US 2011/0109813 A1 May 12, 2011

(30) Foreign Application Priority Data

Nov. 11, 2009 (JP) ..... 2009-258315
Nov. 11, 2009 (JP) ..... 2009-258316

(51) Int. Cl.
*G09G 3/36* (2006.01)

(52) U.S. Cl.
USPC ..... 345/89; 345/211; 345/212; 345/690

(58) Field of Classification Search
USPC ..... 345/87–100, 204–215, 690
See application file for complete search history.

(56) References Cited

U.S. PATENT DOCUMENTS 8,072,399 B2 * 12/2011 Iida et al. ..... 345/77
2002/0067327 A1 * 6/2002 Ozawa et al. ..... 345/89
2004/0070557 A1 * 4/2004 Asano et al. ..... 345/76
2008/0030436 A1 2/2008 Iida et al.

FOREIGN PATENT DOCUMENTS

JP 2008-033193 2/2008

* cited by examiner

*Primary Examiner* — Vijay Shankar
(74) *Attorney, Agent, or Firm* — Dentons US LLP

(57) ABSTRACT

A display device includes: pixels each including a light-emitting element; scan lines and signal lines; a scan line drive circuit applying a selection pulse to each of the scan lines in succession; and a signal line drive circuit writing video signals to respective selected pixels through switching a gray-scale interpolation voltage, a basic voltage, and a video signal voltage to apply each voltage selected by switching to each of the signal lines. The signal line drive circuit performs gray-scale interpolation on a light emission luminance level for each of the light emitting elements through setting the video signal voltage to a fundamental gray-scale voltage, and through varying the gray-scale interpolation voltage. The scan line drive circuit starts and completes an application of the selection pulse during each of a period of a gray-scale interpolation voltage, a period of a basic voltage and a period of a video signal voltage.

15 Claims, 32 Drawing Sheets

DISPLAY DEVICE AND DRIVE METHOD THEREFOR, AND ELECTRONIC UNIT

BACKGROUND OF THE INVENTION

1. Field of the Invention

The present invention relates to a display device displaying images by a light-emitting element provided to each pixel, a drive method for the display device, and an electronic unit provided with such a display device.

2. Description of the Related Art

In the field of display devices displaying an image, recently developed for market is a display device (organic Electro Luminescence (EL) display device) using a light-emitting element, e.g., organic EL element, being a current-driven optical element that changes in light emission luminance in accordance with a value of current flowing therethrough.

The organic EL element is a self-emitting element unlike a liquid crystal element and others. The organic EL display device thus requires no light source, i.e., backlight, thereby favorably offering a higher image visibility, a lower power consumption, and a faster element response speed compared with a liquid crystal display device requiring a light source.

The organic EL display device is classified into the passive- and active-matrix types in terms of driving similarly to a liquid crystal display device. The display device of the passive-matrix type is simple and easy to configure, but has a problem of difficulty in being large in size and offering a high definition, for example. Due to such a problem and others, the display device of the active-matrix type has been under active development. In an organic EL display device of the active-matrix type as such, an active element is in charge of controlling a current flowing through an organic EL element provided to each pixel. The active element is generally a TFT (Thin Film Transistor) provided in a drive circuit provided to each of the organic EL elements.

The organic EL elements each have the characteristics of current-voltage (I-V), which are generally known to deteriorate over time (suffer from over-time deterioration). In a pixel circuit in which the organic EL elements are driven by a current, when the I-V characteristics of the organic EL elements are deteriorated over time, a current flowing through a drive transistor shows a change in value. This changes also the value of a current flowing through the organic EL elements themselves, thereby changing also the level of light emission luminance.

In the drive transistor, the threshold voltage Vth and the mobility μ thereof may change over time or fluctuate depending on the pixel circuit due to variations of the manufacturing process. When the threshold voltage Vth and/or the mobility μ of the drive transistor fluctuate depending on the pixel circuit as such, a current flowing to the drive transistor may vary in value depending on the pixel circuit. Therefore, even if any specific one level of voltage is applied to the gate of the drive transistor, the organic EL elements vary in light emission luminance, whereby resulting in the loss of uniformity of the screen.

In consideration thereof, there has been a proposal to maintain uniform the light emission luminance of the organic EL elements with no influence even if the I-V characteristics thereof show some change over time, or even if, in the drive transistor, the threshold voltage Vth and/or the mobility μ show some change over time or fluctuate depending on the pixel circuit. To be specific, proposed is a display device provided with functions of compensation and correction. The function of compensation is for compensating for any variation observed in the I-V characteristics of the organic EL elements, and the function of correction is for correcting any fluctuation occurred to the threshold voltage Vth and/or the mobility μ of the drive transistor. An example includes Japanese Unexamined Patent Publication No. 2008-33193.

SUMMARY OF THE INVENTION

In the market of flat panel displays, a liquid crystal television using a liquid crystal display device is recently gaining a market share. The consumers' appetite for buying is whetted by the lower price of the liquid crystal television together with the larger screen and the lower profile thereof. In this sense, for an organic EL television using an organic EL display device, making an attempt for price reduction (cost reduction) is important for promoting the sale thereof.

As a way to realize the cost reduction as such, a peripheral circuit for driving pixels may be a target for cost reduction, for example. The peripheral circuit includes a data driver supplying a video signal to each pixel, and in this data driver, the number of gray-scale levels for output is often set to gray-scale levels based on 10-bit (1024 gray-scale levels). Reducing this number of gray-scale levels for output may lead to the cost reduction, but if the number of gray-scale levels for output remains simply reduced, the display quality is resultantly degraded.

It is thus desirable to provide a display device that can offer a higher image quality with a lower cost, a drive method for such a display device, and an electronic unit.

The invention relates to a technology for increasing, in a data driver, the number of gray-scale levels for output to enable representation eventually with the gray-scale level based on 10-bit first by a reduction down to gray-scale level based on 8-bit (256 gray-scale levels), and then by 2-bit (4 gray-scale levels) interpolation between the gray-scale levels based on the 8-bit.

To be specific, before writing of a video signal voltage to each of the pixels, a predetermined signal voltage for gray-scale interpolation is written thereto so that the gray-scale interpolation is performed. Hereinafter, such a signal voltage is simply referred to as "gray-scale interpolation voltage". More in detail, the gray-scale interpolation voltage is varied in value to take a plurality of values with respect to a specific value of a video signal voltage, and using each of the resulting values of the gray-scale interpolation voltage, the video signal voltage is subjected to interpolation between its gray-scale levels, i.e., interpolation in terms of light emission luminance. This technique enables the representation with a larger number of gray-scale levels than the number originally provided by a video signal, and thus is considered to lead to a higher image quality with a lower cost. In the below, such a scheme of pixel driving by the writing of a video signal voltage after the writing of a gray-scale interpolation voltage is referred to as "two-step drive scheme".

The issue here is that, especially with a large-sized display panel, a larger distance from the data driver to each of the pixels often causes rounding of signal-pulse waveforms of the voltages, i.e., the gray-scale interpolation voltage and the video signal voltage. This is due to the wiring resistance in signal lines and the capacity thereof. To be specific, with a pixel not away that much from the data driver, i.e., pixel closer to a signal input end, the signal pulses rise and fall sharply, and on the other hand, with a pixel away from the data driver, i.e., pixel closer to a panel end, the signal pulses rise and fall gradually.

In the two-step drive scheme described above, for the gray-scale interpolation, there needs to change in value the gray-scale interpolation voltage to take a plurality of values with respect to a specific value of the video signal voltage as already described. Accordingly, as described above, if the waveform of signal pulses is different depending on the pixel position in the display panel, due to the difference of the pulse waveform as such, a value range of the gray-scale interpolation voltage to be applied to a specific value of the video signal voltage may not always be the same depending on the pixel position. In this case, if any one specific value of the gray-scale interpolation voltage is applied to every pixel in the display panel, the resulting gray-scale interpolation may not be completed appropriately, i.e., smoothly, to some pixels. As a result, the areas of such pixels may be degraded in image quality.

As such, even such a two-step drive scheme may possibly cause the degradation of image quality in some cases, and thus is expected for more improvement to realize a higher image quality with a lower cost. Note that the problems described above are surely not exclusive to the organic EL display devices, and may similarly occur to any other display devices using self-emitting elements.

Moreover, the two-step drive scheme as such requires the gray-scale interpolation voltage to be in a value range on the side of darker gray-scale levels with a larger value of the video signal voltage, i.e., a value on the side of lighter gray-scale levels. As such, if the gray-scale interpolation voltage fluctuates in value depending on which value the video signal voltage takes, it means that the peripheral circuit requires an additional memory, thereby resulting in a cost increase.

First to fourth display devices according to an embodiment of the invention includes a plurality of pixels each including a light-emitting element, scan lines and signal lines, each line being connected to corresponding pixels of the plurality of pixels, a scan line drive circuit applying a selection pulse to each of the scan lines in succession, the selection pulse allowing a group of pixels to be selected from the plurality of pixels, and a signal line drive circuit writing video signals to respective pixels selected by the scan line drive circuit through switching a gray-scale interpolation voltage, a basic voltage, and a video signal voltage, one after another in this order, to apply each voltage selected by switching to each of the signal lines. In such display devices, the signal line drive circuit performs gray-scale interpolation on a light emission luminance level for each of the light emitting elements through setting the video signal voltage to a fundamental gray-scale voltage corresponding to one of a plurality of gray-scale values which are originally provided by the video signals, and through varying the gray-scale interpolation voltage over a plurality of voltage values.

Among these display devices, especially in the first display device, the scan line drive circuit starts and completes an application of the selection pulse during each of a period of a gray-scale interpolation voltage, a period of a basic voltage and a period of a video signal voltage.

In the second display device, the scan line drive circuit starts an application of the selection pulse prior to a period of the gray-scale interpolation voltage, and completes the application of the selection pulse during a period of the basic voltage subsequent to a period of the gray-scale interpolation voltage.

In the third display device, the scan line drive circuit starts an application of the selection pulse during a period of the gray-scale interpolation voltage, and completes the application of the selection pulse during a period of the video signal voltage subsequent to a period of the basic voltage.

In the fourth display device, the scan line drive circuit starts an application of the selection pulse during a period of the gray-scale interpolation voltage, and completes the application of the selection pulse during a period of the basic voltage, and the signal line drive circuit adjusts a period of the gray-scale interpolation voltage, in such a manner that the period of the gray-scale interpolation voltage gets shorter as a distance along the signal line from the signal line drive circuit to each of the pixels increases.

A fifth display device according to an embodiment of the invention including a display section including a plurality of pixels each including a light-emitting element, and a drive circuit driving the plurality of pixels, through selecting pixels in succession and writing a video signal voltage based on a video signal into the selected pixels. The drive circuit performs gray-scale interpolation on a light emission luminance level of the light emitting element through writing a gray-scale interpolation voltage into the selected pixels while varying the gray-scale interpolation voltage over a plurality of voltage values, one horizontal period or longer period before a write timing of the video signal voltage.

An electronic unit according to an embodiment of the invention includes any one of the first to fifth display devices described above.

A method of driving any one of first to fourth display device through driving a plurality of pixels each including a light-emitting element and each connected to both a scan line and a signal line, the method including steps of, applying a selection pulse to each of the scan lines in succession, the selection pulse allowing a group of pixels to be selected from the plurality of pixels, writing video signals to respective pixels selected by the scan line drive circuit through switching a gray-scale interpolation voltage, a basic voltage, and a video signal voltage, one after another in this order, to apply each voltage selected by switching to each of the signal lines, and performing gray-scale interpolation on a light emission luminance level for each of the light emitting elements through setting the video signal voltage to a fundamental gray-scale voltage corresponding to one of a plurality of gray-scale values which are originally provided by the video signals, and through varying the gray-scale interpolation voltage over a plurality of voltage values.

Among these display device drive methods, especially in the first display device drive method, an application of the selection pulse is started and completed during each of a gray-scale interpolation voltage period, a basic voltage period and a video signal voltage period, to perform writing of the video signals.

In the second display device drive method, an application of the selection pulse is started prior to a period of the gray-scale interpolation voltage, and the application of the selection pulse is completed during a period of the basic voltage subsequent to a period of the gray-scale interpolation voltage, to perform writing of the video signals.

In the third display device drive method, an application of the selection pulse is started during a period of the gray-scale interpolation voltage, and the application of the selection pulse is completed during a period of the video signal voltage subsequent to a period of the basic voltage, to perform writing of the video signals.

In the fourth display device drive method, an application of the selection pulse is started during a period of the gray-scale interpolation voltage, the application of the selection pulse is completed during a period of the basic voltage, to perform writing of the video signals, and a period of the gray-scale interpolation voltage is adjusted, in such a manner that the period of the gray-scale interpolation voltage gets shorter as a distance along the signal line from the signal line drive circuit to each of the pixels increases.

In the fifth display device drive method, a plurality of pixels each including a light-emitting element are driven, through selecting pixels in succession and writing a video signal voltage based on a video signal into the selected pixels, and gray-scale interpolation is performed on a light emission luminance level of the light emitting element through writing a gray-scale interpolation voltage into the selected pixels while varying the gray-scale interpolation voltage over a plurality of voltage values, one horizontal period or longer period before a write timing of the video signal voltage.

With the first to fourth display devices and drive methods therefor according to the embodiment of the invention, a selection pulse is applied to the scan lines for making a sequential selection of a plurality of pixels, and at the same time, signal lines are applied with a gray-scale interpolation voltage, a basic voltage, and a video signal voltage one after another in this order, whereby any selected pixels are each written with a video signal. At this time, the video signal voltage is assigned a value corresponding to one of a plurality of gray-scale levels, and the gray-scale interpolation voltage is varied in value to take a plurality of values so that an operation of gray-scale interpolation is performed on each of the light-emitting elements in terms of light emission luminance. This accordingly enables the representation with a larger number of gray-scale levels than the number originally provided by a video signal, and thus the resulting gray-scale representation may be made with a higher definition with a simpler configuration of the drive circuit, i.e., not adding complexity to the configuration thereof.

Among these, especially with the first display device and drive method therefor, a selection pulse is applied separately during the respective application periods for the gray-scale interpolation voltage, the basic voltage, and the video signal voltage. With such an application of a selection pulse not only during the application period for the gray-scale interpolation voltage but also during the application period for the basic voltage, compared with a case with no application of a selection pulse during the application period for the basic voltage, a bootstrap operation is restricted or prevented in a time period before starting the application of a video signal after completing the application of the gray-scale interpolation voltage, i.e., application period for the basic voltage. This accordingly reduces the amount of mobility correction during the application of the gray-scale interpolation voltage, thereby reducing the amount of current change, i.e., current of driving the light-emitting elements, when the gray-scale interpolation voltage is increased in value. In other words, the amount of mobility correction is reduced during the application of the gray-scale interpolation voltage so that the characteristics of current change show the gradual rise and fall with respect to the gray-scale interpolation voltage.

Moreover, since a selection pulse applied during the application period for the gray-scale interpolation voltage is not the one applied during the application period for the basic voltage described above, this is unlike the case in which any same selection pulse is applied for the whole duration including the application period for the gray-scale interpolation voltage and that for the basic voltage, for example. In other words, the length of the write period for the gray-scale interpolation voltage is determined by how long the selection pulse is to be applied during the application period therefor. As such, unlike in the case of applying any same selection pulse, applying a selection pulse as such can suppress (or prevent) any variation depending on the pixel position in the device, i.e., depending on the distance from the signal line drive circuit to each of the pixels, for the length of the write period for the gray-scale interpolation voltage, and for the length of the bootstrap period thereafter, i.e., period of time before starting the application of a selection pulse during the application period for the basic voltage. In other words, applying a selection pulse as such can suppress or prevent the amount of mobility correction i.e., by extension, the amount of mobility correction in an entire horizontal period, from varying during the application of the gray-scale interpolation voltage regardless of the pixel position.

With the second display device and drive method therefor, the application of the selection pulse is started before the application of the gray-scale interpolation voltage, and is completed during the application period for the basic voltage after completing the application of the gray-scale interpolation voltage. With such a continuous application of the selection pulse for the whole duration including the application period for the gray-scale interpolation voltage and that for the basic voltage, compared with a case of not applying a selection pulse continuously as such, this accordingly reduces the amount of mobility correction during the application of the gray-scale interpolation voltage so that the resulting characteristics of current change show the gradual rise and fall with respect to the gray-scale interpolation voltage. Moreover, unlike in a case of starting the application of a selection pulse during the application period for the gray-scale interpolation voltage, for example, by starting the application of a selection pulse before the application of the gray-scale interpolation voltage, the length of the write period for the gray-scale interpolation voltage is determined only by the length of the application period therefor. Therefore, unlike in such a case, by starting the application of a selection pulse before the application of the gray-scale interpolation voltage, any variation can be suppressed (or prevented) depending on the pixel position in the device for the length of the write period for the gray-scale interpolation voltage. In other words, applying a selection pulse as such can suppress or prevent the amount of mobility correction i.e., by extension, the amount of mobility correction in an entire horizontal period, from varying during the application of the gray-scale interpolation voltage regardless of the pixel position.

With the third display device and drive method therefor, the application of the selection pulse is started during the application period for the gray-scale interpolation voltage, and is completed during the application period for the video signal voltage subsequent to the application period for the basic voltage. With such a continuous application of the selection pulse for the whole duration including the application period for the gray-scale interpolation voltage and that for the basic voltage, compared with a case of not applying a selection pulse continuously as such, this accordingly reduces the amount of mobility correction during the application of the gray-scale interpolation voltage so that the resulting characteristics of current change show the gradual rise and fall with respect to the gray-scale interpolation voltage. Moreover, unlike in a case of completing the application of a selection pulse during the application period for the basic voltage, for example, completing the application of a selection pulse during the application period for the video signal voltage as such can suppress (or prevent) any variation depending on the pixel position in the device for the whole duration including the write period for the gray-scale interpolation voltage and that for the video signal voltage. In other words, completing the application of a selection pulse as such can suppress or prevent the amount of mobility correction from varying not only during the application of the gray-scale interpolation voltage but also during the application of the video signal voltage (as a horizontal period) regardless of the pixel position.

With the fourth display device and drive method therefor, the application of the selection pulse is started during the application period for the gray-scale interpolation voltage, and is completed during the application period for the basic voltage. With such a continuous application of the selection pulse for the whole duration including the application period for the gray-scale interpolation voltage and that for the basic voltage, compared with a case of not applying a selection pulse continuously as such, this accordingly reduces the amount of mobility correction during the application of the gray-scale interpolation voltage so that the resulting characteristics of current change show the gradual rise and fall with respect to the gray-scale interpolation voltage. Moreover, adjusting the application period for the gray-scale interpolation voltage to be shorter in accordance with an increase of a distance from the signal line drive circuit disposed along the signal lines to each of the pixels as such can suppress (or prevent) any variation depending on the pixel position the device for the length of the write period for the gray-scale interpolation voltage. In other words, the length of the write period for the gray-scale interpolation voltage, which is determined by the length from the start of the application of the selection pulse to the completion of the application of the gray-scale interpolation voltage, is adjusted to be shorter in accordance with the increase of the distance. Therefore, even if the increase of distance causes rounding of signal-pulse waveforms (specifically falling edge waveforms) of the gray-scale interpolation voltage, the actual length of the write period remains almost constant irrespective of the pixel position. As such, adjusting the write period as such can suppress or prevent the amount of mobility correction, by extension, the amount of mobility correction in an entire horizontal period, from varying during the application of the gray-scale interpolation voltage irrespective of the pixel position.

With the fifth display device and drive method therefor, and with an electronic unit, before the writing of the video signal voltage, the writing of the gray-scale interpolation voltage is performed while the voltage is varied in value to take a plurality of values. Using the resulting values of the gray-scale interpolation voltage, the video signal voltage may be subjected to interpolation between the gray-scale levels thereof. By setting the timing for writing such a gray-scale interpolation voltage at one horizontal period or longer period before the write timing for the video signal voltage, the resulting characteristics of current change (current for driving the light-emitting elements) of the gray-scale interpolation voltage show the sharp rise and fall.

According to the first to fourth display devices and drive methods therefor, and the electronic unit of the embodiment of the invention, for driving a plurality of pixels for display, an operation of gray-scale interpolation is performed in terms of light emission luminance by assigning a value corresponding to one of a plurality of gray-scale levels to the video signal voltage, and by varying in value the gray-scale interpolation voltage to take a plurality of values. Also the application of a selection pulse is performed not only during the application period for the gray-scale interpolation voltage but also during the application period for the basic voltage. As such, compared with a case with no application of a selection pulse during the application period for the basic voltage, the resulting characteristics of current change show the gradual rise and fall with respect to the gray-scale interpolation voltage. This accordingly allows, for the operation of gray-scale interpolation as such, the values of the gray-scale interpolation voltage to fall within almost the same range for application to the video signal voltage irrespective of gray-scale levels. There is thus no need to provide any additional memory to the peripheral circuit such as data driver, i.e., the signal line drive circuit, for performing the operation of gray-scale interpolation. Moreover, since a predetermined operation is executed during the application of a selection pulse to the scan lines and during the application of various types of voltages to the signal lines, this can suppress or prevent the amount of mobility correction from varying irrespective of the pixel position in an entire horizontal period. As a result, even if every pixel in the display, i.e., display panel, is applied with the gray-scale interpolation voltage in the same value range, the operation of gray-scale interpolation may be performed appropriately (smoothly), thereby being able to suppress or prevent any degradation of the image quality irrespective of the pixel position. Accordingly, a higher image quality may be realized together with a lower cost.

According to the fifth display device and drive method therefor, and the electronic unit in the embodiment of the invention, any selected pixel is written not only with the video signal voltage but also with the gray-scale interpolation voltage while it is changed in value to take a plurality of values so that the resulting representation may be made with a larger number of gray-scale levels. Moreover, such a gray-scale interpolation voltage is written to the pixel one horizontal period or longer period before a timing for writing of the video signal voltage. As a result, since the resulting characteristics of current change show the sharp rise and fall with respect to the gray-scale interpolation voltage, the values of the gray-scale interpolation voltage fall almost in the same range for application to the video signal voltage on a value basis. Accordingly, there is no more need to provide any additional memory to the peripheral circuit such as data driver so that a higher image quality may be realized together with a lower cost.

Other and further objects, features and advantages of the present invention will appear more fully from the following description.

DETAILED DESCRIPTION OF THE PREFERRED EMBODIMENTS

In the below, embodiments of the invention are described in detail by referring to the accompanying drawings. The description is made in the following order.

1. First Embodiment (Exemplary case of providing a selection pulse for writing of a gray-scale interpolation voltage separately from a selection pulse for writing of a basic voltage)
2. Second Embodiment (Exemplary case of starting the application of a selection pulse before starting the application of a gray-scale interpolation voltage, and completing the application of the selection pulse during an application period for a basic voltage)
3. Third Embodiment (Exemplary case of starting the application of a selection pulse during an application period for a gray-scale interpolation voltage, and completing the application of the selection pulse during an application period for a video signal voltage)
4. Fourth Embodiment (Exemplary case of adjusting an application period for a gray-scale interpolation voltage to be shorter in accordance with an increase of distance along signal lines from a signal drive circuit to each pixel)
5. Fifth Embodiment (Exemplary case of starting the writing of a gray-scale interpolation voltage one horizontal period or longer period before a write timing for a video signal voltage)
6. Module and Application Examples
7. Modulation Examples

First Embodiment

Configuration of Display Device

Figure 1:
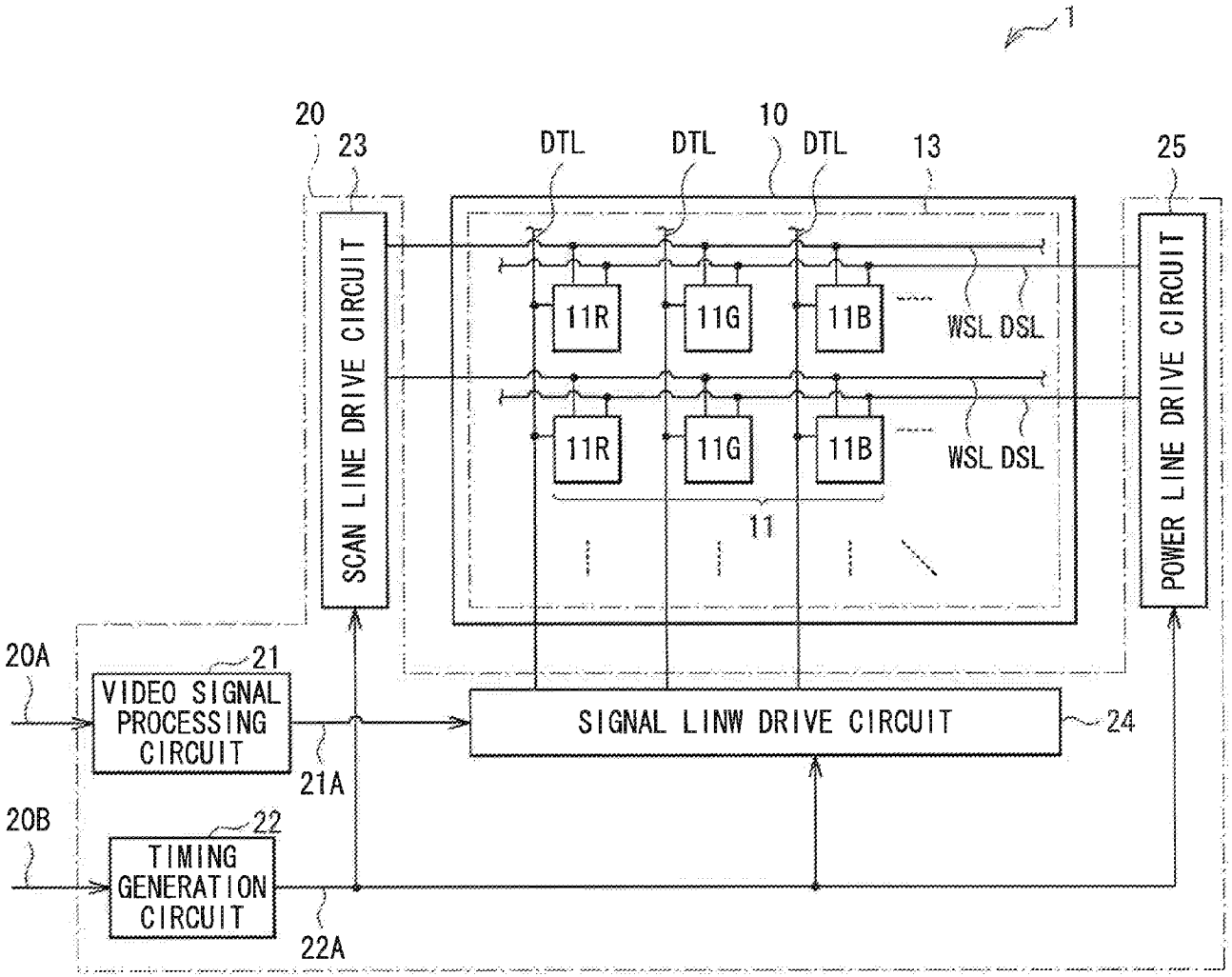
FIG. 1 is a diagram showing an exemplary configuration of display devices according to first to fourth embodiments of the invention.

FIG. 1 is a block diagram showing the schematic configuration of a display device 1 in an embodiment of the invention. This display device 1 is configured to include a display panel 10 (display section), and a drive circuit 20.

(Display Panel 10)

The display panel 10 is provided with a pixel array section 13 in which a plurality of pixels 11 are arranged in a matrix. This display panel 10 is of the active-matrix type for image display based on a video signal 20A and a synchronization signal 20B, which are both provided from the outside. In this example, the pixels 11 include pixels 11R for red, pixels 11G for green, and pixels 11B for blue. These pixels 11R, 11G, and 11B are collectively referred to as the pixels 11 in the below as appropriate.

The pixel array section 13 includes a plurality of scan lines WSL, a plurality of signal lines DTL, and a plurality of power lines DSL. The scan lines WSL are arranged in rows, and the signal lines DTL are arranged in columns. The power lines DSL are arranged in rows along each corresponding scan line WSL. These lines, i.e., the scan lines WSL, the signal lines DTL, and the power lines DSL, are connected, at their one ends, to a drive circuit 20 that will be described later. In this configuration, the pixels 11R, 11G, and 11B described above are arranged in rows and columns, i.e., arranged in a matrix, with a one-to-one relationship with the intersections of the scan lines WSL and the signal lines DTL.

Figure 2:
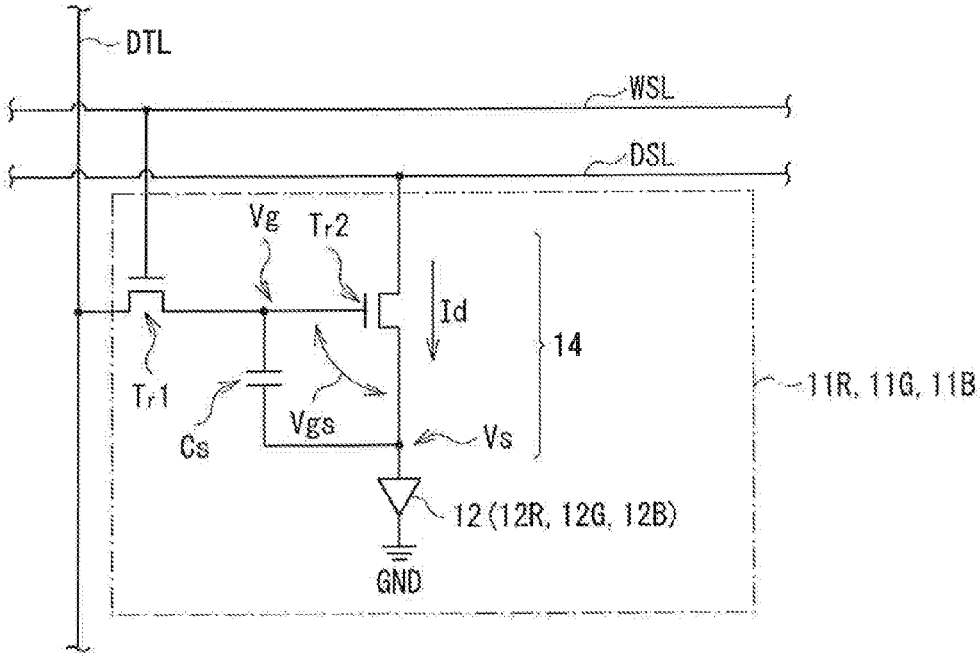
FIG. 2 is a circuit diagram of each pixel of FIG. 1, showing an exemplary internal configuration thereof.

FIG. 2 is a diagram showing an exemplary internal configuration of the pixel 11R, 11G, or 11B. The pixels 11R, 11G, and 11B are each provided with a corresponding organic EL element 12R, 12G, or 12B (light-emitting element), and a pixel circuit 14. In the below, the organic EL elements 12R, 12G, and 12B are collectively referred to as the organic EL elements 12 as appropriate.

The pixel circuit 14 is configured using a write (for sampling) transistor Tr1, i.e., first transistor, a drive transistor Tr2, i.e., second transistor, and a retention capacitor Cs. This is a so-called "2Tr1C" circuit configuration. In this configuration, the write transistor Tr1 and the drive transistor Tr2 are each a TFT of an n-channel MOS (Metal Oxide Semiconductor) type, for example. Herein, the TFT is surely not restricted by type as such, and may be in the inverted-staggered structure (so-called bottom gate type) or in the stagger structure (so-called top gate type).

In the pixel circuit 14, as to the write transistor Tr1, the gate is connected to the corresponding scan line WSL, the drain to the corresponding signal line DTL, and the source to the gate of the drive transistor Tr2 and to one end of the retention capacitor Cs. The drain of the drive transistor Tr2 is connected to the corresponding power line DSL, and the source thereof is connected to the remaining end of the retention capacitor Cs and to the anode of the organic EL element 12. The cathode of the organic EL element 12 is set to be at a potential of a fixed value, and in this example, is set to be at a ground (ground potential) through connection to a grand line GND. Herein, the cathode of the organic EL element 12 serves as an electrode of shared use for the organic EL elements 12, and is a flat-shaped electrode formed across the display region of the display panel 10, for example.

(Drive Circuit 20)

The drive circuit 20 drives (performs display drive) the pixel array section 13, i.e., the display panel 10. To be specific, although the details will be described later, the drive circuit 20 drives a plurality of pixels 11 (11R, 11G, and 11B) in the pixel array section 13 for display by making a sequential selection thereof, and at the same time, by writing a video signal voltage based on the video signal 20A to the selected pixels 11. This drive circuit 20 is configured to include a video signal processing circuit 21, a timing generation circuit 22, a scan line drive circuit 23, a signal line drive circuit 24, and a power line drive circuit 25 as shown in FIG. 1.

The video signal processing circuit 21 performs a predetermined correction to the digital video signal 20A coming from the outside, and outputs the resulting video signal thorough with the correction, i.e., video signal 21A, to the signal line drive circuit 24. This predetermined correction includes gamma correction, overdrive correction, and others.

The timing generation circuit 22 controls the components, i.e., the scan line drive circuit 23, the signal line drive circuit 24, and the power line drive circuit 25, to operate in association with one another. Such control is performed by a control signal 22A generated and output based on the synchronization signal 20B coming from the outside.

The scan line drive circuit 23 is for making a sequential selection of the pixels 11 (11R, 11G, and 11B) through the sequential application of a selection pulse to a plurality of scan lines WSL in accordance with (in synchronization with) the control signal 22A. To be specific, the scan line drive circuit 23 is so configured as to generate the selection pulse described above by selectively outputting voltages Von and Voff. The voltage Von is the one applied to set the write transistor Tr1 in the ON state, and the voltage Voff is to set the write transistor Tr1 in the OFF state. Although the details will be described later, this scan line drive circuit 23 applies a selection pulse to each of the scan lines WSL during each corresponding application period for a gray-scale interpolation voltage Vsig1, a basic voltage Vofs, and a video signal voltage Vsig2 that will be described later. Herein, the voltage Von takes a (fixed) value equal to or larger than the value of an ON voltage of the write transistor Tr1, and the voltage Voff takes a (fixed) value smaller than the value of the ON voltage thereof.

The signal line drive circuit 24 generates, for application to each of the signal lines DTL, an analog video signal corresponding to the video signal 21A coming from the video signal processing circuit 21 in accordance with (in synchronization with) the control signal 22A. To be specific, by applying the voltage of an analog video signal based on the video signal 21A to each of the signal lines DTL, the signal line drive circuit 24 writes the video signal to the pixels 11 (11R, 11G, and 11B) selected by, i.e., being the selection targets for, the scan line drive circuit 23. Herein, the writing of the video signal means the application of a predetermined level of voltage between the gate and source of the drive transistor Tr2.

The signal line drive circuit 24 is capable of outputting three different voltages (three-valued voltage) including the gray-scale interpolation voltage Vsig1, the video signal voltage Vsig2, and the basic voltage Vofs, which are all based on the video signal 20A. In this example, the signal line drive circuit 24 applies these three different voltages to each of the signal lines DTL in order of the gray-scale interpolation voltage Vsig1, the basic voltage Vofs, and the video signal voltage Vsig2. The signal line drive circuit 24 also separately varies the value of the gray-scale interpolation voltage Vsig1 and that of the video signal voltage Vsig2. As such, although the details will be described later, the signal line drive circuit 24 performs an operation of gray-scale interpolation to each of the organic EL elements 12 in terms of light emission luminance. On the other hand, the basic voltage Vofs is to be applied to the gate of the drive transistor Tr2 when the organic EL elements 12 are turned off. To be specific, assuming that the threshold voltage for the drive transistor Tr2 is Vth, this basic voltage Vofs is so set that (Vofs−Vth) takes a (fixed) value smaller than the value of (Vel+Vca), which is the sum of the threshold voltage Vel and the cathode voltage Vca in each of the organic EL elements 12.

The power line drive circuit 25 controls the organic EL elements 12 in terms of the light-on operation and light-off operation by sequentially applying a control pulse to a plurality of power lines DSL in accordance with (in synchronous with) the control signal 22A. To be specific, the power line drive circuit 25 selectively outputs voltages Vcc and Vini, thereby generating the control pulse described above. The voltage Vcc is the one applied when the drive transistor Tr2 is provided with a supply of current Id, and the voltage Vini is the one applied when the drive transistor Tr2 is provided with no supply of current Id. In this example, the voltage Vini is so set as to take a (fixed) value smaller than the value of (Vel+Vca), which is the sum of the threshold voltage Vel and the cathode voltage Vca in each of the organic EL elements 12. On the other hand, the voltage Vcc is so set as to take a (fixed) value equal to or larger than this voltage value of (Vel+Vca).

(Effects and Advantages of Display Device)

Described next are the effects and advantages of the display device 1 of this embodiment.

(1. General Outlines of Display Operation)

As shown in FIGS. 1 and 2, in this display device 1, the drive circuit 20 is in charge of driving for display the pixels 11 (11R, 11G, and 11B) in the display panel 10 (the pixel array section 13) based on the video signal 20A and the synchronization signal 20B. In response thereto, a drive current is directed to the organic EL element 12 in each of the pixels 11, and this recombines holes and electrons so that the light emission occurs. As a result, multiple reflection occurs to the light emitted as such between the anode (not shown) and the cathode (not shown) of each of the organic EL elements 12, and the resulting light is directed to the outside after passing through the cathodes, and others. In this manner, image display is made on the display panel 10 based on the video signal 20A.

(2. Details of Display Operation)

Figure 3:
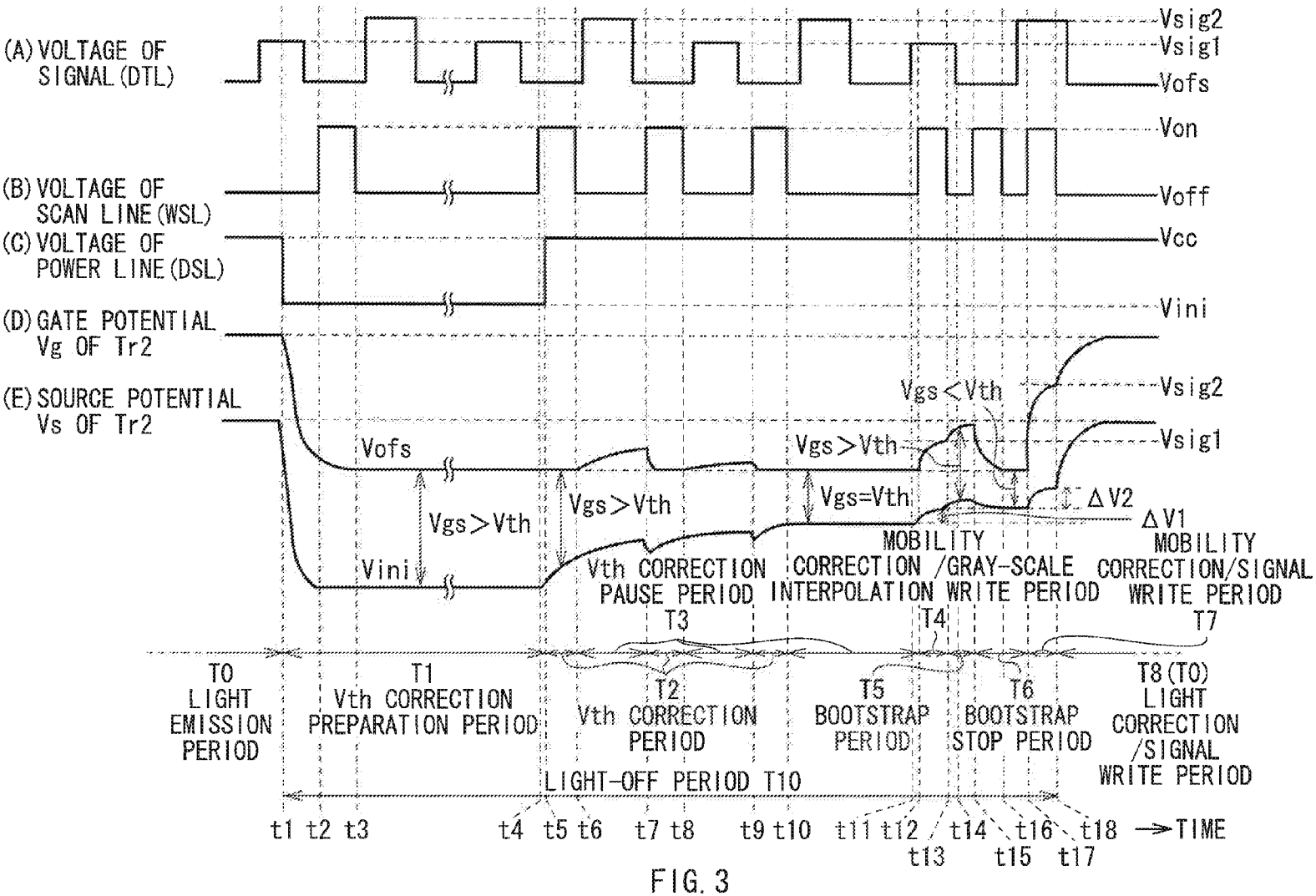
FIG. 3 is a timing chart for an exemplary operation of the display device according to the first embodiment.

FIG. 3 is a timing chart showing various exemplary waveforms during the display operation by the display device 1, i.e., during driving by the drive circuit 20 for display. In FIG. 3, part A shows a voltage waveform of the signal lines DTL, part B shows that of the scan lines WSL, and part C shows that of the power lines DSL. To be specific, In FIG. 3, part A shows a periodic change of voltage of the signal lines DTL within a range of voltage values, i.e., values of the basic voltage Vofs, the gray-scale interpolation voltage Vsig1, and the video signal voltage Vsig2. Also in FIG. 3, part B shows a periodic change of voltage of the scan lines WSL between the values of voltages Voff and Von, and part C shows a periodic change of voltage of the power lines DSL between the values of voltages Vcc and Vini. In FIG. 3, part D shows the waveform of a gate potential Vg in the drive transistor Tr2, and part E shows the waveform of a source potential Vs therein.

(Vth Correction Preparation Period T1: t1 to t5)

First of all, after the completion of a light-emission period T0, i.e., after a timing t1, the drive circuit 20 prepares to correct the threshold voltage Vth (to perform Vth correction) in the drive transistor Tr2 in each of the pixels 11 (11R, 11G, and 11B). To be specific, first of all, at the timing t1, the power line drive circuit 25 reduces the voltage of the power lines DSL from Vcc to Vini (part C in FIG. 3). Then in a period of timings t2 to t3 when the signal lines DTL are at the basic voltage Vofs, and when the power lines DSL are at the voltage Vini, the scan line drive circuit 23 increases the voltage of the scan lines WSL from Voff to Von (part B in FIG. 3). Such a voltage increase accordingly reduces the source potential Vs of the drive transistor Tr2, and the voltage thereof reaches the value of the voltage Vini (part E in FIG. 3) so that the organic EL elements 12 are turned off. In this example, the period from the timing t1 to a timing t18 at the beginning of a light-emitting operation that will be described later is a light-off period T10 in which the organic EL elements 12 are in the slight-off state. On the other hand, also in response to the decrease of the source potential Vs described above, the gate potential Vg of the drive transistor Tr2 goes down due to the capacity coupling via the retention capacitors Cs (part D in FIG. 3). Thereafter, the voltage of the scan lines WSL reaches the value of the voltage Von, and the write transistor Tr1 is put in the ON state so that, eventually, the gate potential Vg of the drive transistor Tr2 takes the value of the basic voltage Vofs corresponding to the voltage of the signal lines DTL at this time (part D in FIG. 3). As a result, as shown in FIG. 3, a gate-source voltage Vgs in the drive transistor Tr2 takes a value larger than the value of the threshold voltage Vth of the drive transistor Tr2 (Vgs>Vth), and this is the end of the preparation for the Vth correction. In this example, thereafter, at a timing t4 in a period when the signal lines DTL are at the basic voltage Vofs, and when the power lines DSL are at the voltage Vini, the scan line drive circuit 23 increases the voltage of the scan lines WSL from Voff to Von (part B in FIG. 3).

(First-Time Vth Correction Period T2: t5 to t6)

Next, the drive circuit 20 makes the first-time Vth correction in the drive transistor Tr2. To be specific, first of all, at a timing t5 in a period when the signal lines DTL are at the basic voltage Vofs, and when the scan lines WSL are at the voltage Von, the power line drive circuit 25 increases the voltage of the power lines DSL from Vini to Vcc (part C in FIG. 3). In response thereto, a current Id starts flowing between the drain and the source of the drive transistor Tr2 so that the source potential Vs goes up (part E in FIG. 3). Next, at a timing t6 in a period when the signal lines DTL and the power lines DSL are respectively kept at the basic voltage Vofs and the voltage Vcc, the scan line drive circuit 23 reduces the voltage of the scan lines WSL from Von to Voff (part B in FIG. 3). In response thereto, the write transistor Tr1 is put in the OFF state, and the gate of the drive transistor Tr2 is put in the floating state so that the operation of the Vth correction is temporarily stopped, i.e., the procedure goes to a first-time Vth correction pause period T3 below.

(First-Time Vth Correction Pause Period T3: t6 to t7)

Next, in a period from the timing t6 to a timing t7 that will be described later, the operation of the Vth correction is temporarily stopped as described above. As an exception, however, when the first-time Vth correction is not appropriately completed, i.e., when the gate-source voltage Vgs in the drive transistor Tr2 is still higher than the threshold voltage Vth therein (Vgs>Vth), the operation is performed as below. In other words, since the gate-source voltage Vgs in the drive transistor Tr2 is still higher than the threshold voltage Vth (Vgs>Vth) during this Vth correction pause period T3, it means that the current Id keeps flowing between the drain and the source of the drive transistor Tr2 so that the source potential Vs keeps going up (part E in FIG. 3). In response to such an increase of the source potential Vs, the gate potential Vg of the drive transistor Tr2 also goes up due to the capacity coupling via the retention capacitors Cs (part D in FIG. 3).

(Second-Time Vth Correction Period T2: t7 to t8)

Next, the drive circuit 20 makes the Vth correction again in the drive transistor Tr2, i.e., makes a second-time Vth correction. To be specific, first of all, at a timing t7 in a period when the signal lines DTL are at the basic voltage Vofs, and when the power lines DSL are at the voltage Vcc, the scan line drive circuit 23 increases the voltage of the scan lines WSL from Voff to Von (part B in FIG. 3). In response thereto, the write transistor Tr1 is put in the ON state so that the gate potential Vg of the drive transistor Tr2 reaches the value of the basic voltage Vofs corresponding to the voltage of the signal lines DTL at this time (part D in FIG. 3). At this time, when the source potential Vs of the drive transistor Tr2 is lower than the voltage value (Vofs (=Vg)−Vth), i.e., (Vs<(Vg−Vth)), in other words, when the gate-source voltage Vgs is still higher than the threshold voltage Vth (Vgs>Vth; when the Vth correction is not yet completed), the operation is executed as below. That is, until the drive transistor Tr2 is cut off, i.e., until the equation of Vgs=Vth is established, similarly in the first-time Vth correction period, the current Id keeps flowing between the drain and the source of the drive transistor Tr2 so that the source potential Vs keeps going up (part E in FIG. 3). In this example, the operation of Vth correction is temporarily stopped again as below before the equation of Vgs=Vth is established. That is, thereafter, at a timing t8 in a period when the signal lines DTL and the power lines DSL are respectively kept at the basic voltage Vofs and the voltage Vcc, the scan line drive circuit 23 reduces the voltage of the scan lines WSL from Von to Voff (part B in FIG. 3). In response thereto, the write transistor Tr1 is put in the OFF state, and the gate of the drive transistor Tr2 is put in the floating state so that the operation of the Vth correction is temporarily stopped again, i.e., the procedure goes to a second-time Vth correction pause period T3 in the below.

(Second-Time Vth Correction Pause Period T3: t8 to t9)

Next, in a period from the timing t8 to a timing t9 that will be described later, the operation of Vth correction is temporarily stopped as described above. In this example, since the second-time Vth correction is not yet appropriately completed as described above (Vgs>Vth), the current Id still keeps flowing between the drain and the source of the drive transistor Tr2 in this second-time Vth correction pause period T3 so that the source potential Vs keeps going up (part E in FIG. 3). In response thereto, similarly to the first-time Vth correction pause period T3, the gate potential Vg of the drive transistor Tr2 also goes up due to the capacity coupling via the retention capacitors Cs (part D in FIG. 3).

(Third-Time Vth Correction Period T2, and Third-Time Vth Correction Pause Period T3: t9 to t12)

Next, the drive circuit 20 makes the Vth correction again in the drive transistor Tr2, i.e., makes a third-time Vth correction. To be specific, first of all, at a timing t9 in a period when the signal lines DTL are at the basic voltage Vofs, and when the power lines DSL are at the voltage Vcc, the scan line drive circuit 23 increases the voltage of the scan lines WSL from Voff to Von (part B in FIG. 3). In response thereto, the write transistor Tr1 is put in the ON state so that the gate potential Vg of the drive transistor Tr2 reaches again the value of the basic voltage Vofs corresponding to the voltage of the signal lines DTL at this time part (D in FIG. 3). Thereafter, similarly to the first- and second-time Vth correction periods T2 as above, until the drive transistor Tr2 is cut off, i.e., until the equation of Vgs=Vth is established, the current Id keeps flowing between the drain and the source of the drive transistor Tr2 so that the source potential Vs goes up (part E in FIG. 3). In this example, as shown in FIG. 3, the equation of Vgs=Vth is established at the end of this third-time Vth correction period T2, and the operation of Vth correction is thus completed. In other words, the retention capacitors Cs are each so charged that the voltage between their both ends reaches the value of the threshold voltage Vth, and as a result, the gate-source voltage Vgs of the drive transistor Tr2 reaches the value of the threshold voltage Vth. Thereafter, at a timing t10 in a period when the signal lines DTL and the power lines DSL are respectively kept at the basic voltage Vofs and the voltage Vcc, the scan line drive circuit 23 reduces the voltage of the scan lines WSL from Von to Voff (part B in FIG. 3). In response thereto, the write transistor Tr1 is put in the OFF state, and the gate of the drive transistor Tr2 is put in the floating state so that, irrespective of the voltage value of the signal lines DTL thereafter, the gate-source voltage Vgs may be kept at the threshold voltage Vth. Note here that, thereafter, in a timing t11 in a period when the scan lines WSL are at the voltage Voff, and when the power lines DSL are at the voltage Vcc, the signal line drive circuit 24 increases the voltage of the signal lines DTL from the basic voltage Vofs to the gray-scale interpolation voltage Vsig1 (part A in FIG. 3). The period from the timing t10 to a timing t12 that will be described later is a third-time Vth correction pause period T3.

In this manner, the gate-source voltage Vgs is set to the value of the threshold voltage Vth by repeating the Vth correction period T2 and the Vth correction pause period T3 each for several times (three times in this example), thereby favorably leading to the effects as below (by making the Vth correction as such). That is, even if the threshold voltage Vth of the drive transistor Tr2 fluctuates depending on the pixel 11 (11R, 11G, or 11B), the organic EL elements 12 are prevented from varying in light emission luminance.

(Mobility Correction/Gray-Scale Interpolation Write Period T4: t12 to t13)

Next, the drive circuit 20 writes the gray-scale interpolation voltage Vsig1 as will be described later, i.e., performs gray-scale interpolation writing, and at the same time, corrects the mobility μ of the drive transistor Tr2, i.e., makes a first-time mobility correction. To be specific, first of all, at a timing t12 in a period when the signal lines DTL are at the gray-scale interpolation voltage Vsig1, and when the power lines DSL are at the voltage Vcc, the scan line drive circuit 23 increases the voltage of the scan lines WSL from Voff to Von (part B in FIG. 3). In response thereto, the write transistor Tr1 is put in the ON state so that the gate potential Vg of the drive transistor Tr2 is increased from the basic voltage Vofs to the gray-scale interpolation voltage Vsig1 corresponding to the voltage of the signal lines DTL at this time (part D in FIG. 3). At this time, the organic EL elements 12 are in the cut-off state because the anode voltage of each thereof is yet smaller than the value of (Vel+Vca), which is the sum of the threshold voltage Vel and the cathode voltage Vca in each of the organic EL elements 12. In other words, in this stage, no current flows between the anode and the cathode of each of the organic EL elements 12 (the organic EL elements 12 do not emit light). Accordingly, the current Id coming from the drive transistor Tr2 is directed to an element capacity (not shown) disposed in line between the anodes and cathodes of the organic EL elements 12 so that these element capacities are charged. As a result, the source potential Vs of the drive transistor Tr2 is increased by a potential difference ΔV1 (part E in FIG. 3) so that the gate-source voltage Vgs takes the value of (Vsig1+Vth−ΔV1).

At this time, in response to an increase of the mobility μ of the drive transistor Tr2, the source potential Vs is also increased more, i.e., more than the potential difference ΔV1. As such, as described above, the gate-source voltage Vgs is reduced by this potential difference ΔV1 before the light emission that will be described later, i.e., by feedback, thereby being able to prevent the mobility μ from varying irrespective of the pixel 11. However, as will be described later, since such an operation of mobility correction is stopped temporarily in this example, the mobility μ is not completely prevented in this stage from varying irrespective of the pixel 11. As such, the first-time mobility correction is made at the same time as the gray-scale interpolation writing.

(Bootstrap Period T5: t13 to t15)

Next, at a timing t13 in a period when the signal lines DTL and the power lines DSL are respectively kept at the gray-scale interpolation voltage Vsig1 and the voltage Vcc, the scan line drive circuit 23 reduces the voltage of the scan lines WSL from Von to Voff (part B in FIG. 3). In response thereto, the write transistor Tr1 is put in the OFF state, and the gate of the drive transistor Tr2 is put in the floating state so that the operation of mobility correction is temporarily stopped. Also at this time, the source potential Vs of the drive transistor Tr2 is also in the state of floating, and as shown in FIG. 3, the gate-source voltage Vgs is again higher than the threshold voltage Vth (Vgs>Vth). This thus causes bootstrap of the drive transistor Tr2, thereby increasing the source potential Vs thereof (part E in FIG. 3: bootstrap period T5). In other words, also in this bootstrap period T5, the operation is performed similarly to that of the mobility correction described above. Note here that since the gate of the drive transistor Tr2 is in the floating state as described above, the gate potential Vg of the drive transistor Tr2 is also increased due to the capacity coupling via the retention capacitors Cs (part D in FIG. 3). Herein, in the bootstrap period T5, at a timing t14 in a period when the scan lines SWL are at the voltage Voff, and when the power lines DSL are at the voltage Vcc, the signal line drive circuit 24 reduces the voltage of the signal lines DTL from the gray-scale interpolation voltage Vsig1 to the basic voltage Vofs (part A in FIG. 3).

(Bootstrap Stop Period T6: t15 to t17)

Next, as will be described below, the drive circuit 20 stops the bootstrap operation (bootstrap stop period T6). To be specific, first of all, at a timing t15 in a period when the signal lines DTL and the power lines DSL are respectively kept at the basic voltage Vofs and the voltage Voff, the scan line drive circuit 23 increases the voltage of the scan lines WSL from Voff to Von (part B in FIG. 3). In response thereto, the write transistor Tr1 is put in the ON state so that the gate potential Vg of the drive transistor Tr2 starts showing a gradual decrease to the value of the basic voltage Vofs corresponding to the voltage of the signal lines DTL at this time (part D in FIG. 3). In response to such a decrease of the gate potential Vg, the source potential Vs of the drive transistor Tr2 also starts showing a gradual decrease due to the capacity coupling via the retention capacitors Cs (part E in FIG. 3). In this manner, in the bootstrap period T6, the basic voltage Vofs is written into the gate of the drive transistor Tr2 so that the bootstrap operation is restricted or prevented. As a result, although the details will be described later, the amount of mobility correction (corresponding to the potential difference ΔV1) is reduced during the application of the gray-scale interpolation voltage Vsig1 (part E in FIG. 3).

(Mobility Correction/Signal Write Period T7: t17 to t18)

Next, as will be described later, the drive circuit 20 writes the video signal voltage Vsig2 (performs signal writing), and at the same time, makes a second-time mobility correction. To be specific, first of all, at a timing t17 in a period when the signal lines DTL are at the video signal voltage Vsig2, and when the power lines DSL are at the voltage Vcc, the scan line drive circuit 23 increases the voltage of the scan lines WSL from Voff to Von (part B in FIG. 3). In response thereto, the write transistor Tr1 is put in the ON state so that the gate potential Vg of the drive transistor Tr2 is increased to the video signal voltage Vsig2 corresponding to the voltage of the signal lines DTL at this time (part D in FIG. 3). At this time, the organic EL elements 12 are still in the cut-off state because the anode voltage of each thereof is yet smaller than the voltage value of (Vel+Vca), which is the sum of the threshold voltage Vel and the cathode voltage Vca in each of the organic EL elements 12. In other words, in this stage, no current flows between the anode and the cathode of each of the organic EL elements 12 (the organic EL elements 12 do not emit light). Accordingly, the current Id coming from the drive transistor Tr2 is directed to the above-described element capacity (not shown) disposed in each of the organic EL elements 12 so that these element capacities are charged. As a result, the source potential Vs of the drive transistor Tr2 is increased by a potential difference ΔV2 (part E in FIG. 3) so that the gate-source voltage Vgs takes the value of (Vsig2+Vth−(ΔV1+ΔV2)).

At this time, in response to an increase of the mobility μ of the drive transistor Tr2, the source potential Vs is also increased more, i.e., more than the potential difference ΔV2, similarly in the first-time mobility correction. As such, as described above, the gate-source voltage Vgs is reduced by this potential difference ΔV2 before the light emission that will be described later, thereby being able to effectively prevent the mobility μ from varying irrespective of the pixel 11. In this manner, the second-time mobility correction is made at the same time as the signal writing.

(Light Emission Period T8 (T0): t18 and thereafter)

Next, at a timing t18 in a period when the signal lines DTL and the power lines DSL are respectively kept at the video signal voltage Vsig2 and the voltage Vcc, the scan line drive circuit 23 reduces the voltage of the scan lines WSL from Von to Voff (part B in FIG. 3). In response thereto, the write transistor Tr1 is put in the OFF state, and the gate of the drive transistor Tr2 is put in the floating state. As a result, the current Id starts flowing between the drain and the source of the drive transistor Tr2 in the state that the gate-source voltage Vgs is fixed in value in the drive transistor Tr2. As a result, the source potential Vs of the drive transistor Tr2 goes up (E in FIG. 3), and in response thereto, the gate potential Vg thereof also goes up due to the capacity coupling via the retention capacitors Cs (part D in FIG. 3). This accordingly increases the anode voltage of each of the organic EL elements 12 to be larger than the voltage value of (Vel+Vca), which is the sum of the threshold voltage Vel and the cathode voltage Vca in each of the organic EL elements 12. Accordingly, the current Id starts flowing between the anode and the cathode of each of the organic EL elements 12 so that the organic EL elements 12 start emitting light with a predetermined level of luminance (light emission period T8 (T0)).

(Repetition)

Next, after the lapse of a predetermined length of period, the drive circuit 20 completes the light emission period T8 (T0). To be specific, similarly to the above, at the timing t1, the power line drive circuit 25 reduces the voltage of the power lines DSL from Vcc to Vini (part C in FIG. 3). In response thereto, the source potential Vs starts showing a decrease in the drive transistor Tr2, and eventually reaches the value of the voltage Vini (part E in FIG. 3). As such, the anode voltage of each of the organic EL elements 12 becomes smaller than the voltage value of (Vel+Vca), which is the sum of the threshold voltage Vel and the cathode voltage Vca in each of the organic EL elements 12, and thus the current Id stops flowing between the anodes and the cathodes in the organic EL elements 12. As a result, after this timing t1, the organic EL elements 12 stop emitting light, i.e., the procedure goes to the light-off period T10 described above. Thereafter, the drive circuit 20 performs display drive to periodically repeat the above-described periods T1 to T8 (T0) on a frame period basis. The drive circuit 20 also uses a selection pulse and a control pulse for scanning in the line direction for every horizontal period (1H period), for example. Herein, the selection pulse is for application to the power lines DSL, and the control pulse is for application to the scan lines SWL. In such a manner, the display operation is performed in the display device 1, i.e., display driving is operated by the drive circuit 20.

(3. Operation of Gray-Scale Interpolation)

Described next in detail is one of the features during the display operation in the display device 1 in this embodiment, i.e., operation of gray-scale interpolation by the drive circuit 20 (operation of gray-scale interpolation to each of the organic EL elements 12 in terms of light emission luminance) in comparison with operations of gray-scale interpolation in comparison examples (comparison examples 1 and 2).

(3-1. Operation of Gray-Scale Interpolation in Comparison Examples)

Figure 4:
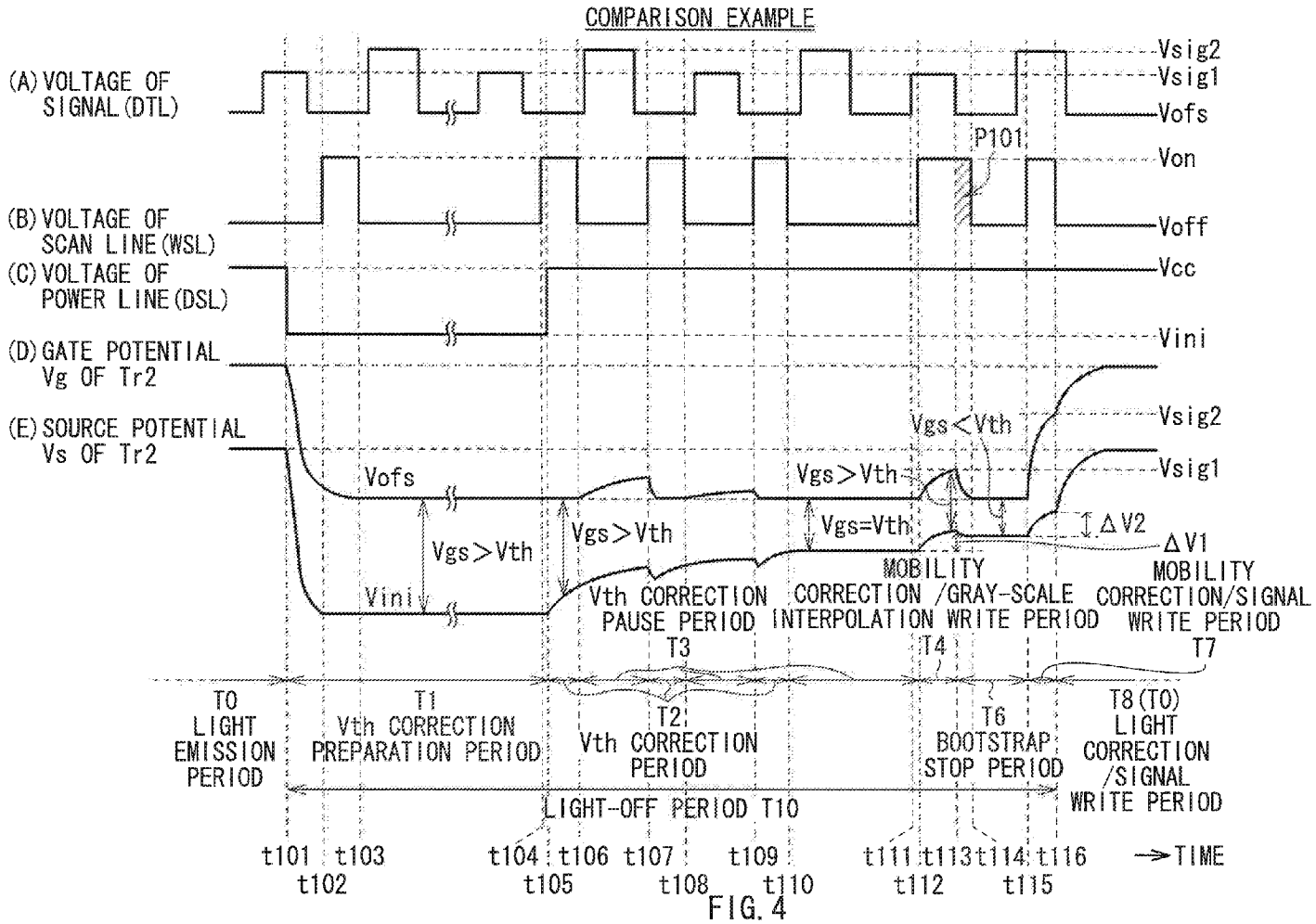
FIG. 4 is a timing chart for an exemplary operation of a display device according to a comparison example 1.

FIG. 4 is a timing chart showing various exemplary waveforms during the display operation in the display device in a comparison example 1, i.e., timings t101 to t116. In FIG. 4, similarly to parts A to C in FIG. 3 described above, part A shows a voltage waveform of the signal lines DTL, part B shows that of the scan lines WSL, and part C shows that of the power lines DSL. Also in FIG. 4, similarly to parts D and E in FIG. 3 described above, part D shows the waveform of a gate potential Vg in the drive transistor Tr2, and part E shows the waveform of a source potential Vs therein.

As to the display operation in this comparison example 1, the operation in a period of timings t101 to t112 is basically similar to the display operation by the display device 1, i.e., operation in the period of timings t1 to t12 in FIG. 3. Such an operation in the period of timings t101 to t112 includes the Vth correction preparation period T1, the first- to third-time Vth correction periods T2, and the first- to third-time Vth correction pause period T3. The operation in a period after a timing t115, i.e., a mobility correction/signal write period T7, and a light emission period T8 (T0), is basically similar to the display operation by the display device 1, i.e., operation in the period after the timing t17 in FIG. 3.

On the other hand, as to the display operation in the comparison example 1, the operation in a period of timings t112 to t115, i.e., the mobility correction/gray-scale interpolation write period T4, and the bootstrap stop period T6, is not the same as the operation in the period of timings t12 to t17 by the display device 1. In other words, although the details will be described later, in the comparison example 1, even after the application voltage to the signal lines DTL is changed at the timing t113 from the gray-scale interpolation voltage Vsig1 to the basic voltage Vofs, the application voltage to the scan lines WSL remains at the voltage Von (part B in FIG. 4). At the timing t114 in the period when the application voltage to the signal lines DTL is at the basic voltage Vofs, the application voltage to the scan lines WSL is changed from Von to Voff (part B in FIG. 4). As such, in this comparison example 1, the bootstrap period T5 is not provided unlike in the embodiment, and the bootstrap stop period T6 follows immediately after the mobility correction/signal write period T4.

Also during the display operation in this comparison example 1, similarly to that in the embodiment, the "two-step drive scheme" is used, i.e., signal writing is performed in two steps. To be specific, as shown in FIG. 4, in a period of timings t111 to t116, the mobility correction/signal write period is provided before and after the bootstrap stop period T6, i.e., the mobility correction/gray-scale interpolation write period T4, and the mobility correction/signal write period T7). The signal line drive circuit 24 is capable of providing three different voltages (three-valued voltage) including the gray-scale interpolation voltage Vsig1, the video signal voltage Vsig2, and the basic voltage Vofs. Such a signal line drive circuit 24 applies two of such three voltages, i.e., the gray-scale interpolation voltage Vsig1 and the video signal voltage Vsig2, to each of the signal lines DTL in this order as shown in FIG. 4. The signal line drive circuit 24 also individually changes in value the gray-scale interpolation voltage Vsig1 and the video signal voltage Vsig2 as will be described later.

As such, similarly to the embodiment that will be described later, in the comparison example 1, an operation of gray-scale interpolation is performed to each of the organic EL elements 12 in terms of light emission luminance L as will be described in more detail later. As a result, this comparison example 1 enables the representation with a larger number of gray-scale levels than the number originally provided by the video signal 20A. The resulting gray-scale representation may be thus made with a higher definition with a simpler configuration of the drive circuit 20 (the signal line drive circuit 24), i.e., not adding complexity to the configuration thereof.

Such an operation of gray-scale interpolation is described below more in detail. That is, first of all, the signal line drive circuit 24 performs a value assignment to the video signal voltage Vsig2 as shown in parts A to D in FIG. 5, for example, i.e., assigns a value (value x in this example) corresponding to one of a plurality of gray-scale levels provided by the video signal 20A, e.g., gray-scale level based on 8-bit=256 gray-scale levels. Thereafter, as indicated by an arrow P11 in part A in FIG. 5, the signal line drive circuit 24 varies the gray-scale interpolation voltage Vsig1 in value to take a plurality of values. e.g., four voltage values of (y−3), (y−2), (y−1), and y in this example. The signal line drive circuit 24 then repeats such an operation, i.e., assigns another fixed value to the video signal voltage Vsig2 (a voltage value corresponding to any of the gray-scale levels not yet assigned), and then varies the gray-scale interpolation voltage Vsig1 in value again to take the values described.

Figure 5:
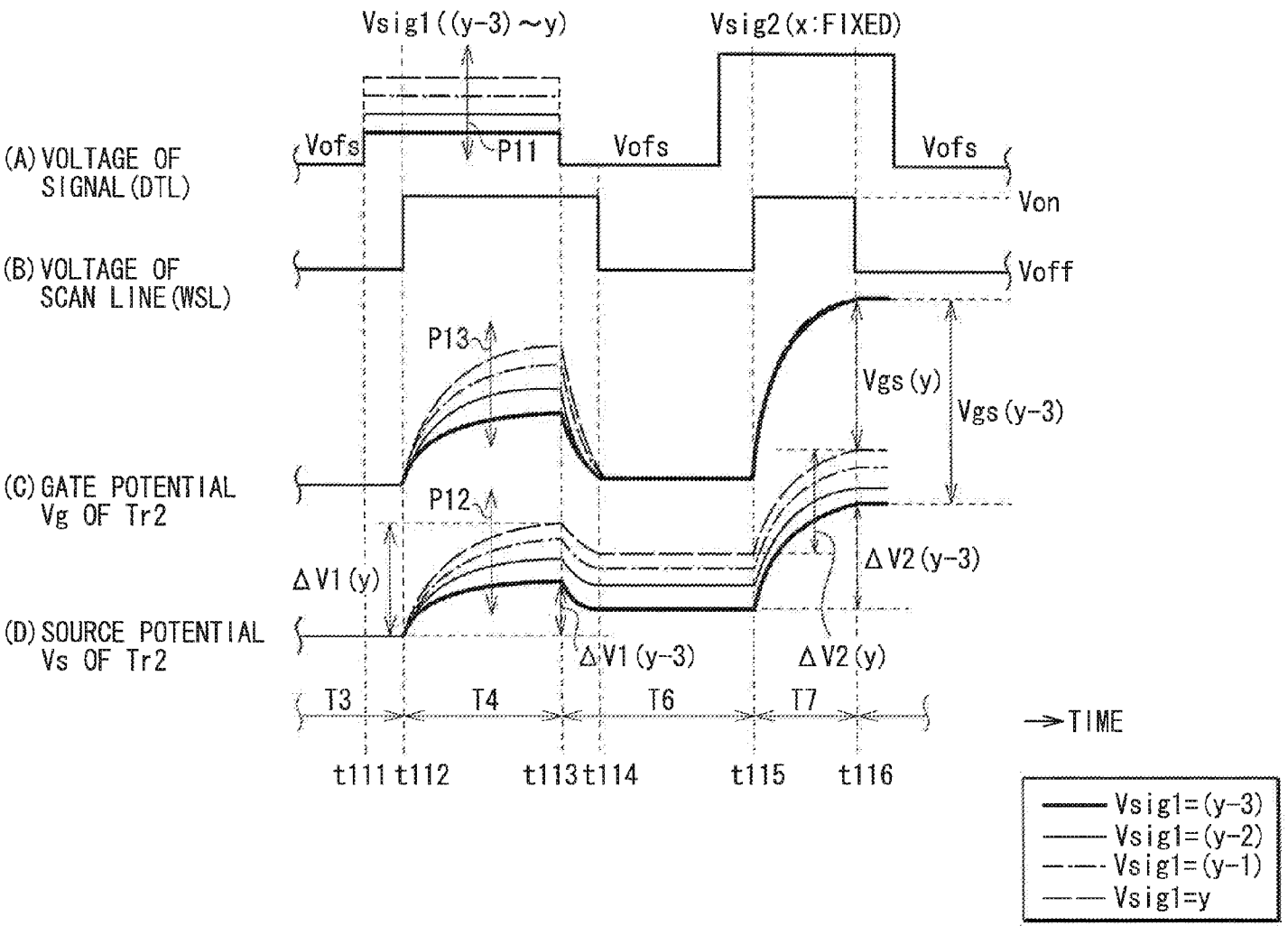
FIG. 5 is a timing chart for illustrating changes observed in the gate potential and in the source potential of a drive transistor in response to any change of a gray-scale interpolation voltage in the comparison example 1.

In this case, as indicated by the arrow P11 in part A in FIG. 5, and an arrow P12 in part D in FIG. 5, in response to the increase of the gray-scale interpolation voltage Vsig in value from (y−3) to y, the source potential Vs of the drive transistor Tr2 is also increased more after the completion of writing of the gray-scale interpolation voltage Vsig1. To be specific, the increase of the source potential Vs when the gray-scale interpolation voltage Vsig1 is at the value of (y), i.e., potential difference $\Delta V1(y)$, is larger than the increase of the source potential Vs when the gray-scale interpolation voltage Vsig1 is at the value of y−3 i.e., potential difference $\Delta V1(y-3)$ after the first-time mobility correction. At this time, in this mobility correction/gray-scale interpolation write period T4, as indicated by an arrow P13 in part C in FIG. 5, the gate potential Vg of the drive transistor Tr2 also shows an increase in response to such an increase of the source potential Vs therein. In other words, in response to the value increase of the gray-scale interpolation voltage Vsig1 from (y−3) to y, the gate potential Vg also shows an increase after the completion of writing of the gray-scale interpolation voltage Vsig1.

On the other hand, in the mobility correction/signal write period T7, the source potential Vs of the drive transistor Tr2 shows a constant increase, i.e., potential difference $\Delta V2$ after the second-time mobility correction, irrespective of the value of the gray-scale interpolation voltage Vsig1 as shown in part D in FIG. 5. This is because, as already described above, the increase of the source potential Vs in the period T7 (potential difference $\Delta V2$) is determined by the value (value x in this example) of the video signal voltage Vsig2 to be written during this period. At the end of this period T7, also as described above, the gate potential Vg of the drive transistor Tr2 takes the value of the video signal voltage Vsig2, e.g., value x in this example (part C in FIG. 5). As such, as shown in FIG. 5, in response to the value increase of the gray-scale interpolation voltage Vsig1 from (y−3) to y, the gate-source voltage Vgs of the drive transistor Tr2 shows a decrease after the completion of writing of the video signal voltage Vsig2, i.e., during the operation of light emission. To be specific, the gate-source voltage Vgs(y) when the gray-scale interpolation voltage Vsig1 is at the value of y is lower than the gate-source voltage Vgs(y−3) when the gray-scale interpolation voltage Vsig1 is at the value of (y−3), for example.

Figure 6:
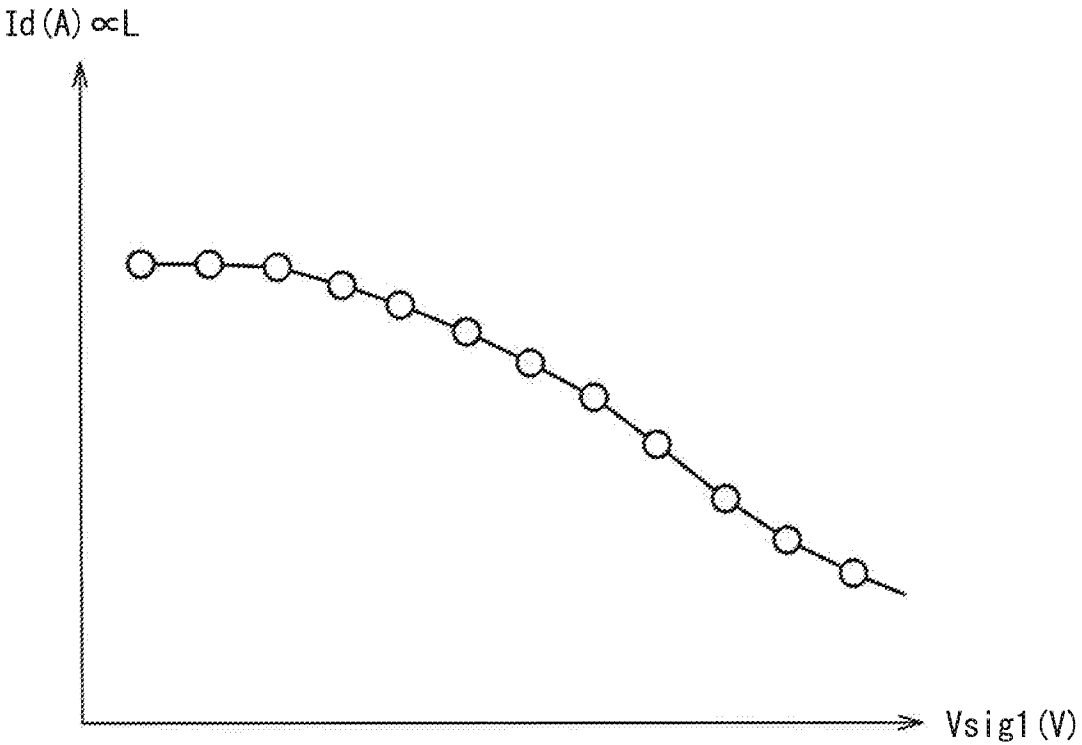
FIG. 6 is a characteristics diagram showing an exemplary relationship, i.e., current-change characteristics of the gray-scale interpolation voltage, between the gray-scale interpolation voltage and a current flowing through the drive transistor, i.e., light emission luminance, in the comparison example 1.

Accordingly, as exemplarily shown in FIG. 6, due to the reduced gate-source voltage Vgs of the drive transistor Tr2 during the operation of light emission associated with the value increase of the gray-scale interpolation voltage Vsig1, the current Id flowing through the drive transistor Tr2 is reduced. In proportion to the reduction of the current Id as such, the organic EL elements 12 are also reduced in light emission luminance L.

Figure 7:
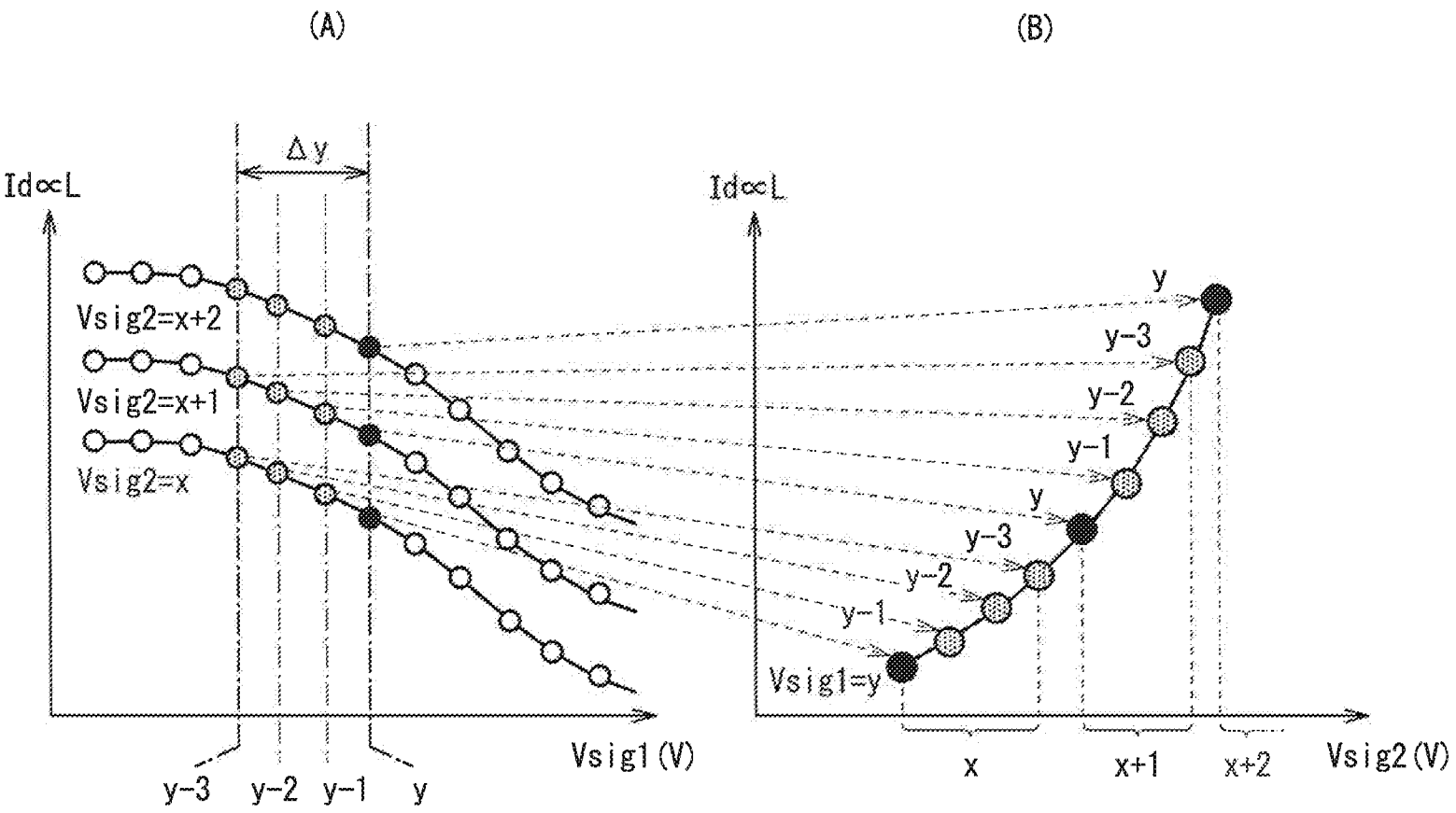
FIGS. 7A and 7B are characteristics diagrams respectively showing an exemplary relationship of the current flowing through the drive transistor with the gray-scale interpolation voltage in the comparison example 1, and an exemplary relationship thereof with a video signal voltage therein.

Utilizing such a phenomenon, the signal line drive circuit 24 in the comparison example 1 performs an operation of gray-scale interpolation like a gamma curve exemplarily shown in FIGS. 7A and 7B. In other words, the signal line drive circuit 24 performs a value selection and assignment to each of the values corresponding to the gray-scale levels provided by the video signal voltage Vsig2, i.e., x, x+1, x+2, and others (FIG. 7B). The values to be selectively assigned as such are those corresponding to 4 gray-scale levels provided by the gray-scale interpolation voltage Vsig1, i.e., (y−3), (y−2), (y−1), and y (FIG. 7A). Herein, the voltage range Δy in FIG. 7A indicates the range of 4 gray-scale levels provided by the gray-scale interpolation voltage Vsig1. As such, when the value x or others provided by the video signal voltage Vsig2 corresponds to the gray-scale level based on 8-bit i.e., $2^8$=256 gray-scale levels, for example, this gray-scale level based on 8-bit is subjected to 2-bit ($2^2$=4 gray-scale levels) interpolation so that the gray-scale level based on 10-bit ($2^{10}$=1024 gray-scale levels) is realized. In other words, by using the value y or others provided by the gray-scale interpolation voltage Vsig1 (gray-scale interpolation voltage) to the value x or others provided by the video signal voltage Vsig2 (fundamental gray-scale voltage), interpolation of gray-scale level based on 2-bit (4 gray-scale levels) is performed so that the gray-scale level based on 10-bit is realized.

Also in this comparison example 1, similarly to the embodiment that will be described later, the bootstrap stop period T6 is provided before the mobility correction/gray-scale interpolation write period T7 and after the mobility correction/signal write period T4 (refer to a reference numeral P101 in FIG. 4). As such, in the period indicated by the reference numeral P101 (period of timings t113 to t114), similarly to the embodiment described by referring to FIG. 3, the gate potential Vg of the drive transistor Tr2 shows a gradual decrease toward the basic voltage Vofs corresponding to the voltage of the signal lines DTL (part D in FIG. 4). In response to such a decrease of the gate potential Vg, the source potential Vs of the drive transistor Tr2 also starts showing a gradual degrease due to the capacity coupling via the retention capacitors Cs (part E in FIG. 4). With such a decrease, also in the bootstrap stop period T6 in the comparison example 1, the bootstrap operation is restricted or prevented by the writing of the basic voltage Vofs to the gate of the drive transistor Tr2. To be specific, compared with a case with no operation indicated by this reference numeral P101 (comparison example 2; with no application of the voltage Von to the scan lines WSL during the application period for the basic voltage Vofs, and with no bootstrap stop period T6), the bootstrap operation is restricted or prevented more in the application period of the basic voltage Vofs.

Figure 8:
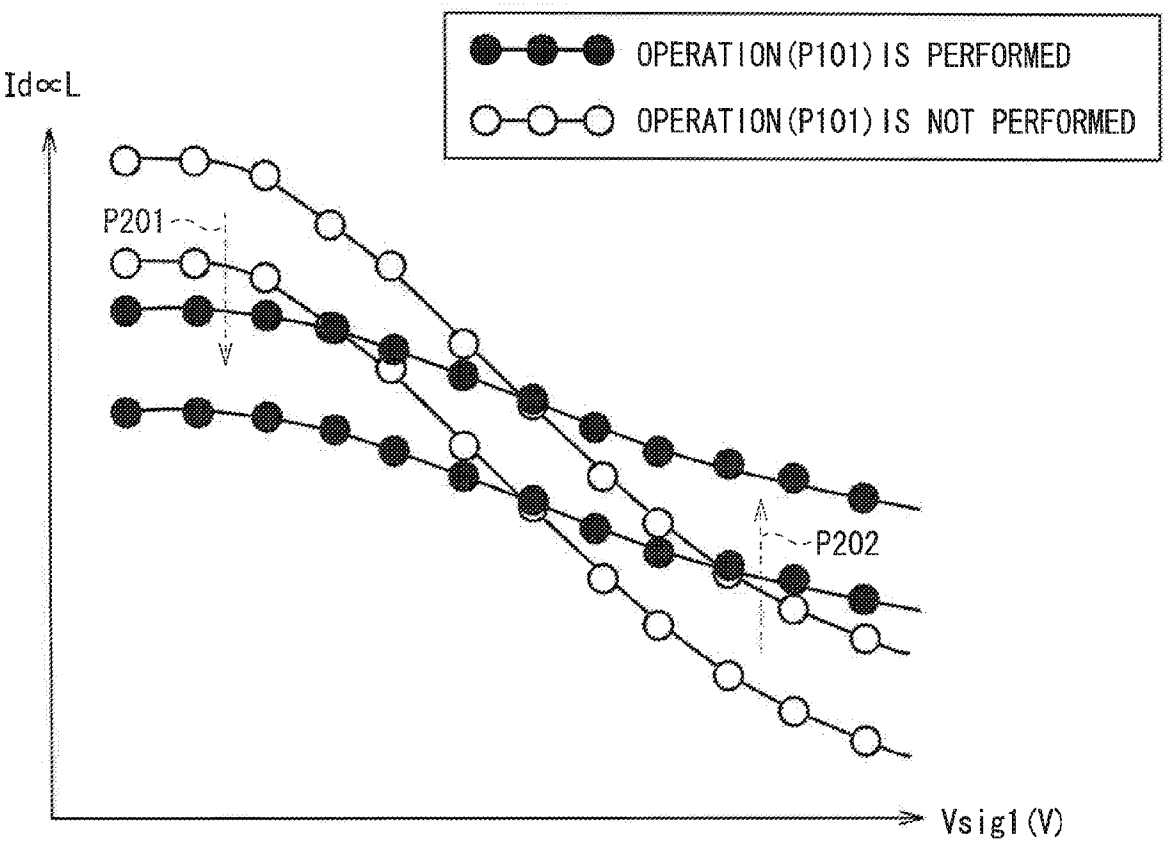
FIG. 8 is a characteristics diagram of exemplary current-change characteristics of the gray-scale interpolation voltage in the comparison example 1 and in a comparison example 2.

As a result, in the comparison example 1 and in the embodiment (the case with the operation indicated by the reference numeral P101) that will be described later, the amount of mobility correction during the application of the gray-scale interpolation voltage Vsig1, i.e., potential difference Δ1, is smaller than that in the comparison example 2 (the case with no operation indicated by the reference numeral P101). The smaller amount of mobility correction accordingly leads to a smaller amount of change of the current Id as exemplarily indicated by arrows P201 and P202 in FIG. 8 after the increase of the gray-scale interpolation voltage Vsig1 in the comparison example 1 and the embodiment that will be described later. In other words, a smaller amount of change of the current Id means a smaller amount of mobility correction (potential difference ΔV1) during the application of the gray-scale interpolation voltage Vsig1 so that the rise and fall thereof become gradual in the characteristics of current change with respect to the gray-scale interpolation voltage Vsig1 as shown in FIG. 8.

Figure 9:
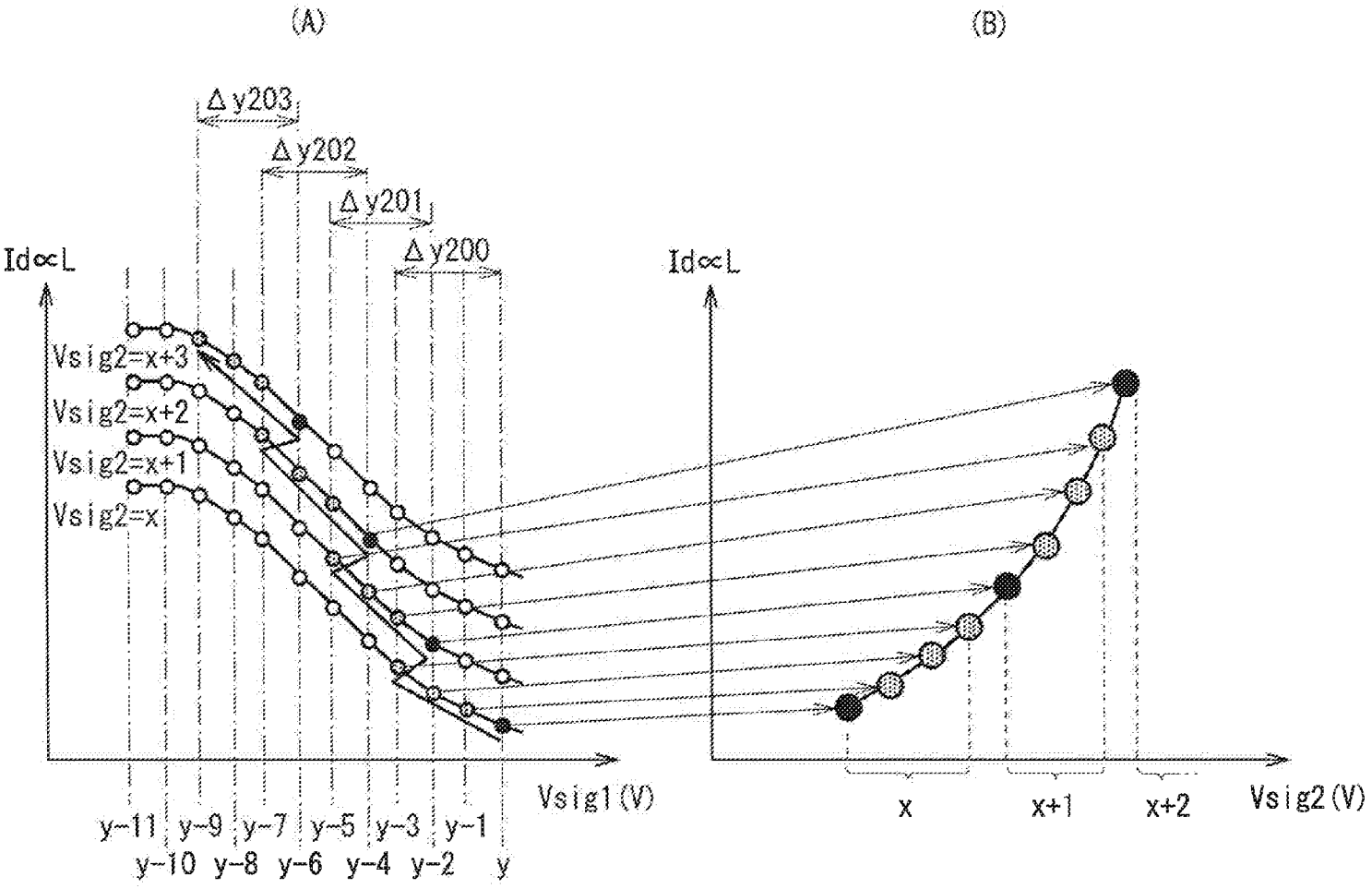
FIGS. 9A and 9B are characteristics diagrams respectively showing an exemplary relationship of a current flowing through a drive transistor with the gray-scale interpolation voltage in the comparison example 2, and an exemplary relationship thereof with a video signal voltage therein.

As such, in the comparison example 1 and the embodiment that will be described later, a selection pulse is applied not only in the application period for the gray-scale interpolation voltage Vsig1 but also in the application period for the basic voltage Vofs, i.e., the voltage Von is applied to the scan lines WSL. This application of selection pulses as such favorably solves problems as below observed in the comparison example 2. That is, the comparison example 2 shows a larger amount of mobility correction (potential difference ΔV1) during the application of the gray-scale interpolation voltage Vsig1 so that the characteristics of current change show the sharp rise and fall with respect to the gray-scale interpolation voltage Vsig1 as shown in FIG. 9A. Accordingly, for the operation of gray-scale interpolation as shown in FIGS. 9A and 9B, unlike with the operation in the comparison example 1 and that in the embodiment in FIGS. 7A and 7B, the comparison example 2 causes a difficulty in setting the values of the gray-scale interpolation voltage Vsig1 to fall within almost the same range for application to the video signal voltage Vsig2 irrespective of the gray-scale levels. In other words, in this comparison example 2, the values in need for the operation of gray-scale interpolation vary depending on gray-scale levels of the video signal voltage Vsig2 (refer to voltage ranges Δy200 to Δy203 in FIG. 9A). As such, with the operation of gray-scale interpolation in the comparison example 2, there needs to provide any additional memory to the peripheral circuit such as the signal line drive circuit 24, thereby resulting in the increase of cost.

On the other hand, with the operation of gray-scale interpolation in the comparison example 1 and that in the embodiment that will be described later, as described above, the characteristics of current change show the gradual rise and fall with respect to the gray-scale interpolation voltage Vsig1. As a result, as shown in FIG. 7A, for the operation of gray-scale interpolation, there is no difficulty in setting the values of the gray-scale interpolation voltage Vsig1 to fall within almost the same range for application to the video signal voltage Vsig2 irrespective of the gray-scale levels (refer to the value range Δy in FIG. 7A). There thus is no need to provide any additional memory to the peripheral circuit such as the signal line drive circuit 24 unlike in the comparison example 2 described above, thereby preventing any increase of cost.

Figure 10:
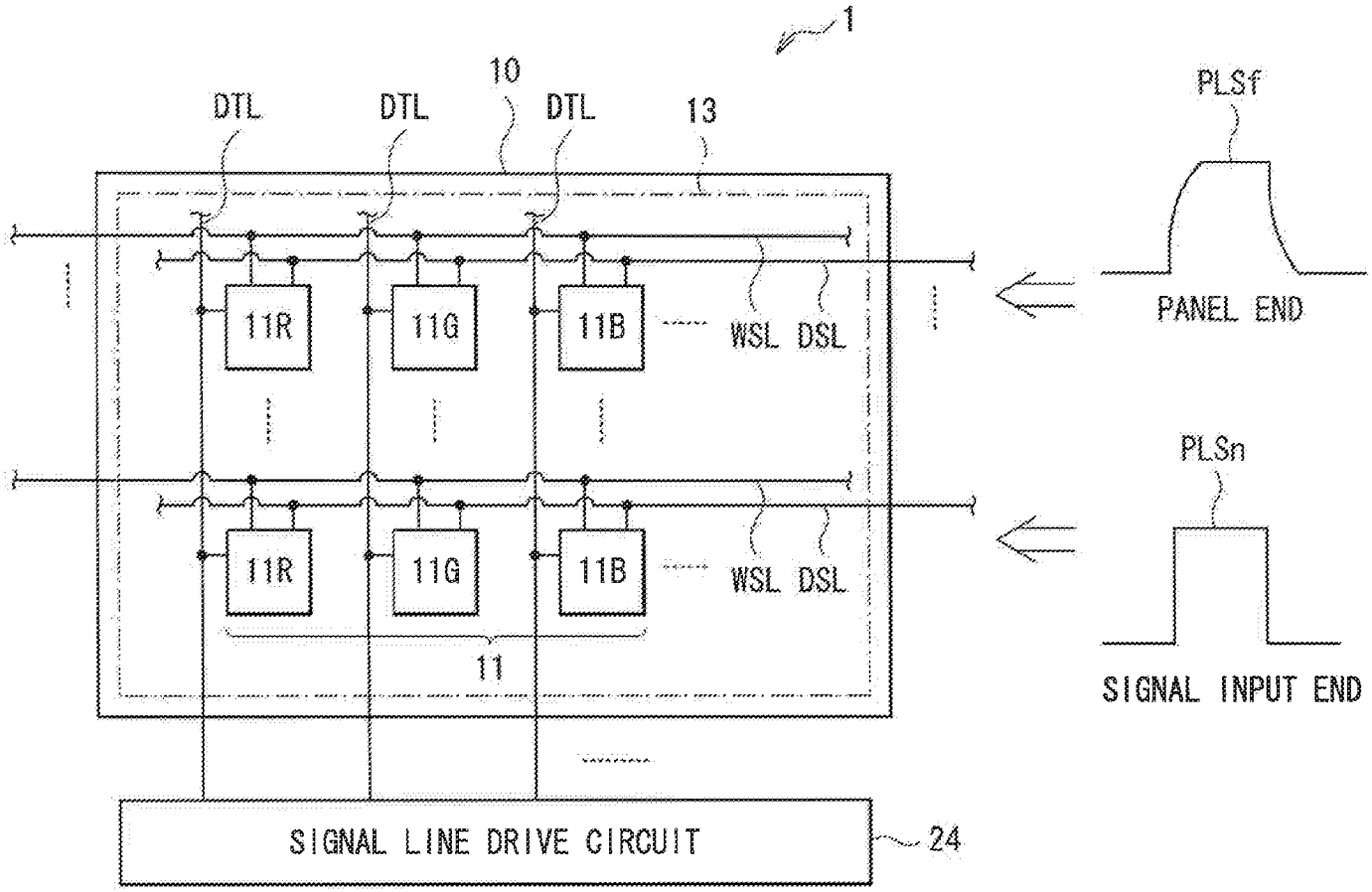
FIG. 10 is a diagram for illustrating how a signal-pulse waveform looks different at a signal input end of a display panel and at a panel end thereof.

The concern here is that, however, even such an operation of gray-scale interpolation in the comparison example 1 may cause problems as below in some cases. That is, as exemplarily shown in FIG. 10, first of all, especially with the display panel 10 large in size, the distance from the signal line drive circuit 24 to each of the pixels 11 (distance in the vertical direction (V-direction)) is large. Such a larger distance causes rounding of signal-pulse waveforms of the voltages, i.e., the gray-scale interpolation voltage Vsig1 and the video signal voltage Vsig2, due to the wiring resistance of the signal lines DTL and the capacity thereof. To be specific, as shown in FIG. 10, with a pixel not that much away from the signal line drive circuit 24, i.e., the pixel 11 closer to the signal input end, the signal pulses PLSn show the sharp rise and fall. On the other hand, with a pixel away from the signal line drive circuit 24, i.e., the pixel 11 closer to the panel end, the signal pulses PLSf show the gradual rise and fall.

Figure 11:
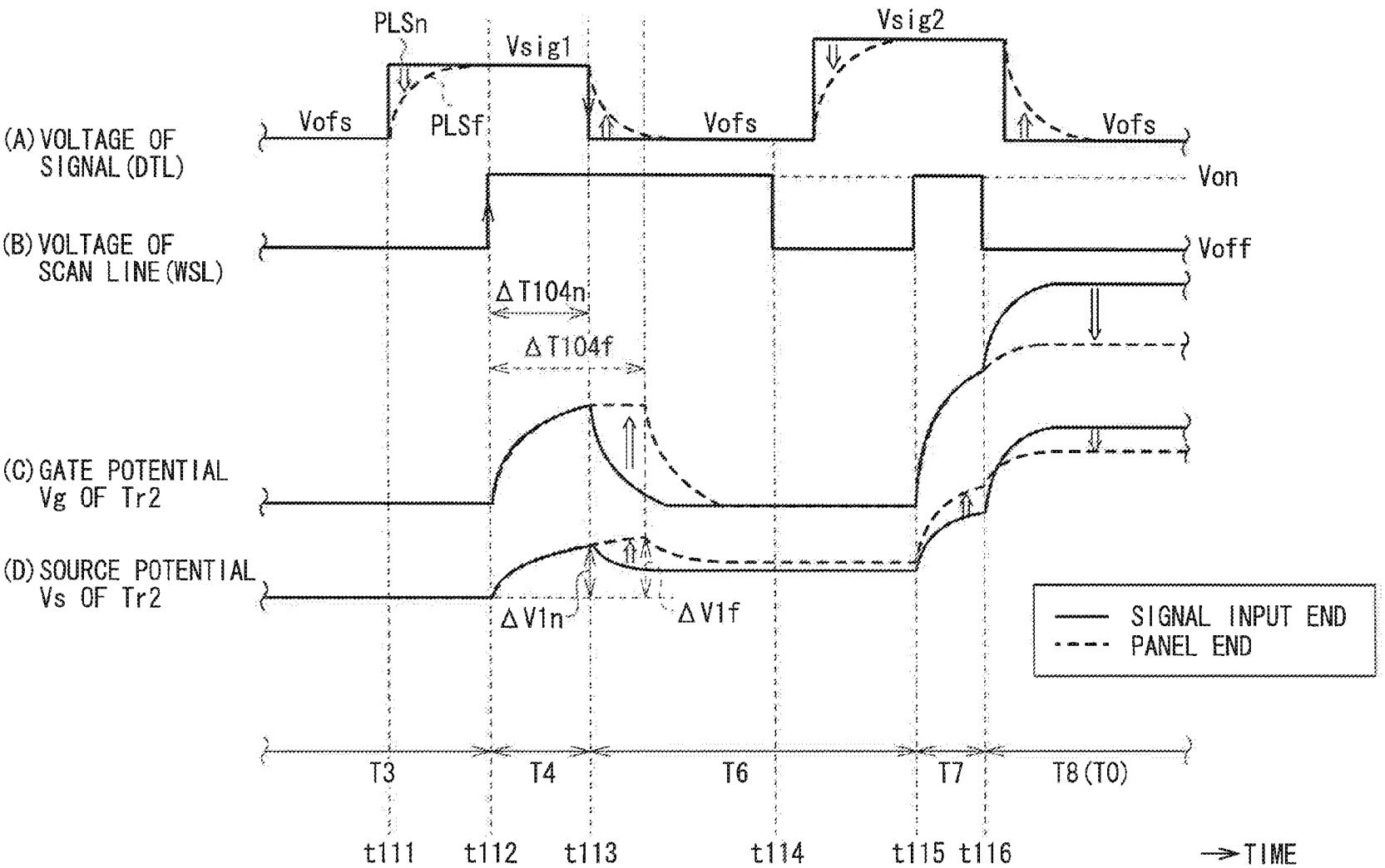
FIG. 11 is a timing chart showing in detail an operation of gray-scale interpolation in the comparison example 1 of FIG. 4.

In the operation of gray-scale interpolation in the comparison example 1, as indicated by arrows in parts A and B in FIG. 11, the length of the write period for the gray-scale interpolation voltage Vsig1 is determined as below. That is, the length is determined by the timing when the application voltage to the scan lines WSL rises in the application period for the gray-scale interpolation voltage Vsig1 (timing t112), and the timing when the gray-scale interpolation voltage Vsig1 falls (timing t113). In other words, the length is determined by the timing when the application voltage to the scan lines WSL switches from Voff to Von, and the timing when the application voltage to the signal lines DTL switches from the gray-scale interpolation voltage Vsig1 to the basic voltage Vofs. This is because, in the comparison example 1, any same selection pulse (voltage Von to the scan lines WSL) is continuously applied from the application period for the gray-scale interpolation voltage Vsig1 to that for the basic voltage Vofs.

Accordingly, as indicated by open arrows in FIG. 10 and in part A in FIG. 11, if the waveform of signal pulses looks different depending on the pixel position in the display panel 10 (like pulse waveforms PLSn and PLSf), such a difference of signal pulse causes problems as below in the comparison example 1. That is, first of all, with a pixel not that much away from the signal line drive circuit 24 (the pixel 11 closer to the signal input end), the signal pulses PLSn show the sharp rise and fall (part A in FIG. 11), and thus a write period ΔT104*n* for the gray-scale interpolation voltage Vsig1 is relatively short in length (part C in FIG. 11). On the other hand, with a pixel away from the signal line drive circuit 24 (the pixel 11 closer to the panel end), the signal pulses PLSf show the gradual rise and fall (part A in FIG. 11), and thus a write period ΔT104*f* for the gray-scale interpolation voltage Vsig1 is relatively long (part C in FIG. 11). As such, the write period for the gray-scale interpolation voltage Vsig1 varies depending on the pixel position in the display panel 10, and due to the write periods varying in length as such, the amount of mobility correction during the application of this gray-scale interpolation voltage Vsig1 (potential difference ΔV1) also varies depending on the pixel position. To be specific, as shown in parts C and D in FIG. 11, the write period for the gray-scale interpolation voltage Vsig1 is longer for the pixel 11 closer to the panel end than that for the pixel 11 closer to the signal input end (ΔT104*n*<ΔT104*f*), thereby increasing also the amount of mobility correction (potential difference ΔV1*n*<potential difference ΔV1*f*).

Figure 12:
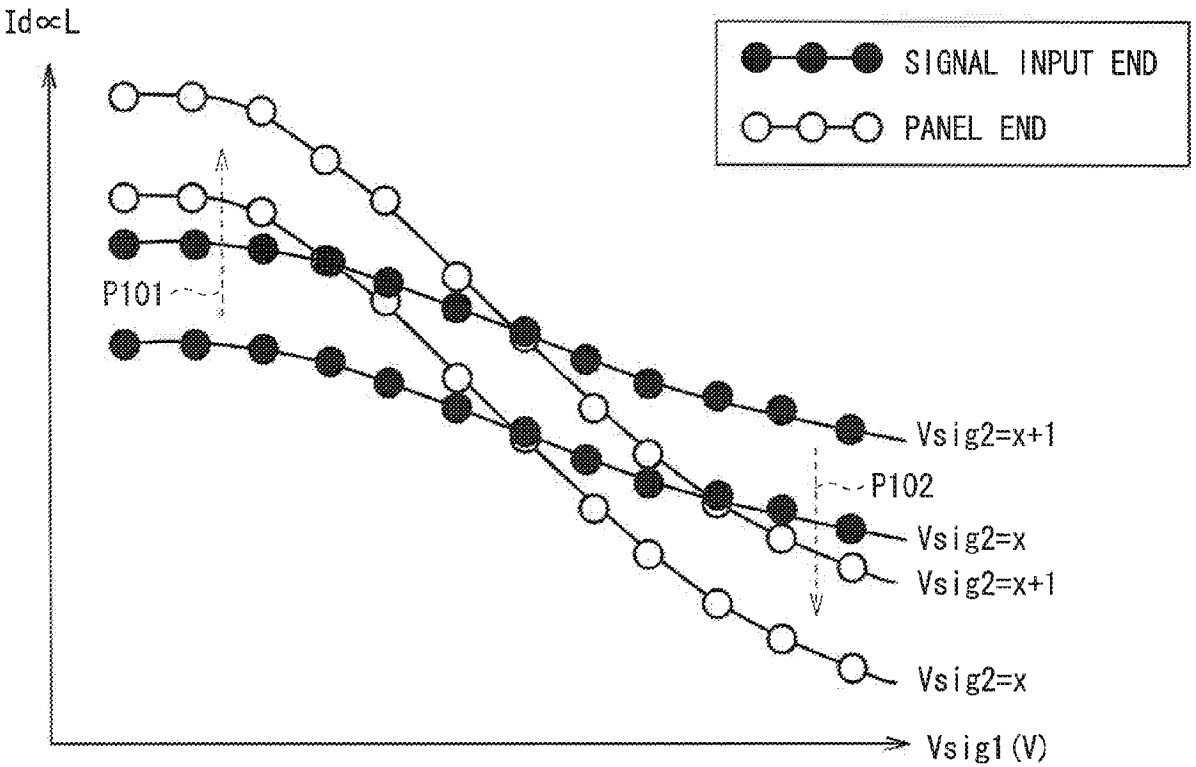
FIG. 12 is a characteristics diagram for illustrating how the current-change characteristics of the gray-scale interpolation voltage are different at a signal input end and at a panel end in the comparison example 1.
Figure 13A:
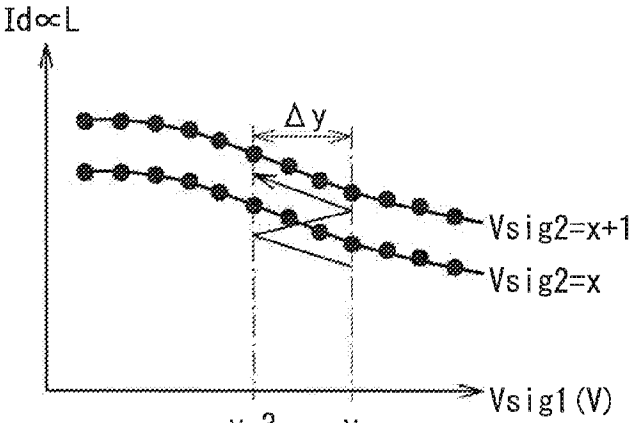
FIGS. 13A to 13D are characteristics diagrams respectively showing an exemplary relationship of the current flowing through the drive transistor with the gray-scale interpolation voltage at a signal input end and at a panel end in the comparison example 1, and an exemplary relationship thereof with the video signal voltage also at the signal input end and at the panel end therein.
Figure 13B:
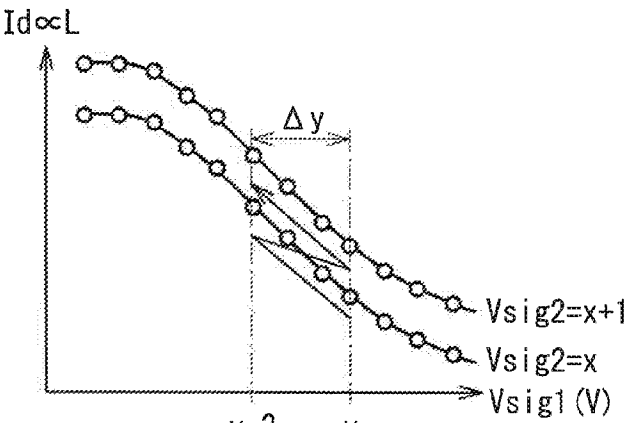
Figure 13C:
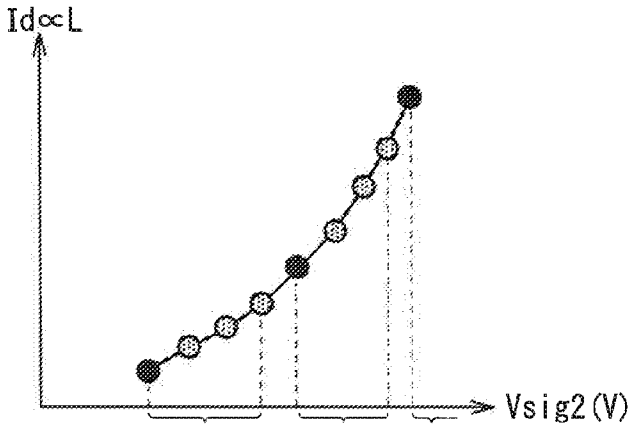
Figure 13D:
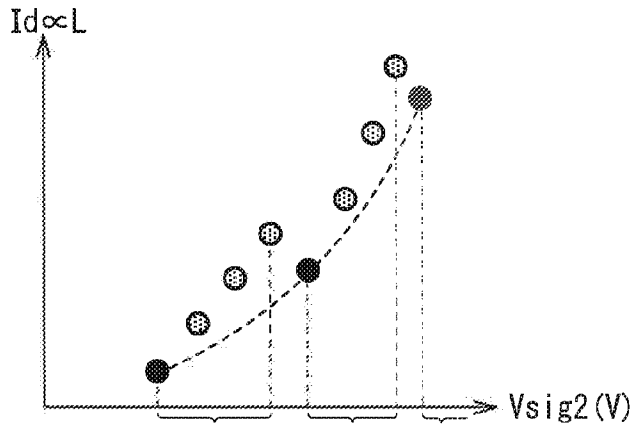

In response thereto, as exemplarily indicated by arrows P101 and P102 in FIG. 12, with the amount of mobility correction increased as such (potential difference ΔV1), compared with the pixel 11 closer to the signal input end, the pixel 11 closer to the panel end is with the sharp rise and fall in the characteristics of current change with respect to the gray-scale interpolation voltage Vsig1. Accordingly, with the operation of gray-scale interpolation in the comparison example 1, the voltage range Δy of the gray-scale interpolation voltage Vsig1 may not fall within the same range for application to the video signal voltage Vsig2 irrespective of the value. On the other hand, in order not to cause a need for any additional memory as described above, if any one specific voltage range Δy is applied to every pixel 11 in the display panel 10, such problems as shown in FIGS. 13A to 13D occur. In other words, as exemplarily shown in FIGS. 13A and 13C, the pixels 11 closer to the signal input end may be subjected to the gray-scale interpolation appropriately, i.e., smoothly, but the pixels 11 closer to the panel end may not be subjected to the gray-scale interpolation appropriately, i.e., smoothly.

Figure 14:
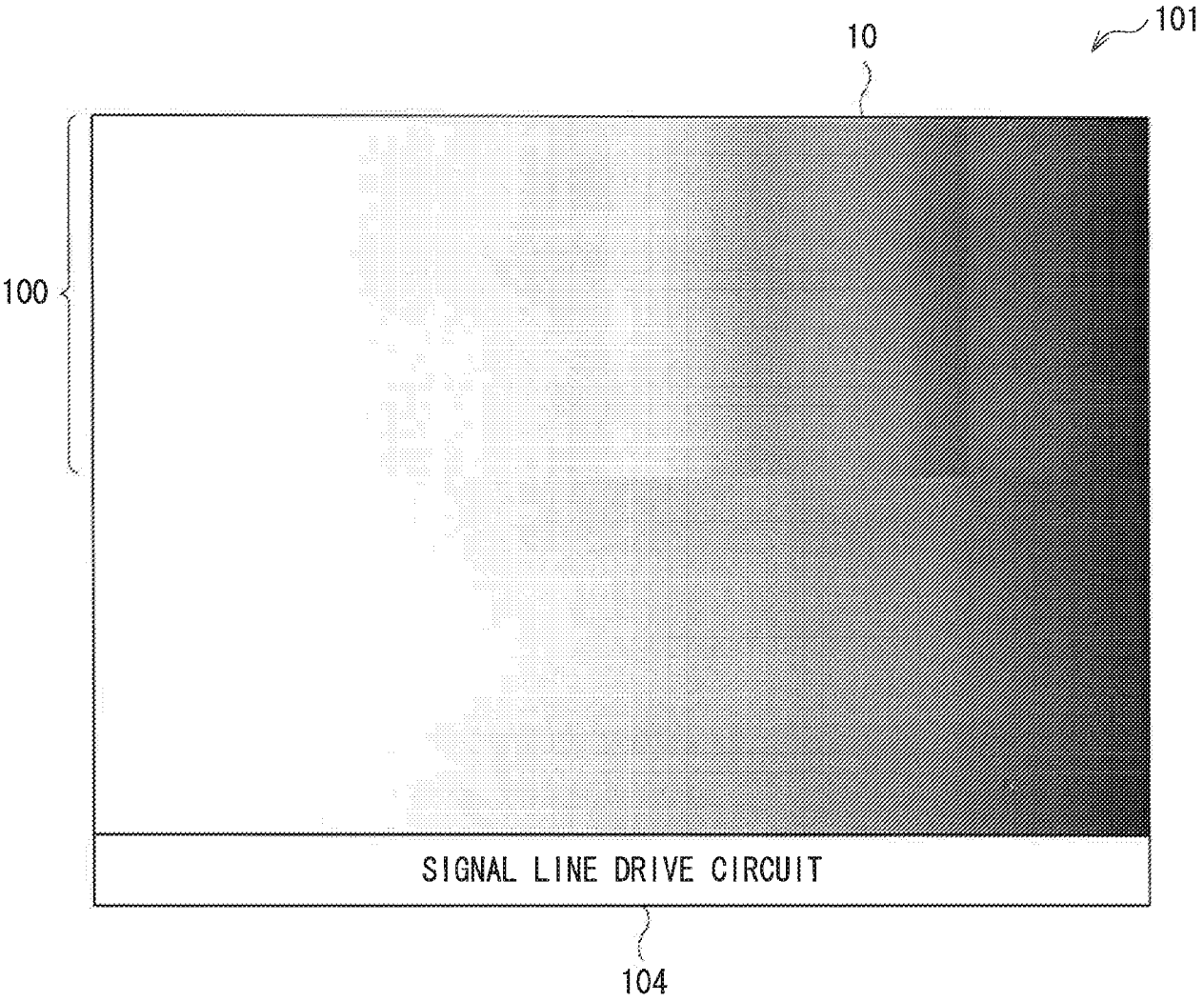
FIG. 14 is a schematic diagram for illustrating exemplary degradation of image quality in a display panel in the comparison example 1.

In this manner, in the operation of gray-scale interpolation in the comparison example 1, some pixels in the display panel 10 may not be subjected to the operation of gray-scale interpolation appropriately (smoothly). In this case, as exemplarily shown in FIG. 14, the region of such pixels may be degraded in image quality. To be specific, FIG. 14 is a diagram schematically showing a case in which a display device 101 in the comparison example 1 makes video display with a supply of lamp signal from a signal line drive circuit 104 to the display panel 10. In this case, the lamp display is clear in the region of the pixels closer to the signal input end, but in a region P100 of the pixels closer to the panel end, the lamp display is with periodically-appearing streaks due to the operation of gray-scale interpolation not performed appropriately (smoothly) as described above.

(3-2. Operation of Gray-Scale Interpolation in Embodiment)

Figure 15:
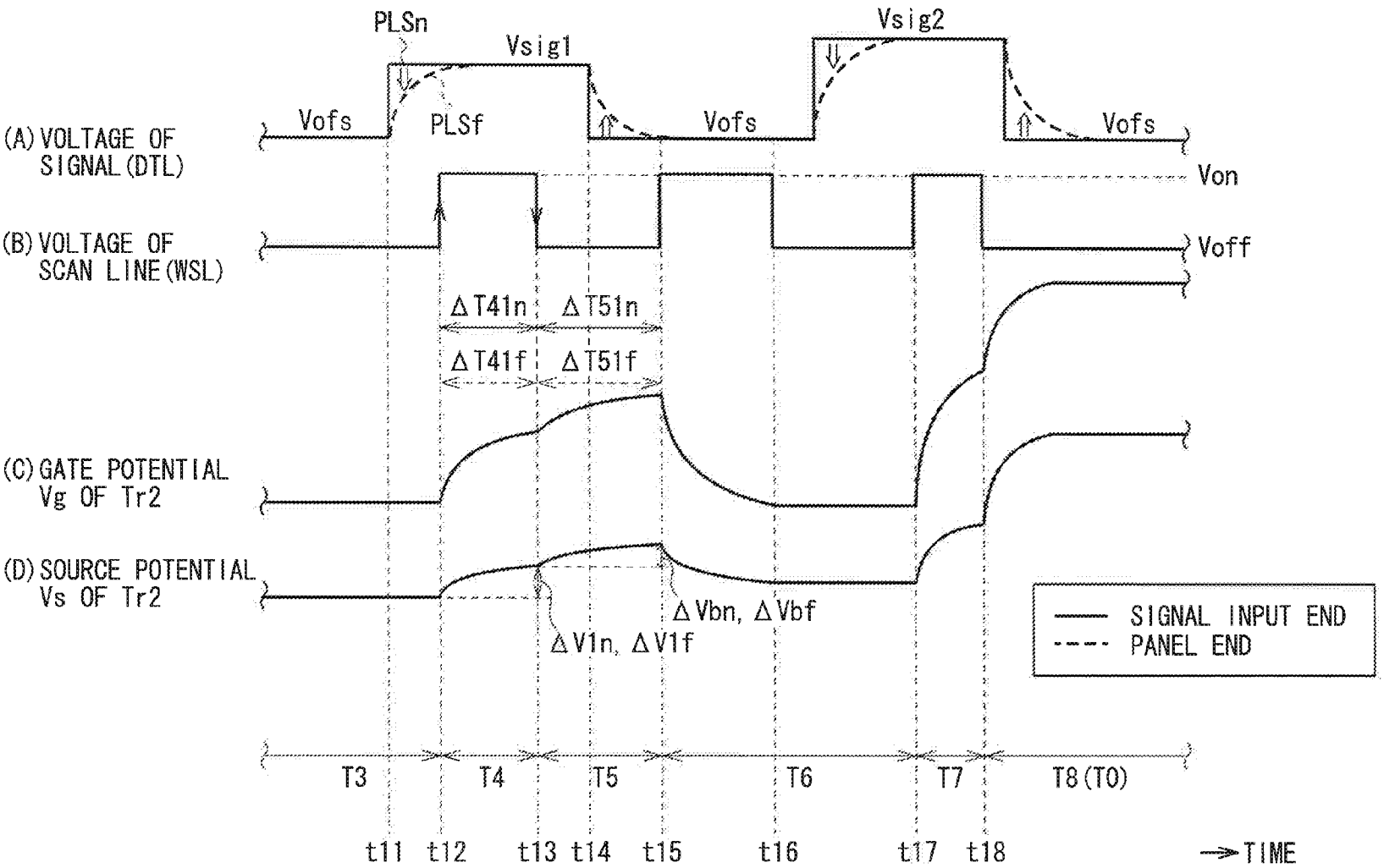
FIG. 15 is a timing chart showing in detail an operation of gray-scale interpolation according to the first embodiment of FIG. 3.

On the other hand, with the display device 1 in the embodiment, unlike in the comparison example 1 described above, an operation of gray-scale interpolation is performed as shown in A to D in FIG. 15, for example. First of all, the scan line drive circuit 23 applies a selection pulse (voltage Von) to the scan lines WSL separately in each corresponding application period for the gray-scale interpolation voltage Vsig1, the basic voltage Vofs, and the video signal voltage Vsig2. In other words, a selection pulse applied during the application period for the gray-scale interpolation voltage Vsig1 is not the one applied during the application period for the basic voltage Vofs (parts A and B in FIG. 15). As such, as indicated by an arrow in part A in FIG. 15, unlike in the above comparison example 1, the length of the write period for the gray-scale interpolation voltage is determined by how long the selection pulse is applied in the application period for the gray-scale interpolation voltage Vsig1.

Accordingly, in this embodiment, as indicated by open arrows in part A in FIG. 15, even if the waveform of signal pulses looks different depending on the pixel position in the display panel 10 (like pulse waveforms PLSn and PLSf), such problems as described in the comparison example 1 do not occur any more. In other words, the write period for the gray-scale interpolation voltage Vsig1 is constant in length irrespective of the pixel position in the display panel 10, i.e., irrespective of the distance from the signal line drive circuit 24 to each of the pixels 11 (refer to write periods ΔT41*n* and ΔT41*f* in part C in FIG. 15). Such a constant length of the write period accordingly makes constant also the actual length of the bootstrap period T5 thereafter irrespective of the pixel position in the display panel 10 (refer to bootstrap execution periods ΔT51*n* and ΔT51*f* in part C in FIG. 15). As such, unlike in the comparison example 1, the amount of mobility correction during the application of the gray-scale interpolation voltage Vsig1 (potential difference ΔV1) is also fixed in value irrespective of the pixel position in the display panel 10. To be specific, not only the amount of mobility correction in the write periods ΔT41*n* and ΔT41*f* (potential differences ΔV1*n* and ΔV1*f*) but also the amount of mobility correction in the bootstrap execution periods ΔT51*n* and ΔT51*f* (potential differences ΔVbn and ΔVbvf) are fixed in value irrespective of the pixel position. In other words, the amount of mobility correction during the application of the gray-scale interpolation voltage Vsig1, by extension, the amount of mobility correction in a horizontal period in its entirety, does not vary that much or not vary at all irrespective of the pixel position.

Figure 16:
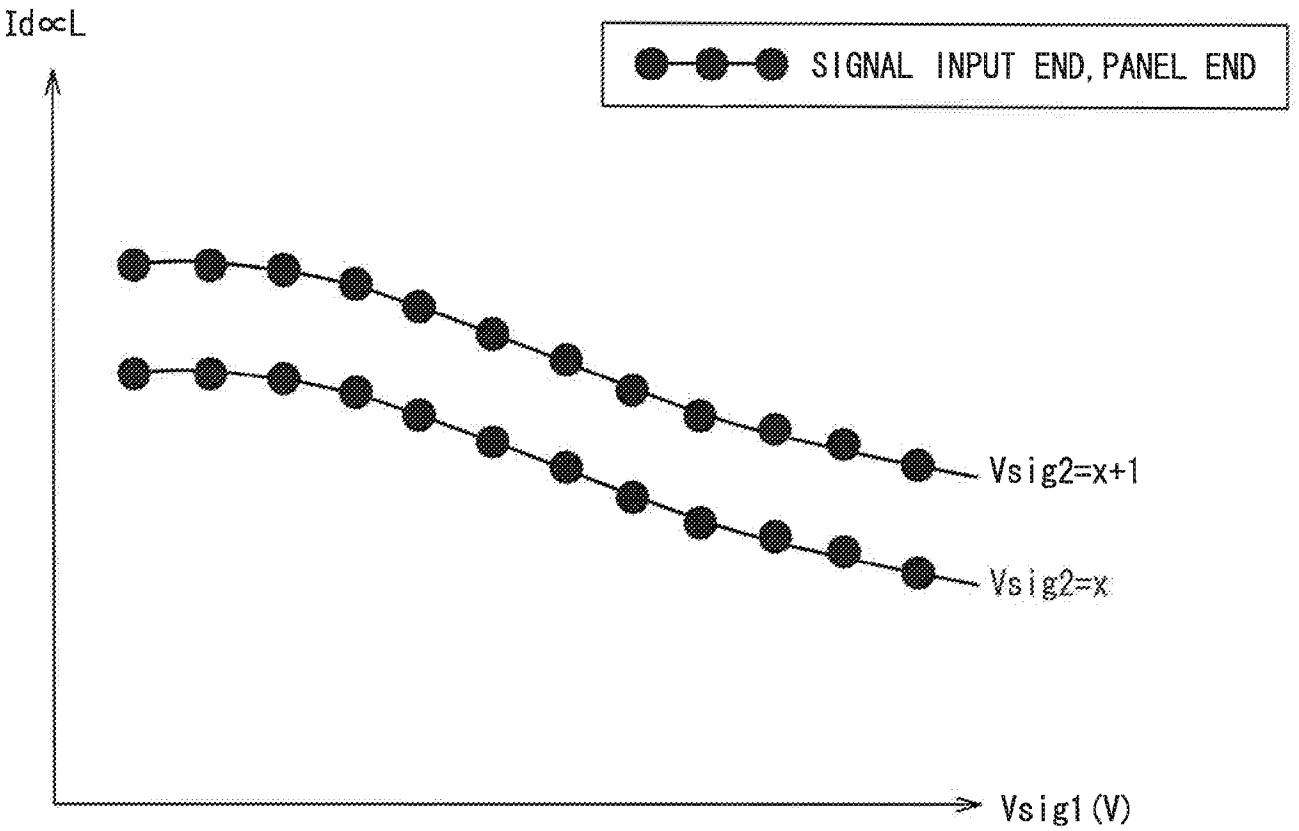
FIG. 16 is a characteristics diagram showing exemplary current-change characteristics of a gray-scale interpolation voltage at a signal input end and at a panel end according to the first embodiment.
Figure 17A:
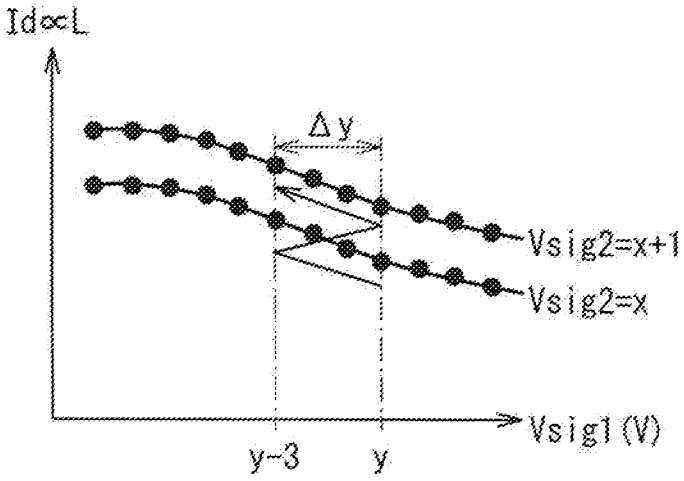
FIGS. 17A and 17B are characteristics diagrams respectively showing an exemplary relationship of a current flowing through a drive transistor with the gray-scale interpolation voltage at the signal input end and at the panel end in the first embodiment, and an exemplary relationship thereof with a video signal voltage also at the signal input end and at the panel end therein.
Figure 17B:
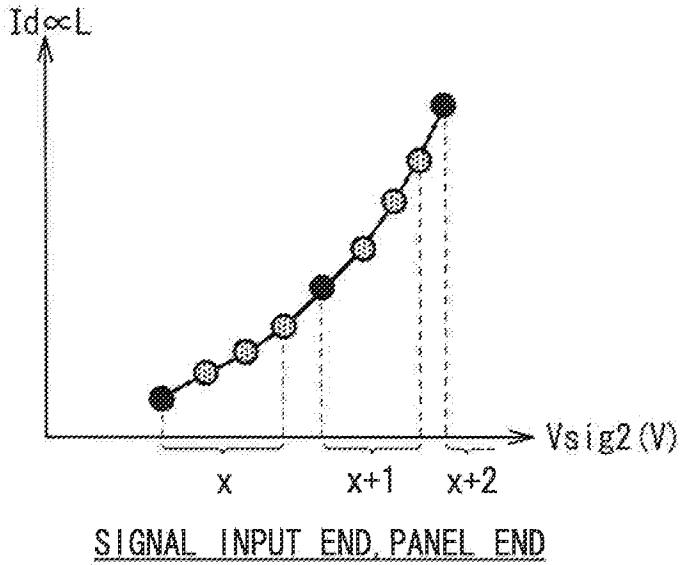

Accordingly, in the operation of gray-scale interpolation in this embodiment, as exemplarily shown in FIG. 16, the characteristics of current change with respect to the gray-scale interpolation voltage Vsig1 may show the same tilt (the rise and fall remain gradual) no matter if the pixel 11 is closer to the signal input end or to the panel end, i.e., the rise and fall remain gradual. Accordingly, unlike in the comparison example 1, the voltage range Δy of the gray-scale interpolation voltage Vsig1 falls within the same range for application to the values of the video signal voltage Vsig2 irrespective of the pixel position. As a result, in this embodiment, as exemplarily shown in FIGS. 17A and 17B, the operation of gray-scale interpolation is performed appropriately (smoothly) to both the pixels 11 closer to the signal input end and closer to the panel end so that such image quality degradation observed in the comparison example 1 is favorably reduced or prevented.

As described above, in the embodiment, during the driving of the pixels 11 in the display panel 10 for display, the drive circuit 20 (the signal line drive circuit 24) separately varies the magnitudes of the gray-scale interpolation voltage Vsig1 and the video signal voltage Vsig2 in accordance with the gray-scale levels of the video signal 20A, thereby performing an operation of gray-scale interpolation to each of the organic EL elements 12 in terms of light emission luminance L. To be specific, the video signal voltage Vsig2 is assigned a value corresponding to one of a plurality of gray-scale levels, and the gray-scale interpolation voltage Vsig1 is varied in value to take a plurality of values so that the operation of gray-scale interpolation is performed. This accordingly enables the representation with a larger number of gray-scale levels than the number originally provided by the video signal 20A, and thus the resulting gray-scale representation may be made with a higher definition with a simpler configuration of the drive circuit 20 (the signal line drive circuit 24), i.e., not adding complexity to the configuration thereof. In other words, even in a case of using a data driver (the signal line drive circuit 24) capable of outputting the M-bit video signal 20A (where M is an integer), the representation can be made with gray-scale level based on an N-bit (where N is an integer; N>M), thereby favorably leading to the cost reduction of the drive circuit 20.

Moreover, the scan line drive circuit 23 is so configured as to apply a selection pulse to the scan lines WSL not only in the application period for the gray-scale interpolation voltage Vsig1 but also in the application period for the basic voltage Vofs. Therefore, compared with a case with no application of a selection pulse in the application period for the basic voltage Vofs, the characteristics of current change show the gradual rise and fall with respect to the gray-scale interpolation voltage Vsig1. As a result, for the operation of gray-scale interpolation, this accordingly allows the values of the gray-scale interpolation voltage Vsig1 to fall within almost the same range for application to the video signal voltage Vsig2 irrespective of gray-scale levels. There is thus no need to provide any additional memory to the peripheral circuit such as the signal line drive circuit 24 for performing the operation of gray-scale interpolation.

The scan line drive circuit 23 is also so configured as to apply a selection pulse to the scan lines WSL separately in each corresponding application period for the gray-scale interpolation voltage Vsig1, the basic voltage Vofs, and the video signal voltage Vsig2. As such, this can suppress or prevent any variation of the amount of mobility correction depending on the pixel 11 in the display panel 10 during the application of the gray-scale interpolation voltage Vsig1 (by extension, the amount of mobility correction in a horizontal period in its entirety). As a result, even if every pixel 11 in the display panel 10 is applied with any one specific voltage range Δy of the gray-scale interpolation voltage Vsig1, the resulting operation of gray-scale interpolation may be performed appropriately (smoothly), thereby being able to reduce or prevent any possible image quality degradation depending on the pixel position.

As described above, the display device 1 in this embodiment is capable of realizing a higher image quality with a lower cost, i.e., achieving both a lower cost and a higher image quality.

In the below, described are several other embodiments of the invention. Note that any component same as that in the first embodiment above is provided with the same reference numeral, and is not described if appropriate.

Second Embodiment

Figure 18:
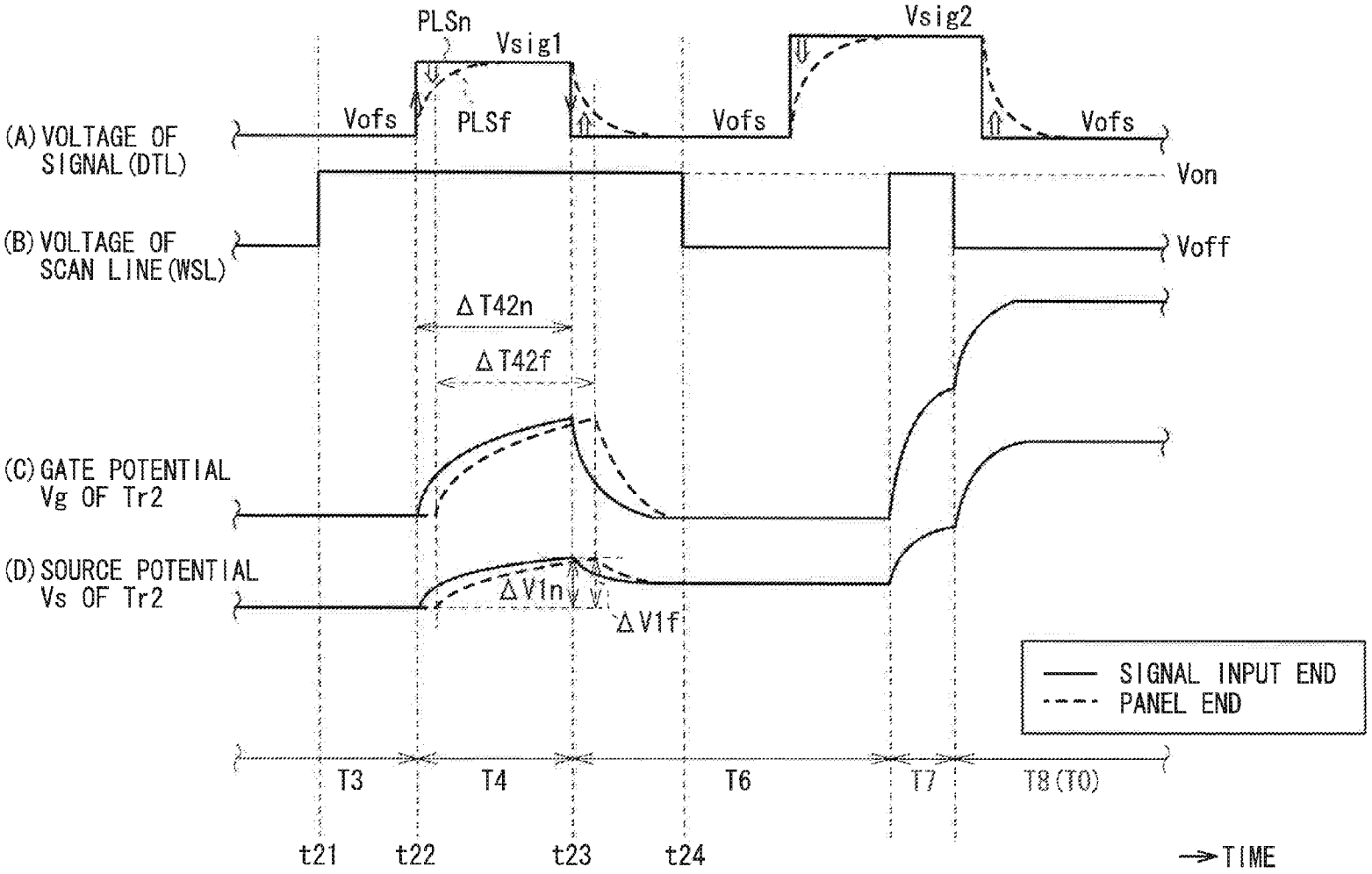
FIG. 18 is a timing chart showing an exemplary operation of gray-scale interpolation according to a second embodiment.

FIG. 18 is a timing chart showing an exemplary operation of gray-scale interpolation according to a second embodiment of the invention. In FIG. 18, part A shows a voltage waveform of the signal lines DTL, and part B shows that of the scan lines WSL similarly to parts A and B in FIG. 3, for example. Also in FIG. 18, similarly to parts D and E in FIG. 3, for example, part C shows the waveform of the gate potential Vg in the drive transistor Tr2, and part D shows the waveform of the source potential Vs therein. Herein, the block configuration of the display device 1, and the pixel configuration of the pixels 11 are both same as those in the first embodiment described above, and thus are not described twice. The display operation herein is also basically similar to the display operation in the first embodiment described by referring to FIG. 3 or others, and thus is not described again.

Also in this second embodiment, similarly to the first embodiment described above, the operation of gray-scale interpolation is performed by, during the driving of the pixels 11 for display, the signal line drive circuit 24 separately changing in value the gray-scale interpolation voltage Vsig1 and the video signal voltage Vsig2 in accordance with the gray-scale levels of the video signal 20A. In this manner, similarly to the first embodiment described above, this accordingly enables the representation with a larger number of gray-scale levels than the number originally provided by the video signal 20A. The resulting gray-scale representation may be made thus with a higher definition with a simpler configuration of the drive circuit 20 (the signal line drive circuit 24), i.e., not adding complexity to the configuration thereof.

Also in this embodiment, the application of a selection pulse is continuously made from the application period for the gray-scale interpolation voltage Vsig1 to that for the basic voltage Vofs. In other words, similarly to the first embodiment described above, the application of a selection pulse is made to the scan lines WSL not only in the application period for the gray-scale interpolation voltage Vsig1 but also in that for the basic voltage Vofs. As such, similarly to the first embodiment described above, compared with a case with no application of a selection pulse during the application period for the basic voltage Vofs, the characteristics of current change show the gradual rise and fall with respect to the gray-scale interpolation voltage Vsig1. As a result, for the operation of gray-scale interpolation, the values of the gray-scale interpolation voltage Vsig1 fall within almost the same range for application to the video signal voltage Vsig2. Accordingly, there is no need to provide any additional memory to the peripheral circuit such as the signal line drive circuit 24 for the operation of gray-scale interpolation.

On the other hand, in this embodiment, unlike in the first embodiment described above, the application of a selection pulse is started before the application of the gray-scale interpolation voltage Vsig1 (timing t21), and is completed during the application period for the basic voltage Vofs (timing t24) after completing the application of the gray-scale interpolation voltage Vsig1 (parts A and B in FIG. 18). As such, as indicated by open arrows in part A in FIG. 18, unlike in the comparison example 1, the length of the write period for the gray-scale interpolation voltage Vsig1 is determined only by the length of the application period for the gray-scale interpolation voltage Vsig1.

Figure 19:
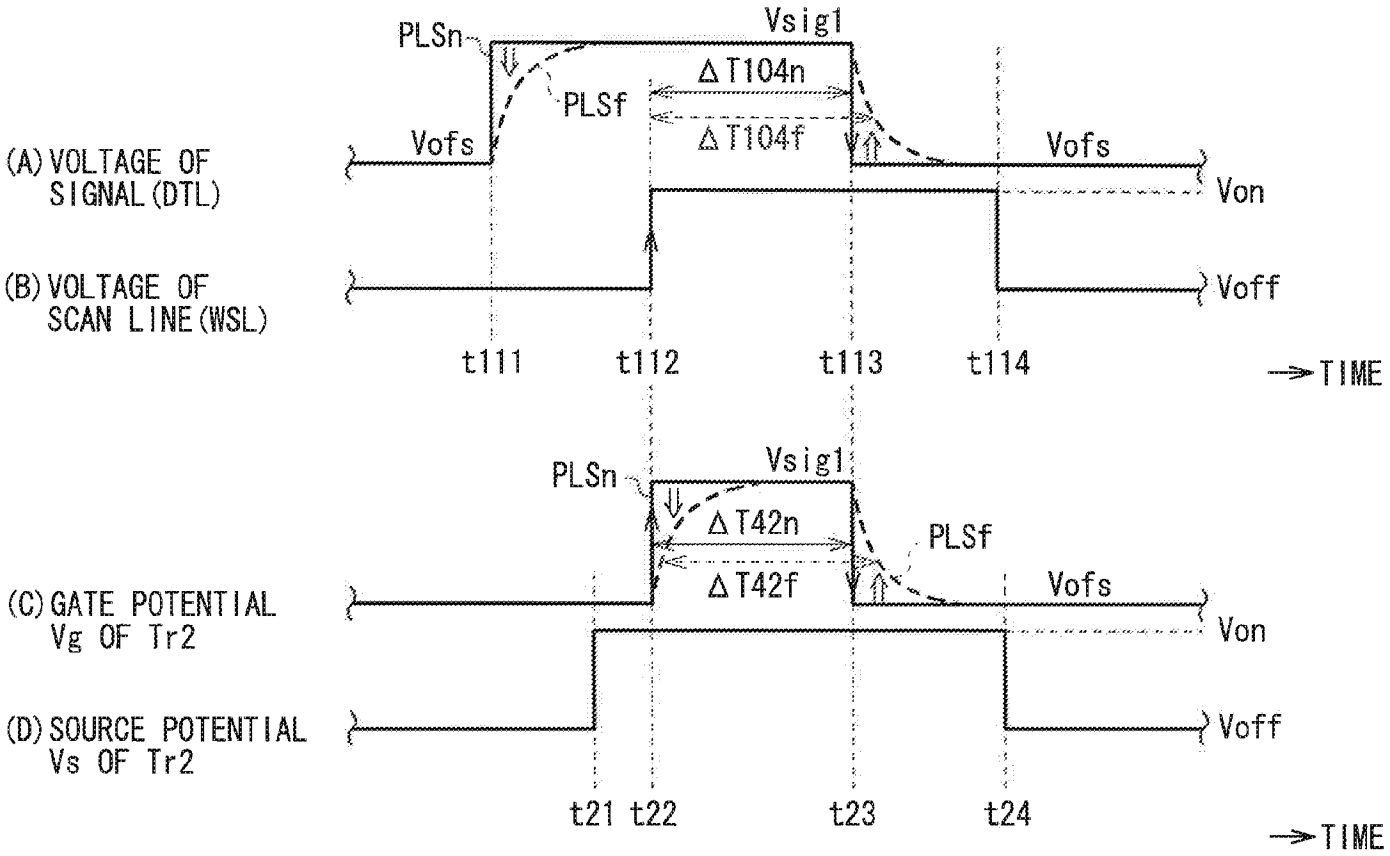
FIG. 19 is a timing chart for illustrating a difference(s) between the operation of gray-scale interpolation in the comparison example 1 and that in the second embodiment.

Accordingly, also in this second embodiment, as indicated by the open arrows in part A in FIG. 18, even if the waveform of signal pulses is different depending on the pixel position in the display panel 10 (like pulse waveforms PLSn and PLSf), such problems as described in the comparison example 1 do not occur any more. In other words, similarly to the first embodiment described above, the length of the write period for the gray-scale interpolation voltage Vsig1 becomes constant irrespective of the pixel position in the display panel 10, i.e., irrespective of the distance from the signal line drive circuit 24 to each of the pixels 11 (refer to the write periods ΔT42*n* and ΔT42*f* in part C in FIGS. 18 and 19). Note that, in the comparison example 1 described above, like the write periods ΔT104*n* and ΔT104*f* in part A in FIG. 19, the write period for the gray-scale interpolation voltage Vsig1 is varied in length depending on the pixel position in the display panel 10 in some cases.

As such, also in this second embodiment, similarly to the first embodiment described above, the amount of mobility correction during the application of the gray-scale interpolation voltage Vsig1 (potential difference ΔV1) is fixed in value irrespective of the pixel position in the display panel 10. To be specific, the amount of mobility correction in both the write periods ΔT42*n* and ΔT42*f* (potential differences ΔV1*n* and ΔV1*f*) is fixed in value irrespective of the pixel position. In other words, similarly to the first embodiment described above, the amount of mobility correction during the application of the gray-scale interpolation voltage Vsig1, by extension, the amount of mobility correction in a horizontal period in its entirety, is suppressed or prevented from varying depending on the pixel position.

As described above, in this embodiment, the scan line drive circuit 23 is so configured as to start the application of a selection pulse before the application of the gray-scale interpolation voltage Vsig1, and completes the application of the selection pulse during the application period for the basic voltage Vofs after completing the application of the gray-scale interpolation voltage Vsig1. Accordingly, the amount of mobility correction during the application of the gray-scale interpolation voltage Vsig1, by extension, the amount of mobility correction in a horizontal period in its entirety, is suppressed or prevented from varying depending on the pixel position. As a result, similarly to the first embodiment described above, even if every pixel 11 in the display panel 10 is applied with the gray-scale interpolation voltage Vsig1 in the same voltage range Δy, the operation of gray-scale interpolation may be performed appropriately (smoothly), thereby being able to reduce or prevent any degradation of the image quality depending on the pixel position. Accordingly, also in this second embodiment, a higher image quality may be realized together with a lower cost, i.e., achieving both a lower cost and a higher image quality.

Third Embodiment

Figure 20:
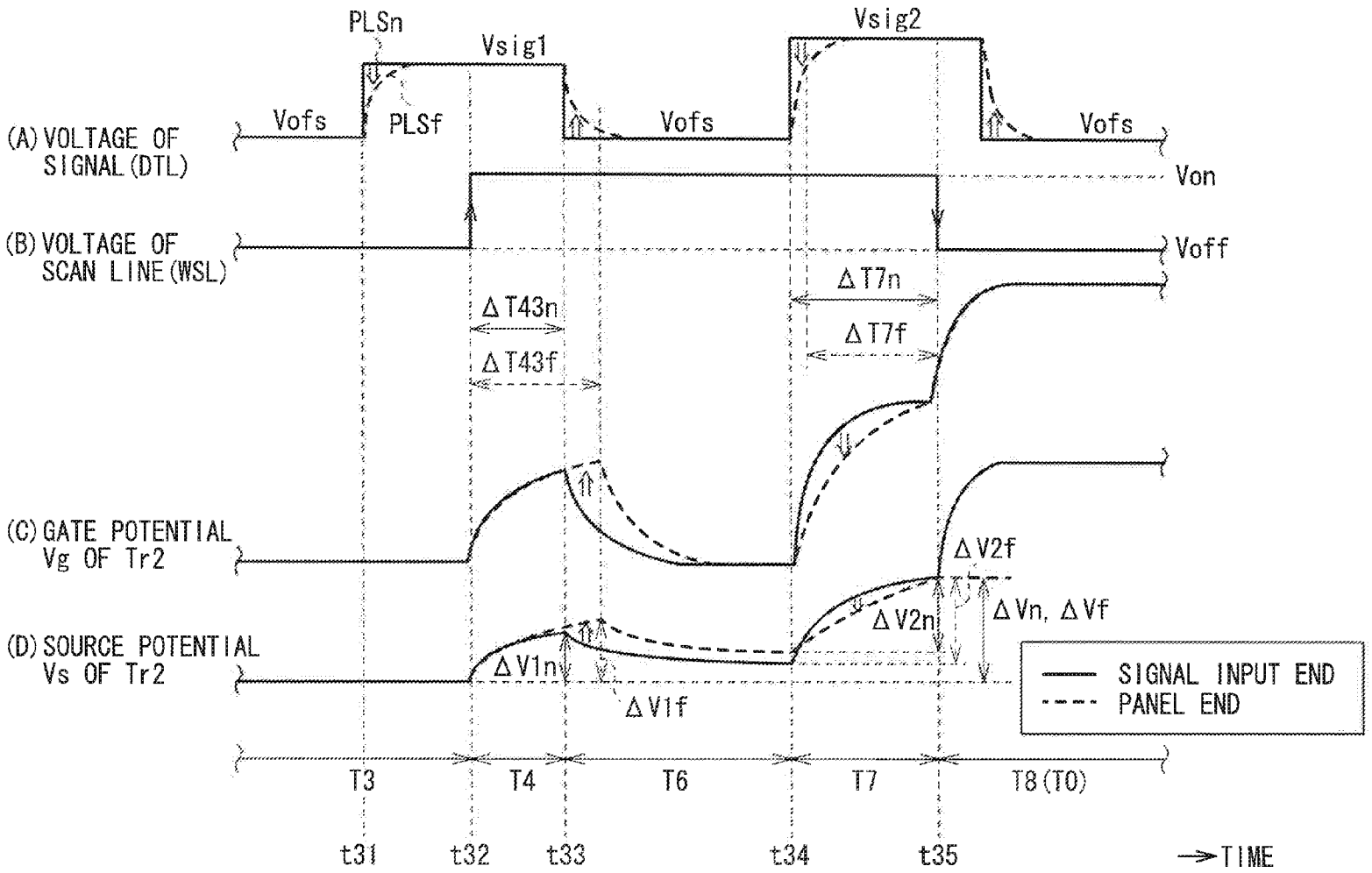
FIG. 20 is a timing chart showing an exemplary operation of gray-scale interpolation according to a third embodiment.

FIG. 20 is a timing chart showing an exemplary operation of gray-scale interpolation in a third embodiment of the invention. In FIG. 20, part A shows a voltage waveform of the signal lines DTL, and part B shows that of the scan lines WSL similarly to parts A and B in FIG. 3, for example. Also in FIG. 20, similarly to parts D and E in FIG. 3, for example, part C shows the waveform of the gate potential Vg in the drive transistor Tr2, and part D shows the waveform of the source potential Vs therein. Herein, the block configuration of the display device 1, and the pixel configuration of the pixels 11 are both same as those in the first embodiment described above, and thus are not described twice. The display operation herein is also basically similar to the display operation in the first embodiment described by referring to FIG. 3 or others, and thus is not described again.

Also in this third embodiment, similarly to the first embodiment described above, the operation of gray-scale interpolation is performed by, during the driving of the pixels 11 for display, the signal line drive circuit 24 separately changing in value the gray-scale interpolation voltage Vsig1 and the video signal voltage Vsig2 in accordance with the gray-scale levels of the video signal 20A. In this manner, similarly to the first embodiment described above, this accordingly enables the representation with a larger number of gray-scale levels than the number originally provided by the video signal 20A. The resulting gray-scale representation may be made thus with a higher definition with a simpler configuration of the drive circuit 20 (the signal line drive circuit 24), i.e., not adding complexity to the configuration thereof.

Also in this embodiment, the application of a selection pulse is continuously made from the application period for the gray-scale interpolation voltage Vsig1 to that for the basic voltage Vofs. In other words, similarly to the first embodiment described above, the application of a selection pulse is made to the scan lines WSL not only in the application period for the gray-scale interpolation voltage Vsig1 but also in that for the basic voltage Vofs. As such, similarly to the first embodiment described above, compared with a case with no application of a selection pulse during the application period for the basic voltage Vofs, the characteristics of current change show the gradual rise and fall with respect to the gray-scale interpolation voltage Vsig1. As a result, for the operation of gray-scale interpolation, the values of the gray-scale interpolation voltage Vsig1 fall within almost the same range for application to the video signal voltage Vsig2 irrespective of gray-scale levels. Accordingly, there is no need to provide any additional memory to the peripheral circuit such as the signal line drive circuit 24 for the operation of gray-scale interpolation.

On the other hand, in this third embodiment, unlike in the first embodiment described above, the application of a selection pulse is started during the application period for the gray-scale interpolation voltage Vsig1 (timing t32), and is completed during the application period for the video signal voltage Vsig2 (timing t35) subsequent to the application period for the basic voltage Vofs (parts A and B in FIG. 20). As such, also in this third embodiment, as indicated by open arrows in part A in FIG. 20, even if the waveform of signal pulses is different depending on the pixel position in the display panel 10 (like pulse waveforms PLSn and PLSf), such problems as described in the comparison example 1 do not occur any more.

To be specific, in this third embodiment, the whole duration including both the write period for the gray-scale interpolation voltage Vsig1 and the write period for the video signal voltage Vsig2 becomes constant in length irrespective of the pixel position in the display panel 10, i.e., irrespective of the distance from the signal line drive circuit 24 to each of the pixels 11. To be specific, first of all, for the pixels 11 closer to the signal input end, the write period ΔT43*n* for the gray-scale interpolation voltage Vsig1 and the write period ΔT7*n* for the video signal voltage Vsig2 each have the length as shown in part C in FIG. 20. On the other hand, for the pixels 11 closer to the panel end, the write period ΔT43*f* for the gray-scale interpolation voltage Vsig1 and the write period ΔT7*f* for the video signal voltage Vsig2 each have the length as shown in part C in FIG. 20. In other words, (Length of Period Δ43*n*<Length of Period ΔT43*f*) and (Length of Period Δ7*n*<Length of Period Δ7*f*) are both observed, the total length of such write periods remain the same for the pixels 11 closer to the signal input end and those closer to the panel end.

As such, in this third embodiment, the total amount of mobility correction (potential difference ΔV) including the amount of mobility correction (potential difference ΔV1) during the application of the gray-scale interpolation voltage Vsig1 and the amount of mobility correction (potential difference ΔV2) during the application of the video signal voltage Vsig2 becomes fixed in value irrespective of the pixel position in the display panel 10. To be specific, first of all, for the pixels 11 closer to the signal input end, as shown in parts C and D in FIG. 20, adding the amount of mobility correction in the write period ΔT43*n* (potential difference ΔV1*n*) to the amount of mobility correction in the write period ΔT7*n* (potential difference ΔV2*n*) leads to the amount of mobility correction (potential difference ΔVn). On the other hand, for the pixels 11 closer to the panel end, adding the amount of mobility correction in the write period ΔT43*f* (potential difference ΔV1*f*) to the amount of mobility correction in the write period ΔT7*f* (potential difference ΔV2*f*) leads to the amount of mobility correction (potential difference ΔVf) similarly to the value for the pixels 11 closer to the signal input end. Accordingly, also in this third embodiment, similarly to the first embodiment described above, the amount of mobility correction in an entire horizontal period is suppressed or prevented from varying depending on the pixel position.

As described above, in this third embodiment, the scan line drive circuit 23 is so configured as to start the application of a selection pulse during the application period for the gray-scale interpolation voltage Vsig1, and completes the application of the selection pulse during the application period for the video signal voltage Vsig2 subsequent to the application period for the basic voltage Vofs. Accordingly, the amount of mobility correction in an entire horizontal period is suppressed or prevented from varying depending on the pixel position. As a result, similarly to the first embodiment described above, even if every pixel 11 in the display panel 10 is applied with any one specific voltage range Δy of the gray-scale interpolation voltage Vsig1, the resulting operation of gray-scale interpolation may be performed appropriately (smoothly), thereby being able to reduce or prevent any image quality degradation depending on the pixel position. Accordingly, this third embodiment also realizes a higher image quality with a lower cost, i.e., achieves both a lower cost and a higher image quality.

Fourth Embodiment

Figure 21:
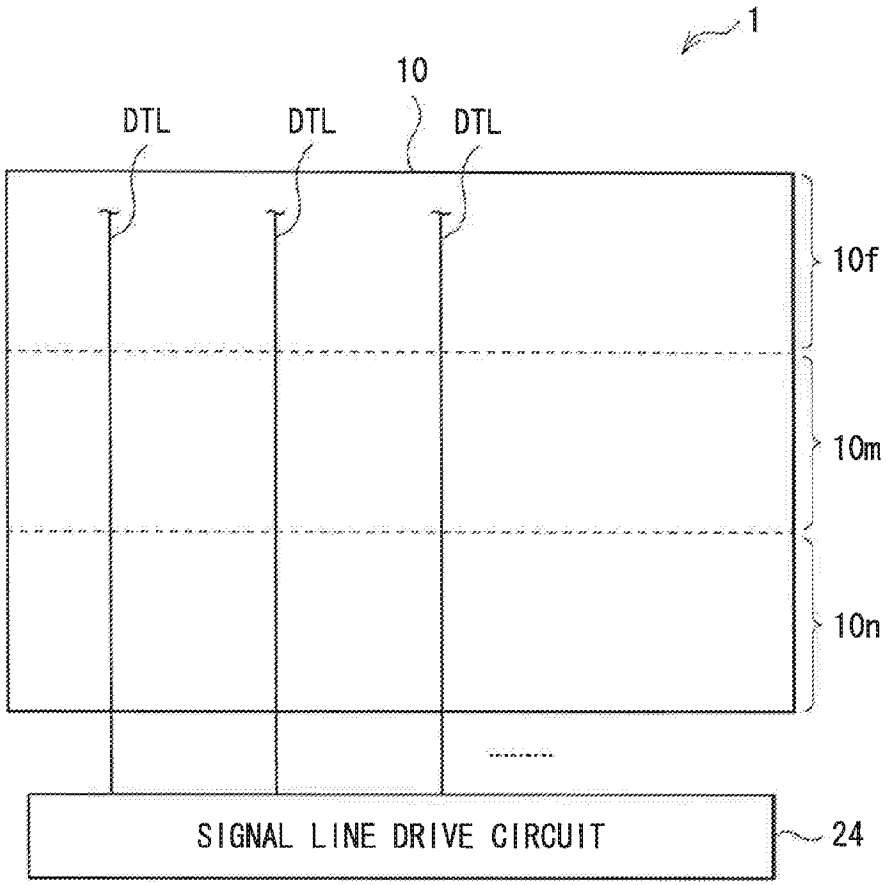
FIG. 21 is a schematic diagram showing a plurality of exemplary division display regions in a display panel according to a fourth embodiment.

FIG. 21 is a diagram schematically showing a plurality of exemplary division display regions in the display panel 10 according to a fourth embodiment of the invention. In the display panel 10 in this fourth embodiment, a display region is divided into a plurality of (three in this example) division display regions 10*n*, 10*m*, and 10*f* in the direction along the signal lines DTL (vertical (V) direction). To be specific, the display region is divided into, in order from the side of the signal line drive circuit 24 (the side of signal input end) toward the side of the panel end, the panel lower region 10*n* on the side of the signal input end, the panel middle area 10*m*, and the panel upper area 10*f* on the side of the panel end. Exemplified here is such a case that the display region is divided into three division display regions 10*n*, 10*m*, and 10*f*, but alternatively, the display region may be divided into any arbitrary number (larger than 2) of division display regions. The block configuration of the display device 1, and the pixel circuit configuration of the pixels 11 are both the same as those in the first embodiment described above, and thus are not described twice.

Figure 22:
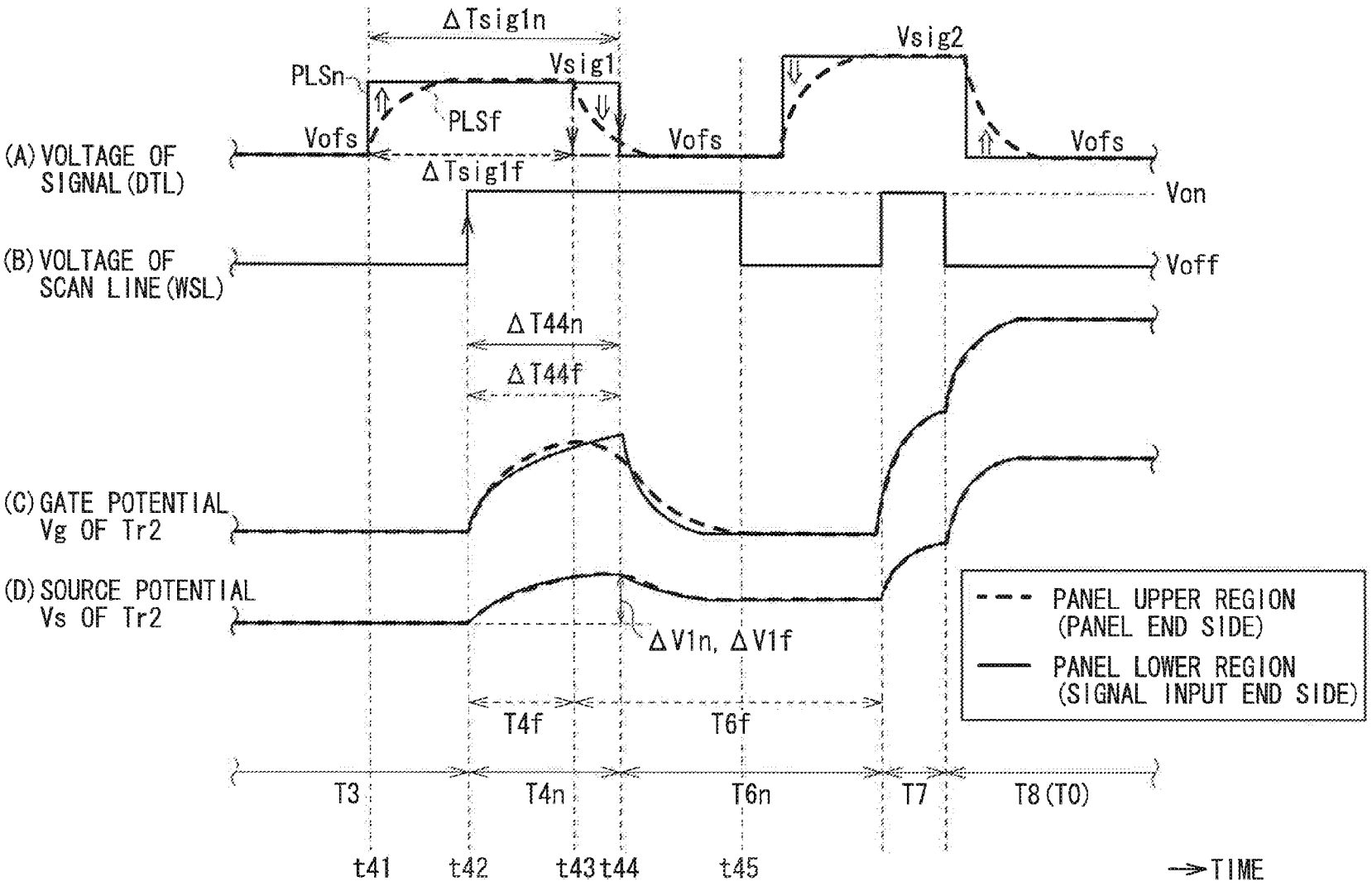
FIG. 22 is a timing chart showing an exemplary operation of gray-scale interpolation according to the fourth embodiment.

FIG. 22 is a timing chart showing an exemplary operation of gray-scale interpolation in this fourth embodiment. In FIG. 22, similarly to parts A and B in FIG. 3, for example, part A shows a voltage waveform of the signal lines DTL, and part B shows that of the scan lines WSL. Also in FIG. 22, similarly to parts D and E in FIG. 3, for example, part C shows the waveform of a gate potential Vg in the drive transistor Tr2, and part D shows the waveform of a source potential Vs therein. The display operation herein is also basically similar to the display operation in the first embodiment described by referring to FIG. 3 or others, and thus is not described again.

Also in this fourth embodiment, similarly to the first embodiment described above, the operation of gray-scale interpolation is performed by, during the driving of the pixels 11 for display, the signal line drive circuit 24 separately changing in value the gray-scale interpolation voltage Vsig1 and the video signal voltage Vsig2 in accordance with the gray-scale levels of the video signal 20A. In this manner, similarly to the first embodiment described above, this enables the representation with a larger number of gray-scale levels than the number originally provided by the video signal 20A. The resulting gray-scale representation may be made thus with a higher definition with a simpler configuration of the drive circuit 20 (the signal line drive circuit 24), i.e., not adding complexity to the configuration thereof.

Also in this embodiment, the application of a selection pulse is continuously made from the application period for the gray-scale interpolation voltage Vsig1 to that for the basic voltage Vofs. In other words, similarly to the first embodiment described above, the application of a selection pulse is made to the scan lines WSL not only in the application period for the gray-scale interpolation voltage Vsig1 but also in that for the basic voltage Vofs. As such, similarly to the first embodiment described above, compared with a case with no application of a selection pulse during the application period for the basic voltage Vofs, the characteristics of current change show the gradual rise and fall with respect to the gray-scale interpolation voltage Vsig1. As a result, for the operation of gray-scale interpolation, the values of the gray-scale interpolation voltage Vsig1 fall within almost the same range for application to the video signal voltage Vsig2 irrespective of gray-scale levels. Accordingly, there is no need to provide any additional memory to the peripheral circuit such as the signal line drive circuit 24 for the operation of gray-scale interpolation.

On the other hand, in this embodiment, unlike in the first embodiment described above, the signal line drive circuit 24 is so configured as to adjust the application period for the gray-scale interpolation voltage Vsig1 to be shorter in accordance with an increase of distance from itself disposed along the signal lines DTL to each of the pixels 11. To be specific, in this example, the signal line drive circuit 24 adjusts the application period for the gray-scale interpolation voltage Vsig1 to be shorter step by step as the distance increases. In other words, in this example, the application period for the gray-scale interpolation voltage Vsig1 is so adjusted as to be shorter step by step in order from the panel lower area 10*n*, the panel middle area 10*m*, and the panel upper area 10*f* shown in FIG. 21. To be more specific, as exemplarily shown in part A in FIG. 22, the application period is so adjusted that the application period ΔTsig1*f* for the gray-scale interpolation voltage Vsig1 in the panel upper area 10*f* becomes shorter in length than the application period ΔTsig1*n* for the gray-scale interpolation voltage Vsig1 in the panel lower area 10*n*.

As such, in this fourth embodiment, the length of the write period for the gray-scale interpolation voltage Vsig1, which is determined by the length from the start of the application of the selection pulse to the scan lines WSL (timing t42) to the completion of the application of the gray-scale interpolation voltage Vsig1, is adjusted to be shorter in accordance with the increase of the distance. Accordingly, even if an increase of the distance causes rounding of signal-pulse waveforms of the gray-scale interpolation voltage Vsig1 (refer to pulse waveforms PLSn and PLSf in part A in FIG. 22), the actual write periods Δ44*n* and Δ44*f* both remain almost constant in length irrespective of the pixel position. To be specific, first of all, for the pixels 11 closer to the signal input end (in a panel lower area 11*n*), the write period ΔT44*n* for the gray-scale interpolation voltage Vsig1 has almost the same length as a mobility correction/gray-scale interpolation write period T4*n*. On the other hand, for the pixels 11 closer to the panel end, i.e., in a panel upper area 11*f*, the write period ΔT44*f* for the gray-scale interpolation voltage Vsig1 is longer in length than the mobility correction/gray-scale interpolation write period T4*f* due to the rounding of the falling edge waveform of the signal pulses PLSf. Note here that, since this mobility correction/gray-scale interpolation write period T4*f* is adjusted in advance so as to be shorter in application period than the mobility correction/gray-scale interpolation period T4*n*, the actual write periods Δ44*n* and Δ44*f* are almost constant in length irrespective of the pixel position.

As such, also in this fourth embodiment, similarly to the first embodiment described above, the amount of mobility correction during the application of the gray-scale interpolation voltage Vsig1 (potential difference ΔV1) is fixed in value irrespective of the pixel position in the display panel 10. To be specific, the amount of mobility correction in the write periods ΔT44*n* and ΔT44*f* (potential differences ΔV1*n* and ΔV1*f*) are fixed in value irrespective of the pixel position. In other words, similarly to the first embodiment described above, the amount of mobility correction during the application of the gray-scale interpolation voltage Vsig1, by extension, the amount of mobility correction in a horizontal period in its entirety, is suppressed or prevented from varying depending on the pixel position.

As such, in this embodiment, the signal line drive circuit 24 is so configured as to adjust the application period for the gray-scale interpolation voltage Vsig1 to be shorter in accordance with an increase of distance from itself disposed along the signal lines DTL to each of the pixels 11, and this may suppress or prevent the amount of mobility correction in an entire horizontal period from varying depending on the pixel position. Accordingly, similarly to the first embodiment described above, even if every pixel 11 in the display panel 10 is applied with the gray-scale interpolation voltage Vsig1 in the same voltage range Δy, the operation of gray-scale interpolation may be performed appropriately (smoothly), thereby being able to reduce or prevent any degradation of the image quality depending on the pixel position. Accordingly, also in this fourth embodiment, a higher image quality may be realized together with a lower cost, i.e., achieving both a lower cost and a higher image quality.

Fifth Embodiment

Figure 23:
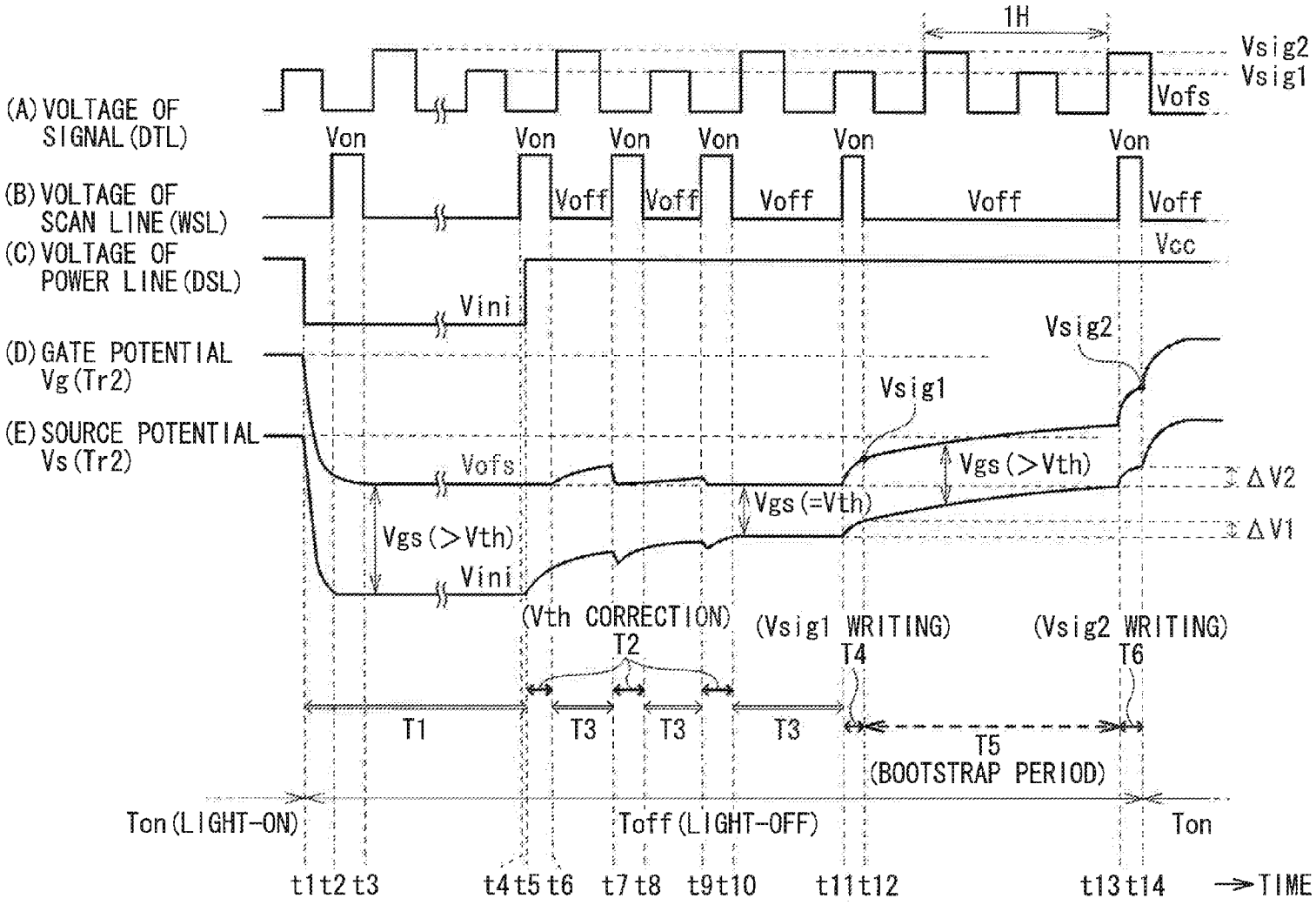
FIG. 23 is a timing chart for an exemplary operation of a display device according to a fifth embodiment.

By referring to parts A to E in FIG. 23, described is a detailed display operation in a fifth embodiment. In FIG. 23, parts A to E show various exemplary timing charts, and specifically, A shows a signal pulse for application to the signal lines DTL, part B shows a signal pulse to the scan lines WSL, and part C shows a signal pulse to the power lines DSL. Also in FIG. 23, part D shows the waveforms of a gate potential Vg in the drive transistor Tr2, and E shows the waveform of a source potential Vs therein. As shown in FIG. 23, the voltage of the signal lines DTL shows a periodical change between the voltages, i.e., the voltage Vofs, the gray-scale interpolation voltage Vsig1, and the video signal voltage Vsig2 (part A in FIG. 23), the voltage of the scan lines WSL shows a periodical change between the voltages Voff and Von (part B in FIG. 23), and the voltage of the power lines DSL shows a periodical change between the voltages Vcc and Vini (part C in FIG. 23).

In this example, a period of timings t1 to t14 that will be described later is a light-off period Toff in which the organic EL elements 12 are in the light-off state. In such a light-off period Toff, the drive circuit 20 uses the two-step drive scheme for display driving. To be specific, the drive circuit 20 is operated for, in this order, the Vth correction preparation, the Vth correction, the writing of the gray-scale interpolation voltage Vsig1, and the writing of the video signal voltage Vsig2, which will be all described later.

(Vth Correction Preparation Period T1: t1 to t5)

First of all, at the end of a light-on period Ton (timing t1), the drive circuit 20 prepares to correct the threshold voltage Vth in the drive transistor Tr2 provided in each of the pixels 11. To be specific, first of all, at the timing t1, the power line drive circuit 25 reduces the voltage of the power lines DSL from Vcc to Vini (C in FIG. 23). Then in a period when the signal lines DTL is at the voltage Vofs, and when the power lines DSL are at the voltage Vini (timings t2 to t3), the scan line drive circuit 23 increases the voltage of the scan lines WSL from Voff to Von (part B in FIG. 23). In response thereto, the source potential Vs of the drive transistor Tr2 goes down and reaches the value of the voltage Vini (part E in FIG. 23), and thus the organic EL elements 12 stop emitting light. On the other hand, in response to the decrease of the source potential Vs as such, the gate potential Vg of the drive transistor Tr2 also goes down due to the capacity coupling via the retention capacitors Cs (part D in FIG. 23). The gate potential Vg at this time becomes equal to the voltage of the signal lines DTL (voltage Vofs) because the scan lines WSL are at the voltage Von, and the write transistor Tr1 is put in the ON state.

As a result, the gate-source voltage Vgs in the drive transistor Tr2 becomes higher than the threshold voltage Vth in this drive transistor Tr2 (Vgs>Vth), and the preparation of Vth correction is completed (timing t3). Thereafter, at a timing t4 when the signal lines DTL are at the voltage Vofs, and when the power lines DTL are at the voltage Vini, the scan line drive circuit 23 increases the voltage of the scan lines WSL from Voff to Von (part B in FIG. 23).

After being ready for the Vth correction as such, the drive circuit 20 keeps correcting the threshold voltage Vth until the drive transistor Tr2 is in the cut off state (Vgs=Vth), i.e., performs the operation of Vth correction. Such an operation of Vth correction may be performed once or more as required, and exemplified herein is the case of performing the operation for three times with a pause period, i.e., Vth correction pause period.

(First-Time Vth Correction Period T2: t5 to 56)

First of all, at a timing t5 when the signal lines DTL are at the voltage Vofs, and when the scan lines WSL are at the voltage Von, the power line drive circuit 25 increases the voltage of the power lines DSL from Vini to Vcc (part C in FIG. 23). In response thereto, the current Id starts flowing between the drain and the source of the drive transistor Tr2, and the source potential Vs thus goes up (part E in FIG. 23). Thereafter, at a timing t6 when the signal lines DTL are kept at the voltage Vofs, and when the power lines DSL are kept at the voltage Vcc, the scan line drive circuit 23 reduces the voltage of the scan lines WSL from Von to Voff (part B in FIG. 23). This accordingly puts the write transistor Tr1 in the OFF state, and thus the gate of the drive transistor Tr2 is put in the floating state so that the operation of Vth correction is temporarily stopped, i.e., the procedure goes to the first-time Vth correction pause period T3.

(First-Time Vth Correction Pause Period T3: t6 to t7)

In a period of timings t6 to t7, the operation of Vth correction is temporarily stopped. In this example, at the timing T6 after the first-time Vth correction, the source potential Vs is lower than the voltage value of (Vofs (=Vg)−Vth), i.e., (Vs<(Vg−Vth)). In other words, the gate-source voltage Vgs is still higher than the threshold voltage Vth (Vgs>Vth). As such, the current Id starts flowing between the drain and the source, and the source potential Vs thus keeps going up (part E in FIG. 23). On the other hand, in response to such an increase of the source potential Vs, the gate potential Vg also goes up due to the capacity coupling via the retention capacitors Cs (part D in FIG. 23).

(Second-Time Vth Correction Period T2: t7 to t8)

Thereafter, at the timing t7 when the signal lines DTL are at the voltage Vofs, and when the power lines DSL are at the voltage Vcc, the scan line drive circuit 23 increases the voltage of the scan lines WSL from Voff to Von (part B in FIG. 23). This accordingly puts the write transistor Tr1 in the ON state, and the gate potential Vg again becomes equal to the voltage of the signal lines DTL at this time (voltage Vofs) (part D in FIG. 23). Since the gate-source voltage Vgs is still higher than the threshold voltage Vth (Vgs>Vth) at the timing t7, the current Id keeps flowing between the drain and the source, and the source potential Vs keeps going up (part E in FIG. 23). Thereafter, at a timing t8 when the signal lines DTL are kept at the voltage Vofs, and when the power lines DSL are kept at the voltage Vcc, the scan line drive circuit 23 reduces voltage of the scan lines WSL from Von to Voff (part B in FIG. 23). This accordingly puts the write transistor Tr1 in the OFF state, and the operation of Vth correction is temporarily stopped, i.e., the procedure goes to the Vth correction pause period T3 (second time).

(Second-Time Vth Correction Pause Period T3: t8 to t9)

In a period of timings t8 to t9, the operation of Vth correction is temporarily stopped. Herein, similarly to the first-time Vth correction pause period T3 described above, the gate-source voltage Vgs is still higher than the threshold voltage Vth (Vgs>Vth). The current Id thus keeps flowing between the drain and source, and the source potential Vs goes up, and in response thereto, the gate potential Vg also goes up (parts D and E in FIG. 23).

(Third-Time Vth Correction Period T2, Vth Correction Pause Period T3: t9 to t11)

Thereafter, at a timing t9 when the signal lines DTL are at the voltage Vofs, and when the power lines DSL are at the voltage Vcc, the scan line drive circuit 23 increases the voltage of the scan lines WSL from Voff to Von (part B in FIG. 23). This accordingly puts the write transistor Tr1 in the ON state, and similarly to the second-time Vth correction period T2 described above, the gate potential Vg becomes equal to the voltage Vofs (part D in FIG. 23). Herein, the gate-source voltage Vgs is still higher than the threshold voltage Vth (Vgs>Vth) at the timing t9, the current Id keeps flowing between the drain and source, and the source potential Vs goes up, but in this third-time Vt correction period T2, the drive transistor Tr2 is eventually cut off (Vgs=Vth) (part E in FIG. 23). That is, this is the end of the operation of Vth correction. As a result, the retention capacitors Cs are each charged at both ends to have the threshold voltage Vth, and thus the gate-source voltage Vgs reaches the value of the threshold voltage Vth. Thereafter, at a timing t10 when the signal lines DTL are kept at the voltage Vofs, and when the power lines DSL are kept at the voltage Vcc, the scan line drive circuit 23 reduces the voltage of the scan lines WSL from Von to Voff (part B in FIG. 23). This accordingly puts the write transistor Tr1 in the OFF state, and the gate of the drive transistor Tr2 is put in the floating state. As a result, irrespective of the magnitude of the voltage of the signal lines DTL, the gate-source voltage Vgs is kept at the threshold voltage Vth (third-time Vth correction pause period T3: timings t10 to t11).

With the operation of Vth correction as described above, even if the threshold voltage Vth varies between the pixels 11, the organic EL elements 12 are prevented from being varied in light emission luminance.

(Gray-Scale Interpolation Write Period T4: t11 to t12)

Next, the drive circuit 20 performs an operation of gray-scale interpolation writing through application of the gray-scale interpolation voltage Vsig1 to the signal lines DTL. The operation of gray-scale interpolation using the gray-scale interpolation voltage Vsig1 will be described specifically later. At the same time as the operation, the drive circuit 20 corrects the mobility μ in the drive transistor Tr2, i.e., performs mobility correction. To be specific, first of all, at a timing t11 when the signal lines DTL are at the gray-scale interpolation voltage Vsig1, and when the power lines DSL are at the voltage Vcc, the scan line drive circuit 23 increases the voltage of the scan lines WSL from Voff to Von (part B in FIG. 23). Since this accordingly puts the write transistor Tr2 in the ON state, the gate potential Vg of the drive transistor Tr2 goes up from the voltage Vofs to the gray-scale interpolation voltage Vsig1 corresponding to the voltage of the signal lines DTL at this time (part D in FIG. 23). In this stage, since the anode voltage of each of the organic EL elements 12 is smaller than the value of (Vel+Vca), which is the sum of the threshold voltage Vel and the cathode voltage Vca in each of the organic EL elements 12, the organic EL elements 12 are in the cut-off state. In other words, in the gray-scale interpolation write period T4, no current flows between the anode and the cathode of each of the organic EL elements 12, i.e., the organic EL elements 12 do not emit light. Accordingly, the current Id coming from the drive transistor Tr2 is directed to the element capacity (not shown) disposed in line between the anode and cathode of each of the organic EL elements 12, thereby charging these element capacities. As a result, the source potential Vs of the drive transistor Tr2 goes up by the potential difference ΔV1 (part E in FIG. 23) so that the gate-source voltage Vgs takes the value of (Vsig1+Vth−ΔV1).

Note that, the increase of this source potential Vs (potential difference ΔV1) shows a change in accordance with the value change of the mobility μ of the drive transistor Tr2. Accordingly, as described above, with the gate-source voltage Vgs being set smaller by the potential difference ΔV1 before light emission, i.e., by feedback, the mobility μ may be prevented from being varied between the pixels 11.

(Bootstrap Period T5: t12 to t13)

Then at a timing t12 when the signal lines DTL are kept at the gray-scale interpolation voltage Vsig1, and when the power lines DSL are kept at the voltage Vcc, the scan line drive circuit 23 reduces the voltage of the scan lines WSL from Von to Voff (part B in FIG. 23). Since this accordingly puts the write transistor Tr1 in the OFF state, the gate of the drive transistor Tr2 is put in the floating state, and this is the end of the writing of the gray-scale interpolation voltage Vsig1. At this time, the source potential Vs of the drive transistor Tr2 is at the floating, and the gate-source voltage Vgs becomes higher again than the threshold voltage Vth (Vgs>Vth). As such, bootstrap of the drive transistor Tr2 occurs, and the source potential Vs goes up (part E in FIG. 23). That is, this bootstrap period T5 is also the mobility correction period for correction of the mobility μ. Since the gate of the drive transistor Tr2 is being in the floating state, the gate potential Vg also goes up due to the capacity coupling via the retention capacitors Cs (part D in FIG. 23).

(Video Signal Write Period T6: t13 to t14)

Next, the drive circuit 20 performs video signal writing through application of the video signal voltage Vsig2 to the signal lines DTL. At the same time, the drive circuit 20 corrects the mobility μ in the drive transistor Tr2, i.e., performs mobility correction. To be specific, first of all, at a timing t13 when the signal lines DTL are at the video signal voltage Vsig2, and when the power lines DSL are at the voltage Vcc, the scan line drive circuit 23 increases the voltage of the scan lines WSL from Voff to Von (part B in FIG. 23). Since this accordingly puts the write transistor Tr1 in the ON state, the gate potential Vg of the drive transistor Tr2 goes up to the video signal voltage Vsig2 corresponding to the voltage of the signal lines DTL at this time (part D in FIG. 23). Also in this stage, similarly to the gray-scale interpolation write period T4 described above, the organic EL elements 12 do not emit light as are still in the cut-off state. Accordingly, the current Id coming from the drive transistor Tr2 is directed to the element capacity (not shown) in each of the organic EL elements 12 described above, thereby charging these element capacities. As a result, the source potential Vs of the drive transistor Tr2 goes up by the potential difference ΔV2 (part E in FIG. 23) so that the gate-source voltage Vgs takes the value of (Vsig2+Vth−(ΔV1+ΔV2)).

Note that, the increase of this source potential Vs (potential difference ΔV2) shows a change in accordance with the value change of the mobility μ of the drive transistor Tr2 as does the potential difference ΔV1 in the gray-scale interpolation write period T4 described above. As such, as described above, with the gate-source voltage Vgs being set smaller by the potential difference ΔV2 before light emission, the mobility μ may be prevented from being varied between the pixels 11.

(Light Emission Period Ton)

Thereafter, at a timing t14 when the signal lines DTL are kept at the video signal voltage Vsig2, and when the power lines DSL are kept at the voltage Vcc, the scan line drive circuit 23 reduces the voltage of the scan lines WSL from Von to Voff (part B in FIG. 23). Since this accordingly puts the write transistor Tr1 in the OFF state, the gate of the drive transistor Tr2 is put in the floating state. In response thereto, in the state that the gate-source voltage Vgs of the drive transistor Tr2 is kept at a fixed value, the current Id starts flowing between the drain and the source of the drive transistor Tr2. As a result, the source potential Vs of this drive transistor Tr2 goes up, and in response thereto, the gate potential Vg also goes up due to the capacity coupling via the retention capacitors Cs (parts D and E in FIG. 23). As such, the anode voltage of each of the organic EL elements 12 becomes higher than the value of (Vel+Vca), which is the sum of the threshold voltage Vel and the cathode voltage Vca in each of the organic EL elements 12. Accordingly, the current Id starts flowing between the anode and the cathode of each of the organic EL elements 12, and the organic EL elements 12 start emitting light with any desired level of luminance.

(Repetition)

Thereafter, the drive circuit 20 completes the light emission period Ton. To be specific, as described above, at the timing t1, the power line drive circuit 25 reduces the voltage of the power lines DSL from Vcc to Vini (part C in FIG. 23). In response thereto, the source potential Vs of the drive transistor Tr2 reaches the value of the voltage Vini (part E in FIG. 23), and the anode voltage of each of the organic EL elements 12 becomes lower than the voltage value of (Vel+Vca), thereby stopping the flow of the current Id between the anodes and the cathodes. As a result, after the timing t1, the organic EL elements stop emitting light, i.e., the procedure goes to the light-off period Toff. As such, the display is driven in such a manner as to periodically repeat the light emission period Ton and the light-off period Toff on a frame period basis. At the same time, the drive circuit 20 performs scanning in the line direction using a selection pulse for application to the power lines DSL and a control pulse for application to the scan lines SWL for every horizontal period (1H period). In such a manner, the display operation is performed in the display device 1.

(2. Gray-Scale Interpolation Operation)

(2-1. Basic Operation)

Described next is the operation of gray-scale interpolation utilizing the gray-scale interpolation voltage Vsig1, i.e., operation of gray-scale interpolation with the two-step drive scheme. The signal line drive circuit 24 applies the gray-scale interpolation voltage Vsig1 to each of the signal lines DTL before applying thereto the video signal voltage Vsig2. As will be described later, the signal line drive circuit 24 also changes the gray-scale interpolation voltage Vsig1 in value to take a plurality of values for application to each value of the video signal voltage Vsig2.

Figure 24:
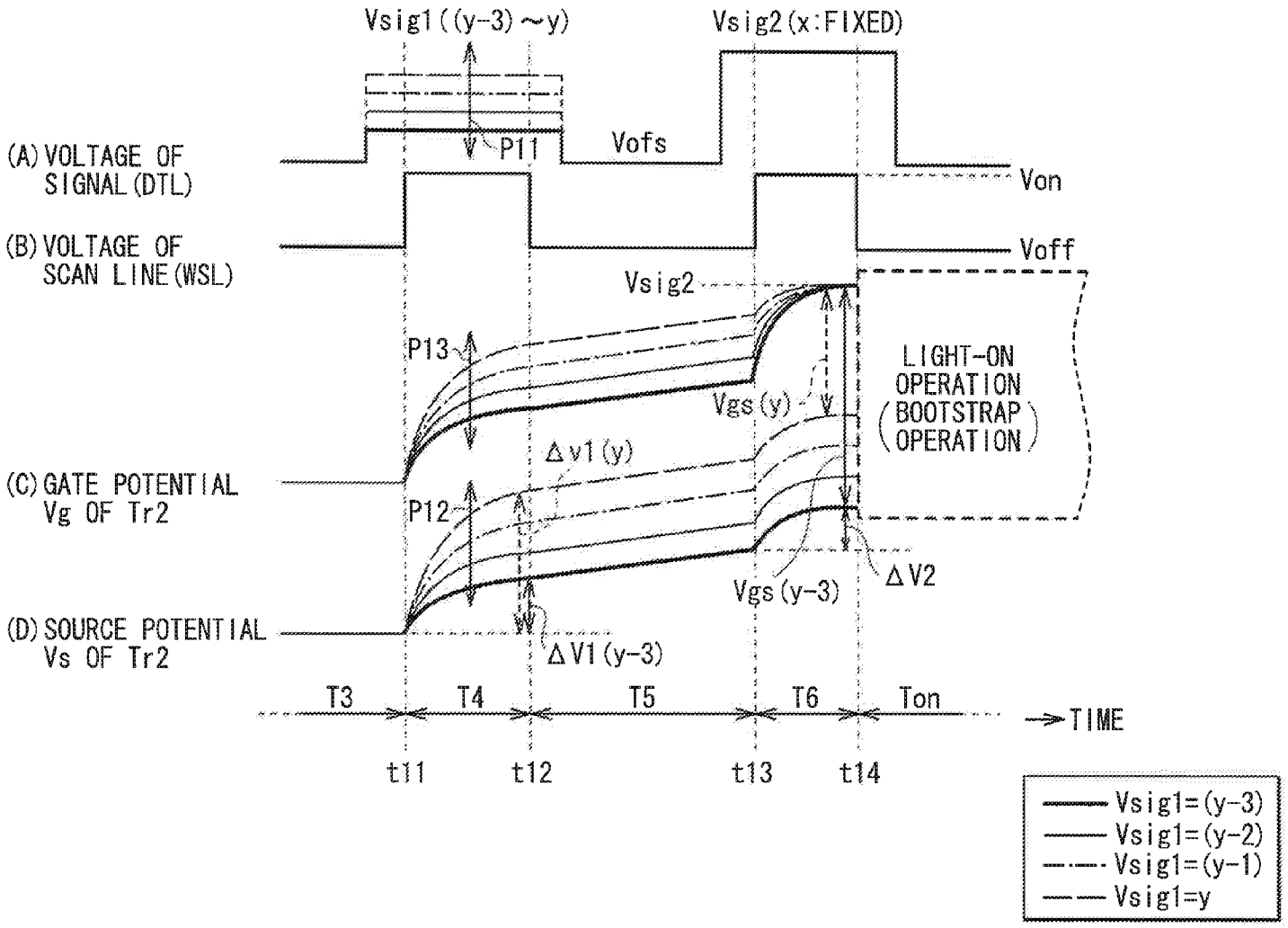
FIG. 24 is a timing chart for illustrating changes observed in the gate potential and in the source potential of a drive transistor in response to any change of a gray-scale interpolation voltage in the fifth embodiment.

To be specific, in the gray-scale interpolation write period T4, the signal line drive circuit 24 changes the gray-scale interpolation voltage Vsig1 in value to take a plurality of values. e.g., four voltage values of y, y−1, y−2, and y−3 in this example, with respect to the video signal voltage Vsig2 set to the value of x (P11 in A in FIG. 24). As described above, the writing of the gray-scale interpolation voltage Vsig1 increases the source potential Vs of the drive transistor Tr2 by the potential difference ΔV1, and the increase is varied depending on the magnitude of the gray-scale interpolation voltage Vsig1 (P12 in part D in FIG. 24). In other words, the magnitude of the gray-scale interpolation voltage Vsig1 changes the potential difference ΔV1 after the operation of gray-scale interpolation writing. As an example, the potential difference ΔV1($y$) when the gray-scale interpolation voltage Vsig1 is set to y becomes larger than the potential difference ΔV1($y$−3) when the gray-scale interpolation voltage Vsig1 is set to (y−3). In response to the increase of the source potential Vs as such, the gate potential Vg also goes up (P13 in part C in FIG. 24).

On the other hand, in the video signal write period T6, the increase of the source potential Vs of the drive transistor Tr2 (potential difference ΔV2) remains constant in value irrespective of the magnitude of the gray-scale interpolation voltage Vsig1 (part D in FIG. 24). This is because the potential difference ΔV2 is determined by the value (x) of the video signal voltage Vsig2. After this period, the gate potential Vg becomes equal to the value of the video signal voltage Vsig2 (=x) (part C in FIG. 24).

As such, by changing the gray-scale interpolation voltage Vsig1 in value with respect to the video signal voltage Vsig2 of a specific value, the gate-source voltage Vgs may be changed in value after the completion of writing of the video signal voltage Vsig2 (during the operation of light emission). As an example, the gate-source voltage Vgs(y) when the gray-scale interpolation voltage Vsig1 is set to the value of y becomes smaller than the gate-source voltage Vgs(y−3) when the gray-scale interpolation voltage Vsig1 is set to the value of y−3.

In other words, in this fifth embodiment, with the two-step drive scheme, any selected pixel 11 is subjected to writing while the gray-scale interpolation voltage Vsig1 is changed in value to take a plurality of values with respect to the video signal voltage Vsig2 of a specific value. Although the details will be described later, using the resulting values of the gray-scale interpolation voltage Vsig1, the gray-scale interpolation is performed to the video signal voltage Vsig2. This enables the representation with a larger number of gray-scale levels than the number originally provided by the signal line drive circuit 24 (the number of gray-scale levels provided by the video signal voltage Vsig2). For example, when the video signal voltage Vsig2 is with the gray-scale level based on m-bit, and when the gray-scale interpolation voltage Vsig1 is changed in value by 2n, it means that the gray-scale level based on original m-bit is the target for the interpolation of gray-scale level based on n-bit (2n gray-scale levels), thereby eventually leading to the gray-scale level based on (m+n)-bit. To be specific, when the video signal voltage Vsig2 is with the gray-scale level based on 8-bit, the gray-scale interpolation voltage Vsig1 is changed in value to take four values of y to y−3 with respect to the video signal voltage Vsig2 with the value of x, i.e., video signal voltage Vsig2(*x*). As such, the gray-scale level based on 2-bit (4 gray-scale levels) is interpolated so that the gray-scale level based on 10-bit may be represented.

(2-2. Effects by Write Timing for Gray-Scale Interpolation Voltage)

In this embodiment, such a write operation of the gray-scale interpolation voltage Vsig1 is performed one horizontal period (1H period) or longer period before the write operation for the video signal voltage Vsig2. In other words, the period (=bootstrap period T5) between the gray-scale interpolation write period T4 (t11 to t12) and the video signal write period T6 (t13 to t14) is a 1H period or longer. In other words, the gray-scale interpolation write period T4 is set so as to have a horizontal period different from that of the video signal write period T6. In the below, the effects and advantages by such a write timing for the gray-scale interpolation voltage Vsig1 is described in the following comparison example 3.

Comparison Example 3

Figure 25:
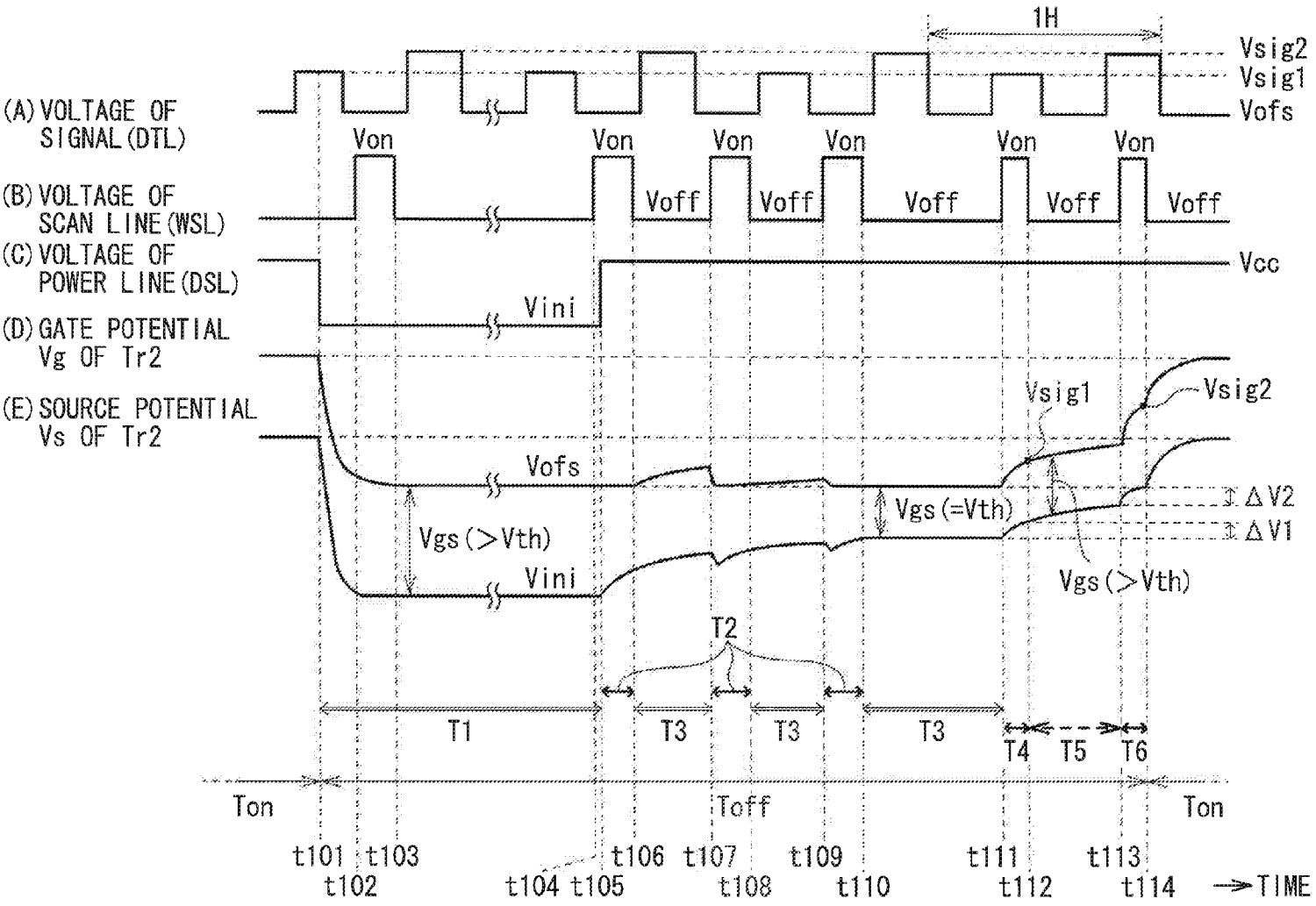
FIG. 25 is a timing chart for an exemplary operation of a display device in a comparison example 3.

First of all, described as the comparison example 3 of the above embodiment is another display drive operation (operation of gray-scale interpolation) using the two-step drive scheme. FIG. 25 is a timing chart showing various exemplary waveforms during the display operation in the comparison example 3 (timings t101 to t114). In FIG. 25, part A shows a voltage waveform of the signal lines DTL, part B shows that of the scan lines WSL, and part C shows that of the power lines DSL. Also in FIG. 25, part D shows the waveform of a gate potential Vg in the drive transistor Tr2, and E shows the waveform of a source potential Vs therein. Also in this comparison example 3, the operation is executed at timings similarly to those by the display device 1 described above in the Vth correction preparation period T1, the Vth correction period T2, and the Vth correction pause period T3 (timings t101 to t111). Prior to the video signal write period T6 (timings t113 to t114), the writing of the gray-scale interpolation voltage is performed (the gray-scale interpolation write period T4; t111 to t112), and the period between such write periods is the bootstrap period T5 (t112 to t113).

Note here that, in this comparison example 3, unlike in the embodiment described above, the operation to be executed from the gray-scale interpolation write period T4 (timings t111 to t112) to the video signal write period T6 is executed during a horizontal period (1H period). In other words, the bootstrap period T5 (timings t112 to t113) is set to be shorter than the 1H period.

Figure 26:
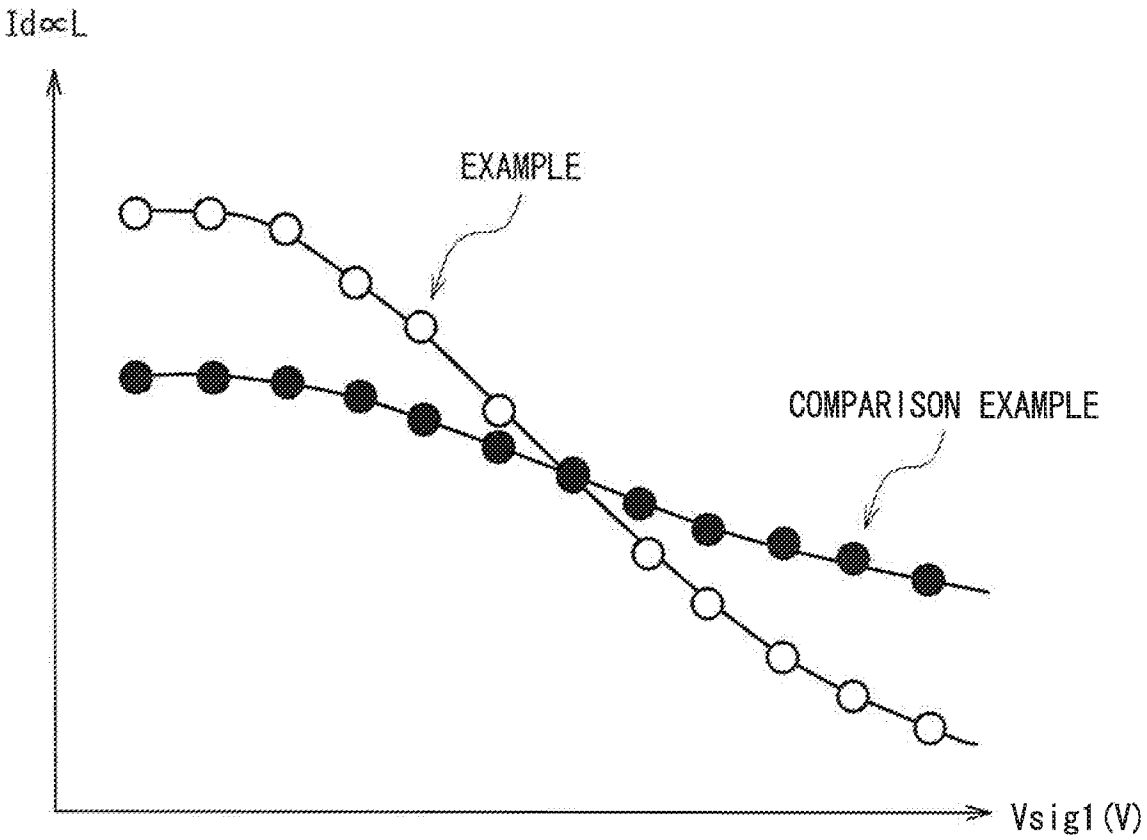
FIG. 26 is a characteristics diagram showing an exemplary relationship between a gray-scale interpolation voltage and a current flowing through a drive transistor, i.e., light emission luminance, in the display device in the fifth embodiment, and that in the display device in the comparison example 3.

FIG. 26 shows an exemplary relationship (current-change characteristics with respect to the gray-scale interpolation voltage Vsig1) between the gray-scale interpolation voltage Vsig1 for application to the video signal voltage Vsig2 of a specific value, and the current Id (proportional to the light emission luminance L of the organic EL elements 12) each for the above embodiment (the fifth embodiment) and for the comparison example 3. As shown in FIG. 26, the characteristics diagrams for the fifth embodiment and for the comparison example 3 both show the decrease of the current Id in response to the increase of the gray-scale interpolation voltage Vsig1. The rise and fall is gradual in the characteristics diagram of the comparison example 3, whereas in the characteristics diagram of the fifth embodiment, the rise and fall is sharp. This is because the bootstrap period T5 is different in length between the fifth embodiment and the comparison example 3. In other words, the bootstrap period T5 is the mobility correction period as described above, and in the fifth embodiment, the bootstrap period T5 is set longer, i.e., to be equal to or longer than a horizontal period. This accordingly increases the amount of mobility correction in the fifth embodiment compared with that in the comparison example 3 so that the characteristics of the current-change show the sharp rise and fall with respect to the gray-scale interpolation voltage Vsig1.

Figure 27:
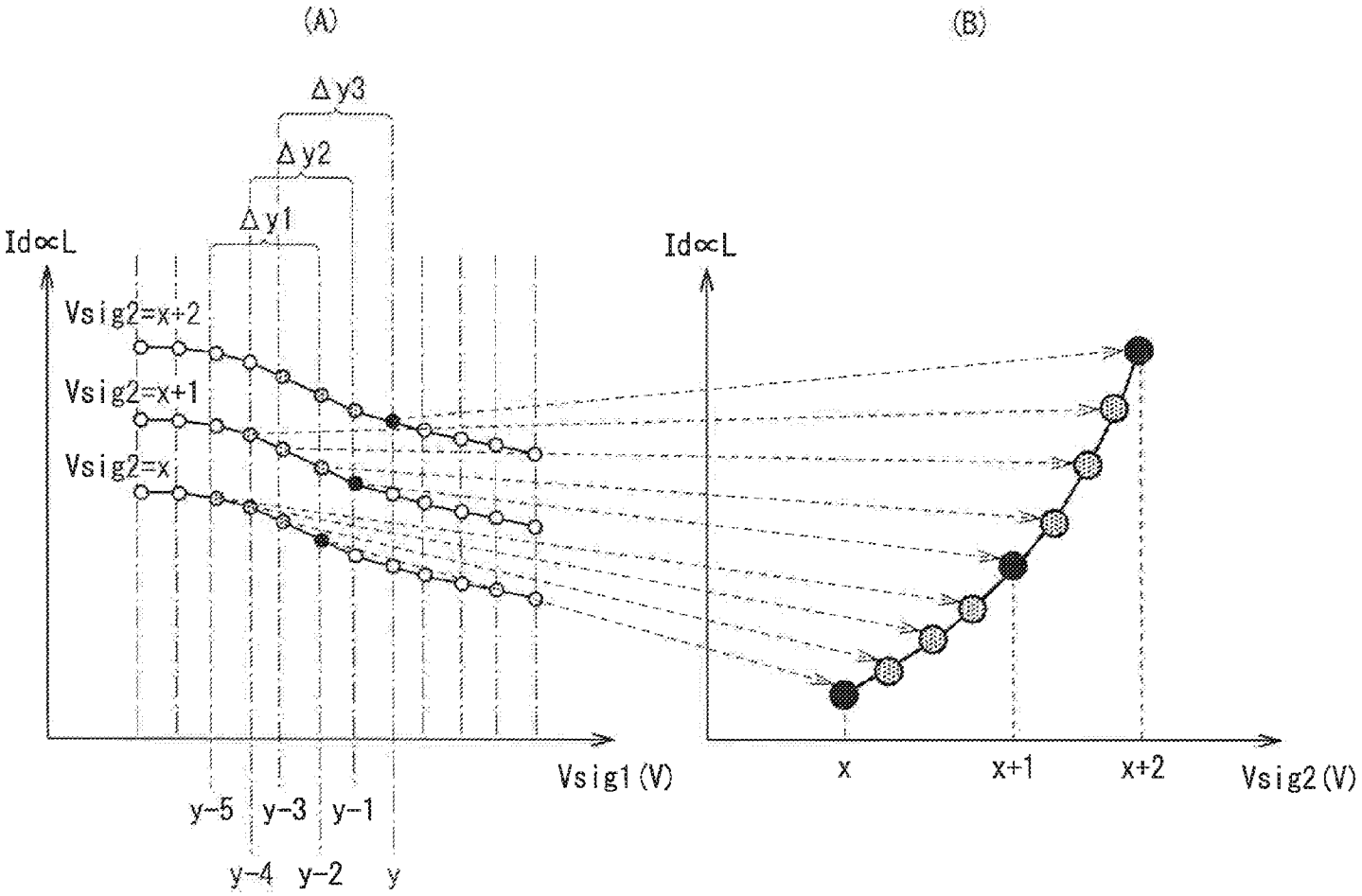
FIGS. 27A and 27B are each a characteristics diagram for illustrating an operation of gray-scale interpolation in the comparison example 3.
Figure 28:
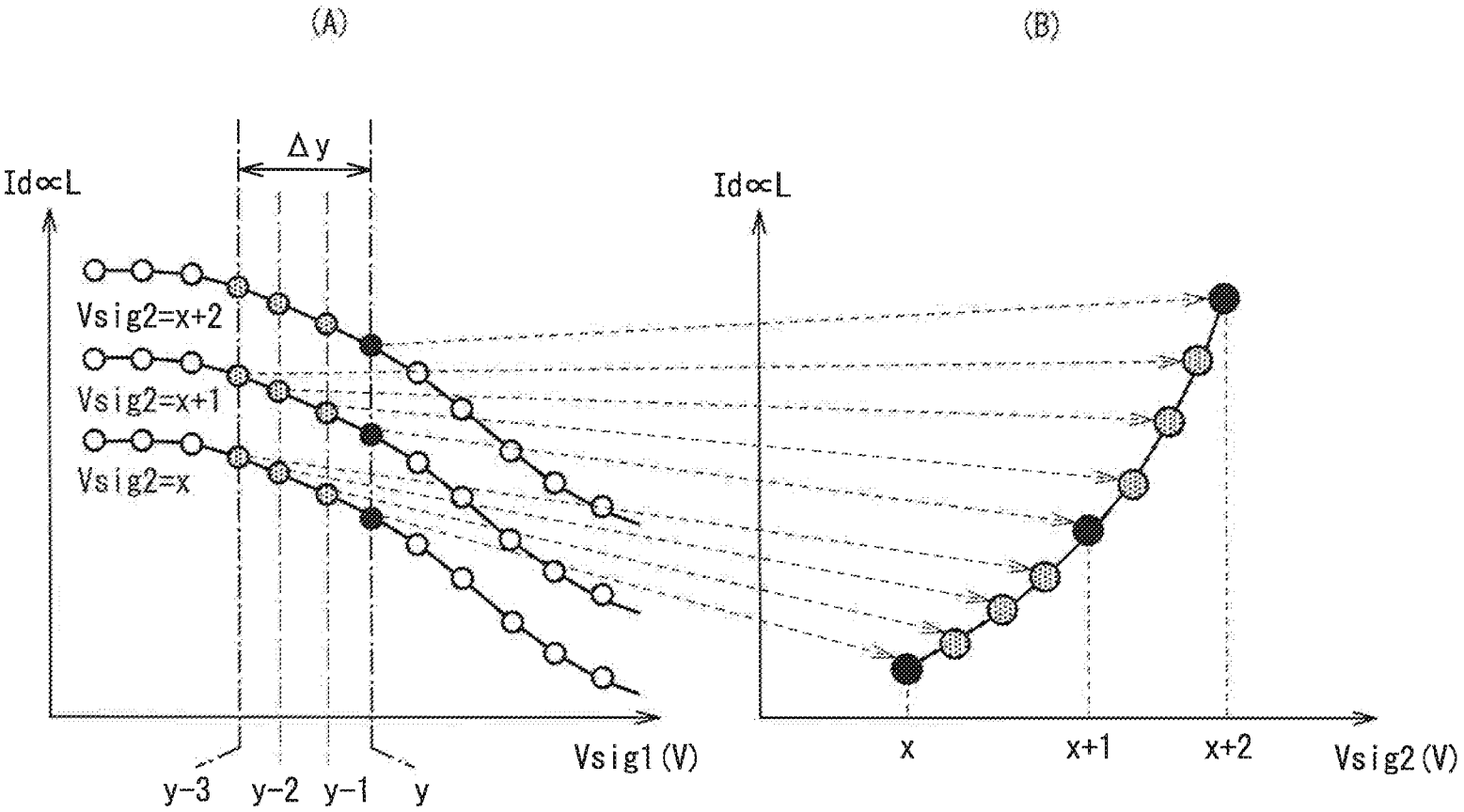
FIGS. 28A and 28B are each a characteristics diagram for illustrating an operation of gray-scale interpolation in the fifth embodiment.

Such a change of the current Id with respect to the gray-scale interpolation voltage Vsig1 varies depending on the magnitude of the video signal voltage Vsig2. In other words, even if the value to be written as the gray-scale interpolation voltage Vsig1 is the same, if the video signal voltage Vsig2 varies in value, the resulting current Id also varies. As an example, FIGS. 27A and 27B show a relationship of the current Id with the gray-scale interpolation voltage Vsig1 and the video signal voltage Vsig2 in the comparison example 3, and FIGS. 28A and 28B show such a relationship in the fifth embodiment. Note that FIGS. 27A and 28A each show the characteristics of current change with respect to the gray-scale interpolation voltage Vsig1 when the video signal voltage Vsig2 takes each of the values of x, x+1, and x+2, and FIGS. 27B and 28B each show a gamma curve (gamma curve after the completion of gray-scale interpolation), which shows a relationship between the current Id and the video signal voltage Vsig2.

With the basic operation as described above (parts A to D in FIG. 24), described is the case of performing the operation of gray-scale interpolation by changing the gray-scale interpolation voltage Vsig1 in value to take a plurality of values (y to y−3) with respect to the video signal voltage Vsig2 with the value of x. To be specific, the gamma curve is formed as below. That is, the gray-scale interpolation voltage Vsig1 is changed in value to take a plurality of values for application to each value of the video signal voltage Vsig2, i.e., for each of the values of x, x+1, x+2, and others in this example, and using the resulting values, the video signal voltage Vsig2 is subjected to gray-scale interpolation (FIGS. 27A to 28B). Herein, FIGS. 27A to 28B show the case of forming a gamma curve with gray-scale level based on 10-bit through 2-bit (4 gray-scale levels) interpolation to the video signal voltage Vsig2 with gray-scale level based on 8-bit, for example.

In this case, in the comparison example 3, as shown in FIG. 27A, since the characteristics of the current-change show the sharp rise and fall with respect to the gray-scale interpolation voltage Vsig1, the value range to be taken by the gray-scale interpolation voltage Vsig1 varies depending on the magnitude of the video signal voltage Vsig2. For example, when the video signal voltage Vsig2 is with a value of x, the gray-scale interpolation voltage Vsig1 is required to be changed in value to fall within a range of Δy1 (y−5 to y−2). When the video signal voltage Vsig2 is with a value of x+1, the gray-scale interpolation voltage Vsig1 is required to be changed in value to fall within a range of Δy2 (y−4 to y−1). Also when the video signal voltage Vsig2 is with a value of x+2, the gray-scale interpolation voltage Vsig1 is required to be changed in value to fall within a range of Δy3 (y−3 to y).

In other words, in the comparison example 3 in which the writing of the gray-scale interpolation voltage Vsig1 and of the video signal voltage Vsig2 is performed during a horizontal period, the bootstrap period is short in length. As such, the characteristics of the current-change show the sharp rise and fall with respect to the gray-scale interpolation voltage Vsig1, whereby the value range to be taken by the gray-scale interpolation voltage Vsig1 varies depending on the magnitude of the video signal voltage Vsig2. If the value range varies as such, a need arises to set in advance a wide value range for the gray-scale interpolation voltage Vsig1, and a memory for such a use needs to be provided in the data driver such as the signal line drive circuit 24.

On the other hand, in this embodiment (in the fifth embodiment), as shown in FIG. 28A, the current-change characteristics show the sharp rise and fall with respect to the gray-scale interpolation voltage Vsig1, and thus the value range to be taken by the gray-scale interpolation voltage Vsig1 does not vary that much depending on the magnitude of the video signal voltage Vsig2. In other words, the values of the gray-scale interpolation voltage Vsig1 in use fall almost in the same range for application to the values of the video signal voltage. For example, even if the video signal voltage Vsig2 takes any of the values of x, x+1, and x+2, there only needs to change in value the gray-scale interpolation voltage Vsig1 to fall within a range of Δy(y−3 to y).

In other words, in this fifth embodiment in which the writing of the gray-scale interpolation voltage Vsig1 is performed one horizontal period or longer period before the writing of the video signal voltage Vsig2, since the bootstrap period is longer in length, the current-change characteristics show the sharp rise and fall with respect to the gray-scale interpolation voltage Vsig1. Therefore, the value range to be taken by the gray-scale interpolation voltage Vsig1 does not vary depending on the magnitude of the video signal voltage Vsig2. This accordingly makes minimum the value range to be taken by the gray-scale interpolation voltage Vsig1, and there thus is no need to provide any additional memory to the data driver such as the signal line drive circuit 24. For an operation of 2-bit interpolation, for example, the gray-scale interpolation voltage Vsig1 may be set so as to take four values (values from y to y−3). In this case, when the number of gray-scale levels for output originally provided by the signal line drive circuit 24 is gray-scale level based on 8-bit (256 gray-scale levels), the resulting representation may be made with gray-scale level based on total 10-bit (1024 gray-scale levels).

As described above, in this fifth embodiment, to any selected pixel 11, the drive circuit 20 (the signal line drive circuit 24) writes the gray-scale interpolation voltage Vsig1 while changing the voltage in value to take a plurality of values for application to each value of the video signal voltage Vsig2, thereby performing an operation of gray-scale interpolation in terms of light emission luminance L. This accordingly enables to represent a larger number of gray-scale levels than those originally provided by the signal line drive circuit 24. Moreover, writing of the gray-scale interpolation voltage Vsig1 as such is performed one horizontal period or longer period before the writing of the video signal voltage Vsig2, and thus the value range to be taken by the gray-scale interpolation voltage Vsig1 does not vary that much depending on the magnitude of the video signal voltage Vsig2. There thus is no need to provide any additional memory to the peripheral circuit such as data driver, thereby favorably realizing a higher image quality with a lower cost.

(Module and Application Examples)

By referring to FIGS. 29 to 34G, described are application examples of the display device 1 described in the first to fifth embodiments above. The display device 1 in the first to fifth embodiments above is applicable to any type of electronic unit such as a television device, a digital camera, a notebook personal computer, a portable terminal device such as mobile phone, or a video camera. In other words, this display device 1 is applicable to any type of electronic unit displaying video signals as images or video. The video signals are those provided from the outside, or those generated inside.

(Module)

Figure 29:
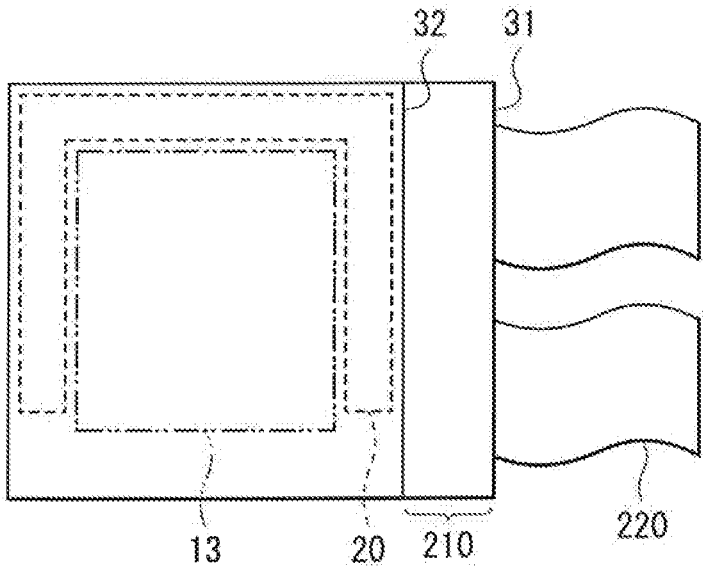
FIG. 29 is a plan view of a module including the display devices in the first to fifth embodiments, showing the schematic configuration thereof.

The display device 1 is incorporated as such a module as shown in FIG. 29, for example, into various types of electronic units in the following application examples 1 to 5. This module includes a region 210 exposed from a sealing substrate 32 on one side of a substrate 31, and this exposed region 210 is formed with an external connection terminal (not shown) by extending the wiring of the drive circuit 20. This external connection terminal may be provided with a flexible printed circuit (FPC) 220 for signal input and output.

Application Example 1

Figure 30:
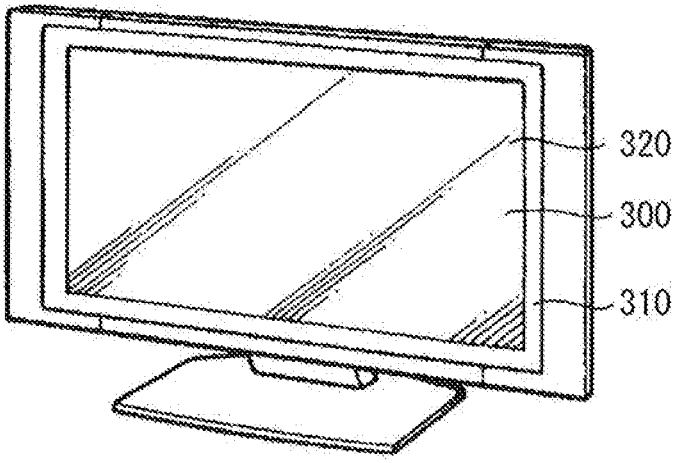
FIG. 30 is a perspective view showing the appearance of an application example 1 for the display devices in the first to fifth embodiments.

FIG. 30 shows the appearance of a television device to which the display device 1 is applied. This television device is provided with a video display screen section 300, including a front panel 310 and a filter glass 320, for example. This video display screen 300 is configured by the display device 1.

Application Example 2

Figure 31A:
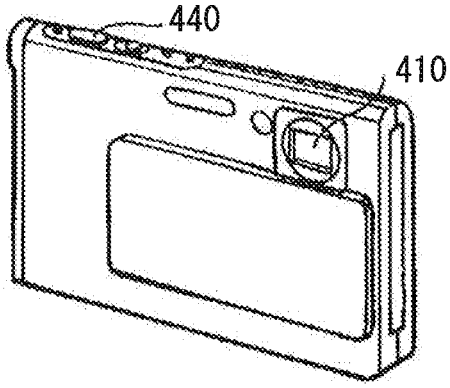
FIG. 31A is a perspective view showing the appearance of an application example 2, showing the outer view thereof viewed from the front side.
Figure 31B:
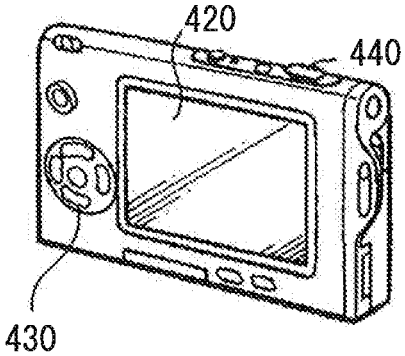
FIG. 31B is a perspective view showing the appearance of the application example 2 viewed from the rear side.

FIG. 31 shows the appearance of a digital camera to which the display device 1 is applied. This digital camera is configured to include a light emission section 410 for flash use, a display section 420, a menu switch 430, and a shutter button 440, for example. This display section 420 is configured by the display device 1.

Application Example 3

Figure 32:
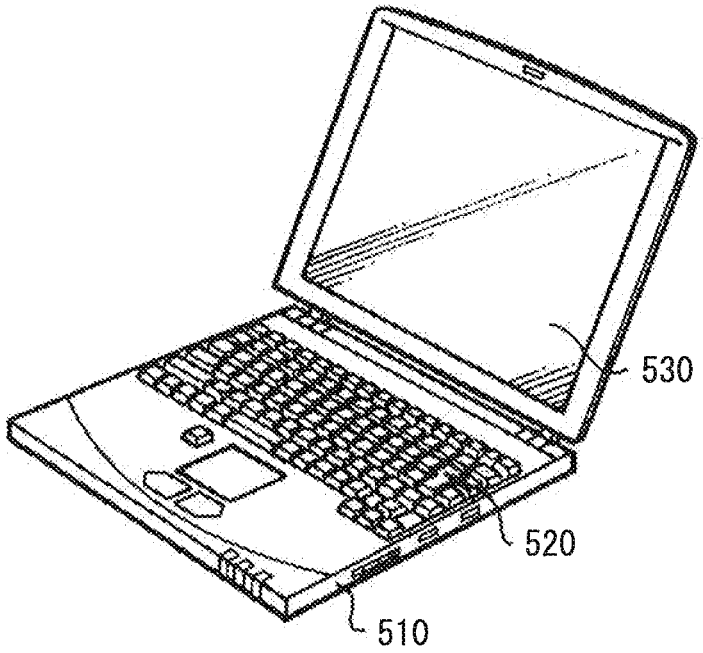
FIG. 32 is a perspective view showing the appearance of an application example 3.

FIG. 32 shows the appearance of a notebook personal computer to which the display device 1 is applied. This notebook personal computer is configured to include a main body 510, a keyboard 520 for input operation of text or others, and a display section 530 for image display, for example. This display section 530 is configured by the display device 1.

Application Example 4

Figure 33:
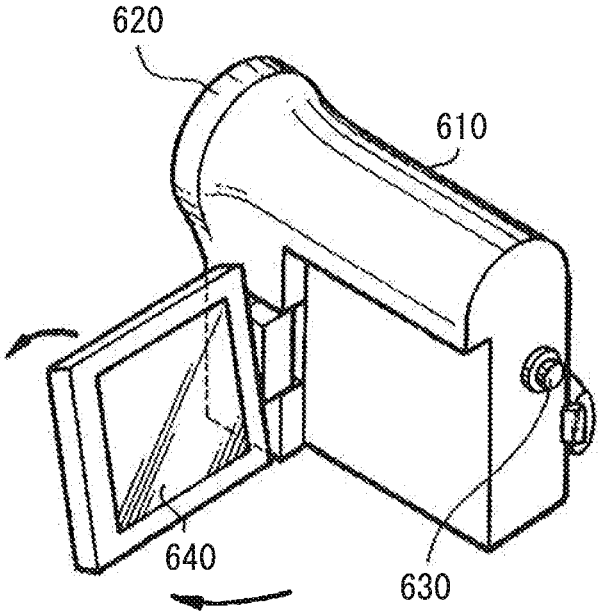
FIG. 33 is a perspective view showing the appearance of an application example 4.
Figures 34A, 34B, 34C, 34D, 34E, 34F, 34G:
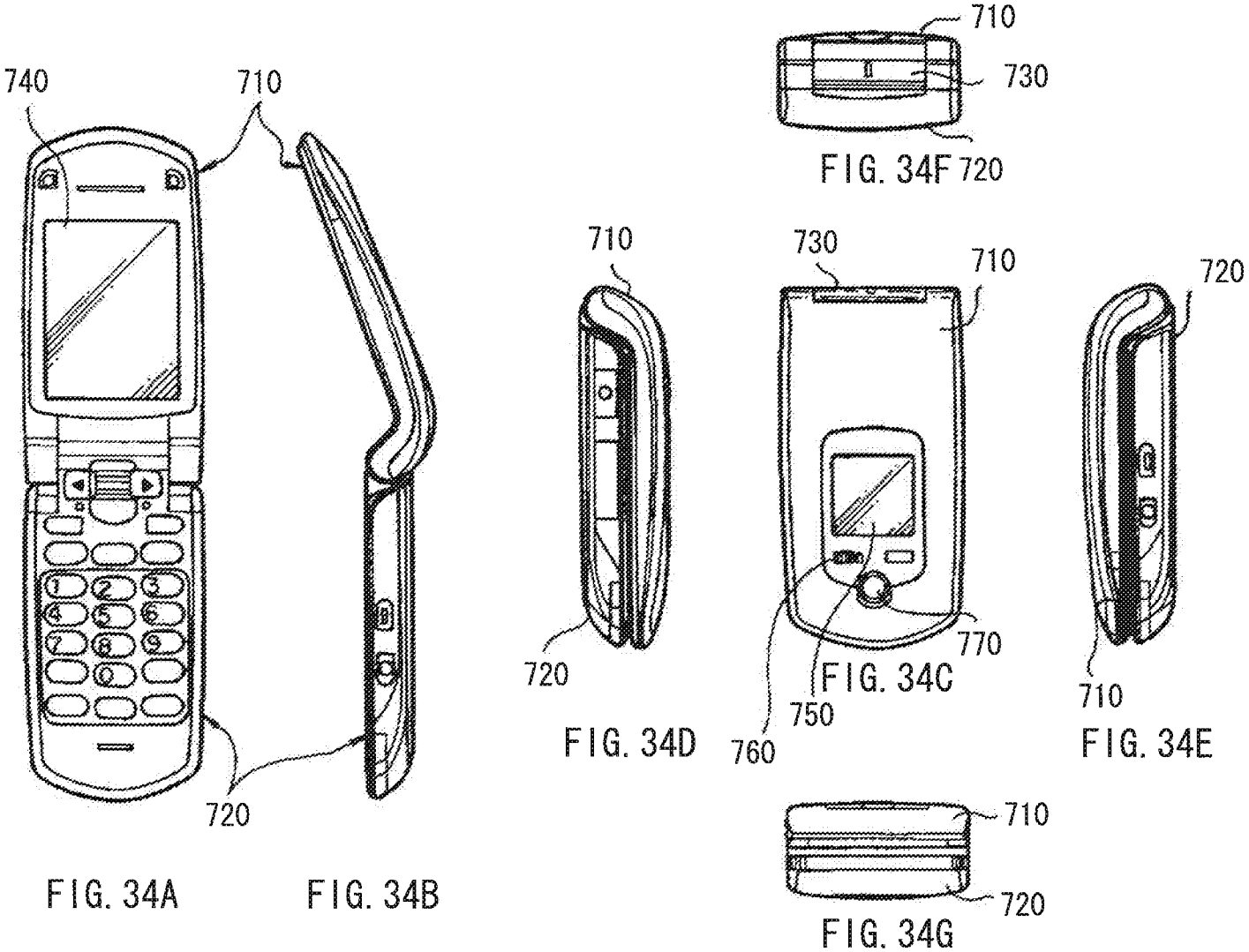
FIG. 34A is a front view of an application example 5 in the open state.
FIG. 34B is a side view of the device of FIG. 34A.
FIG. 34C is a front view of the device in the application example 5 being in the close state.
FIG. 34D is a left side view of the device of FIG. 34C.
FIG. 34E is a right side view of the device of FIG. 34C.
FIG. 34F is a top view of the device of FIG. 34C.
FIG. 34G is a bottom view of the device of FIG. 34C.

FIG. 33 shows the appearance of a video camera to which the display device 1 is applied. This video camera is configured to include a main body section 610, a lens 620 provided on the front side surface of the main body section 610 for object imaging, a start/stop switch 630 during imaging, and a display section 640, for example. This display section 640 is configured by the display device 1.

Application Example 5

FIGS. 34A to 34G each show the appearance of a mobile phone to which the display device 1 is applied. This mobile phone is configured by an upper chassis 710 coupled to a lower chassis 720 using a coupling section (hinge section) 730, and is configured to include a display 740, a sub display 750, a picture light 760, and a camera 770, for example. Among these components, the display 740 or the sub display 750 is configured by the display device 1.

Modified Examples

While the invention has been described in detail with several embodiments and application examples, the foregoing description is in all aspects illustrative and not restrictive. It is understood that numerous other modifications and variations may be devised without departing from the scope of the invention.

As an example, in the embodiments above and others, described is the case of enabling the representation with the light emission luminance L of gray-scale level based on 10-bit by 2-bit interpolation to gray-scale level based on 8-bit provided by the video signal 20A. This is surely not restrictive, and alternatively, any other representations may be realized using the operation of gray-scale interpolation described in the embodiments above and others, e.g., representation with gray-scale level based on 10-bit by 4-bit interpolation to gray-scale level based on 6-bit, or representation with gray-scale level based on 12-bit by 2-bit interpolation to gray-scale level based on 10-bit. Note here that for N-bit interpolation to a video signal originally with gray-scale level based on M-bit, the gray-scale interpolation voltage Vsig1 may be changed by a value of 2N.

Further, in the embodiments above and others, described is the case that the display device 1 is of the active-matrix type, and the configuration of the pixel circuit 14 for driving such an active-matrix display device is surely not restrictive. In other words, the pixel circuit 14 may be additionally provided with a capacitor, a transistor, and others as required. In this case, if the pixel circuit 14 is changed in configuration, any other drive circuit may be additionally provided if required in addition to the above-described circuits, i.e., the scan line drive circuit 23, the signal line drive circuit 24, and the power line drive circuit 25.

Still further, in the embodiments above and others, described is the case that the timing generation circuit 22 is controls the drive operation in the scan line drive circuit 23, the signal line drive circuit 24, and the power line drive circuit 25. This is surely not restrictive, and alternatively, any other circuit may be operated to control as such. The control over such circuits, i.e., the scan line drive circuit 23, the signal line drive circuit 24, and the power line drive circuit 25, may be executed in hardware (circuit), or by software (program).

Still further, in the embodiments above and others, described is the case that the pixel circuit 14 has the so-called "2Tr1C" configuration, but the circuit configuration of the pixel circuit 14 is surely not restrictive thereto. In other words, when the transistor is connected to the organic EL elements 12 in series in the pixel circuit 14, the pixel circuit 14 may have the circuit configuration other than such "2Tr1C".

Still further, in the embodiments above and others, described is the case in which the write transistor Tr1 and the drive transistor Tr2 are each an n-channel transistor, e.g., n-channel MOS TFT. This is surely not restrictive, and the write transistor Tr1 and the drive transistor Tr2 may be each a p-channel transistor, e.g., p-channel MOS TFT. In this case, preferably, in the drive transistor Tr2, either the source or drain not connected to the power line DSL is connected to the cathode of the organic EL element 12 together with an end of the retention capacitor Cs, and the anode of the organic EL element 12 is connected to the ground line GND or others.

The present application contains subject matter related to that disclosed in Japanese Priority Patent Application JP 2009-258315 filed in the Japan Patent Office on Nov. 11, 2009 and in Japanese Priority Patent Application JP 2009-258316 filed in the Japan Patent Office on Nov. 11, 2009, the entire content of which is hereby incorporated by references.

It should be understood by those skilled in the art that various modifications, combinations, sub-combinations and alterations may occur depending on design requirements and other factors insofar as they are within the scope of the appended claims or the equivalents thereof.

What is claimed is:

1. An electronic unit provided with a display device, the display device comprising:

a plurality of pixels each including a light-emitting element;

scan lines and signal lines, each line being connected to corresponding pixels of the plurality of pixels;

a scan line drive circuit applying a selection pulse to each of the scan lines in succession, the selection pulse allowing a group of pixels to be selected from the plurality of pixels; and a signal line drive circuit writing video signals to respective pixels selected by the scan line drive circuit through switching a gray-scale interpolation voltage, a basic voltage, and a video signal voltage, one after another in this order, to apply each voltage selected by switching to each of the signal lines, wherein the signal line drive circuit performs gray-scale interpolation on a light emission luminance level for each of the light emitting elements through setting the video signal voltage to a fundamental gray-scale voltage corresponding to one of a plurality of gray-scale values which are originally provided by the video signals, and through varying the gray-scale interpolation voltage over a plurality of voltage values, the signal line drive circuit adjusts a period of the gray-scale interpolation voltage, in such a manner that the period of the gray-scale interpolation voltage gets shorter as a distance along the signal line from the signal line drive circuit to each of the pixels increases, and the scan line drive circuit starts an application of the selection pulse during a period of the gray-scale interpolation voltage, and completes the application of the selection pulse during a period of the basic voltage.

2. An electronic unit provided with a display device, the display device comprising:

a plurality of pixels each including a light-emitting element;

scan lines and signal lines, each line being connected to corresponding pixels of the plurality of pixels;

a scan line drive circuit applying a selection pulse to each of the scan lines in succession, the selection pulse allowing a group of pixels to be selected from the plurality of pixels; and a signal line drive circuit writing video signals to respective pixels selected by the scan line drive circuit through switching a gray-scale interpolation voltage, a basic voltage, and a video signal voltage, one after another in this order, to apply each voltage selected by switching to each of the signal lines, wherein the signal line drive circuit performs gray-scale interpolation on a light emission luminance level for each of the light emitting elements through setting the video signal voltage to a fundamental gray-scale voltage corresponding to one of a plurality of gray-scale values which are originally provided by the video signals, and through varying the gray-scale interpolation voltage over a plurality of voltage values, and the scan line drive circuit starts an application of the selection pulse during a period of the gray-scale interpolation voltage, and completes the application of the selection pulse during a period of the video signal voltage subsequent to a period of the basic voltage.

3. An electronic unit provided with a display device, the display device comprising:

a plurality of pixels each including a light-emitting element;

scan lines and signal lines, each line being connected to corresponding pixels of the plurality of pixels;

a scan line drive circuit applying a selection pulse to each of the scan lines in succession, the selection pulse allowing a group of pixels to be selected from the plurality of pixels; and a signal line drive circuit writing video signals to respective pixels selected by the scan line drive circuit through switching a gray-scale interpolation voltage, a basic voltage, and a video signal voltage, one after another in this order, to apply each voltage selected by switching to each of the signal lines, wherein the signal line drive circuit performs gray-scale interpolation on a light emission luminance level for each of the light emitting elements through setting the video signal voltage to a fundamental gray-scale voltage corresponding to one of a plurality of gray-scale values which are originally provided by the video signals, and through varying the gray-scale interpolation voltage over a plurality of voltage values, and the scan line drive circuit starts an application of the selection pulse prior to a period of the gray-scale interpolation voltage, and completes the application of the selection pulse during a period of the basic voltage subsequent to a period of the gray-scale interpolation voltage.

4. An electronic unit provided with a display device, the display device comprising:

a plurality of pixels each including a light-emitting element;

scan lines and signal lines, each line being connected to corresponding pixels of the plurality of pixels;

a scan line drive circuit applying a selection pulse to each of the scan lines in succession, the selection pulse allowing a group of pixels to be selected from the plurality of pixels; and a signal line drive circuit writing video signals to respective pixels selected by the scan line drive circuit through switching a gray-scale interpolation voltage, a basic voltage, and a video signal voltage, one after another in this order, to apply each voltage selected by switching to each of the signal lines, wherein the signal line drive circuit performs gray-scale interpolation on a light emission luminance level for each of the light emitting elements through setting the video signal voltage to a fundamental gray-scale voltage corresponding to one of a plurality of gray-scale values which are originally provided by the video signals, and through varying the gray-scale interpolation voltage over a plurality of voltage values, and the scan line drive circuit starts and completes an application of the selection pulse during each of a period of a gray-scale interpolation voltage, a period of a basic voltage and a period of a video signal voltage.

5. A display device, comprising:

a plurality of pixels each including a light-emitting element;

scan lines and signal lines, each line being connected to corresponding pixels of the plurality of pixels;

a scan line drive circuit applying a selection pulse to each of the scan lines in succession, the selection pulse allowing a group of pixels to be selected from the plurality of pixels; and a signal line drive circuit writing video signals to respective pixels selected by the scan line drive circuit through switching a gray-scale interpolation voltage, a basic voltage, and a video signal voltage, one after another in this order, to apply each voltage selected by switching to each of the signal lines, wherein the signal line drive circuit performs gray-scale interpolation on a light emission luminance level for each of the light emitting elements through setting the video signal voltage to a fundamental gray-scale voltage corresponding to one of a plurality of gray-scale values which are originally provided by the video signals, and through varying the gray-scale interpolation voltage over a plurality of voltage values, and the scan line drive circuit starts and completes an application of the selection pulse during each of a period of a gray-scale interpolation voltage, a period of a basic voltage and a period of a video signal voltage.

6. A display device, comprising:

a plurality of pixels each including a light-emitting element;

scan lines and signal lines, each line being connected to corresponding pixels of the plurality of pixels;

a scan line drive circuit applying a selection pulse to each of the scan lines in succession, the selection pulse allowing a group of pixels to be selected from the plurality of pixels; and a signal line drive circuit writing video signals to respective pixels selected by the scan line drive circuit through switching a gray-scale interpolation voltage, a basic voltage, and a video signal voltage, one after another in this order, to apply each voltage selected by switching to each of the signal lines, wherein the signal line drive circuit performs gray-scale interpolation on a light emission luminance level for each of the light emitting elements through setting the video signal voltage to a fundamental gray-scale voltage corresponding to one of a plurality of gray-scale values which are originally provided by the video signals, and through varying the gray-scale interpolation voltage over a plurality of voltage values, and the scan line drive circuit starts an application of the selection pulse prior to a period of the gray-scale interpolation voltage, and completes the application of the selection pulse during a period of the basic voltage subsequent to a period of the gray-scale interpolation voltage.

7. A display device, comprising:

a plurality of pixels each including a light-emitting element;

scan lines and signal lines, each line being connected to corresponding pixels of the plurality of pixels;

a scan line drive circuit applying a selection pulse to each of the scan lines in succession, the selection pulse allowing a group of pixels to be selected from the plurality of pixels; and a signal line drive circuit writing video signals to respective pixels selected by the scan line drive circuit through switching a gray-scale interpolation voltage, a basic voltage, and a video signal voltage, one after another in this order, to apply each voltage selected by switching to each of the signal lines, wherein the signal line drive circuit performs gray-scale interpolation on a light emission luminance level for each of the light emitting elements through setting the video signal voltage to a fundamental gray-scale voltage corresponding to one of a plurality of gray-scale values which are originally provided by the video signals, and through varying the gray-scale interpolation voltage over a plurality of voltage values, and the scan line drive circuit starts an application of the selection pulse during a period of the gray-scale interpolation voltage, and completes the application of the selection pulse during a period of the video signal voltage subsequent to a period of the basic voltage.

8. A display device, comprising:

a plurality of pixels each including a light-emitting element;

scan lines and signal lines, each line being connected to corresponding pixels of the plurality of pixels;

a scan line drive circuit applying a selection pulse to each of the scan lines in succession, the selection pulse allowing a group of pixels to be selected from the plurality of pixels; and a signal line drive circuit writing video signals to respective pixels selected by the scan line drive circuit through switching a gray-scale interpolation voltage, a basic voltage, and a video signal voltage, one after another in this order, to apply each voltage selected by switching to each of the signal lines, wherein the signal line drive circuit performs gray-scale interpolation on a light emission luminance level for each of the light emitting elements through setting the video signal voltage to a fundamental gray-scale voltage corresponding to one of a plurality of gray-scale values which are originally provided by the video signals, and through varying the gray-scale interpolation voltage over a plurality of voltage values, the signal line drive circuit adjusts a period of the gray-scale interpolation voltage, in such a manner that the period of the gray-scale interpolation voltage gets shorter as a distance along the signal line from the signal line drive circuit to each of the pixels increases, and the scan line drive circuit starts an application of the selection pulse during a period of the gray-scale interpolation voltage, and completes the application of the selection pulse during a period of the basic voltage.

9. The display device according to claim 8, wherein the signal line drive circuit adjusts the period of the gray-scale interpolation voltage, in such a manner that the period of the gray-scale interpolation voltage gets shorter step by step as the distance increases.

10. The display device according to claim 1, further comprising:

power lines each connected to corresponding pixels of the plurality of pixels; and a power line drive circuit applying a control pulse to each of the power lines, the control pulse allowing the light emitting element to be on and off.

11. The display device according to claim 10, wherein the light emitting element has an anode and a cathode, and each of the pixels includes an organic electroluminescence element as the light-emitting element, first and second transistors each having a gate, a source and a drain, and a retention capacitor, the gate of the first transistor being connected to the corresponding scan line, one of the drain and the source in the first transistor being connected to the corresponding signal line, whereas the other one thereof being connected to both the gate of the second transistor and one end of the retention capacitor, one of the drain and the source in the second transistor being connected to the corresponding power line, whereas the other one thereof being connected to both the other end of the retention capacitor and the anode of the organic electroluminescence element, and the cathode of the organic electroluminescence element being set to a fixed potential.

12. A method of driving a display device, through driving a plurality of pixels each including a light-emitting element and each connected to both a scan line and a signal line, the method comprising steps of:

applying a selection pulse to each of the scan lines in succession, the selection pulse allowing a group of pixels to be selected from the plurality of pixels, writing video signals to respective pixels selected by the scan line drive circuit through switching a gray-scale interpolation voltage, a basic voltage, and a video signal voltage, one after another in this order, to apply each voltage selected by switching to each of the signal lines, starting and completing an application of the selection pulse during each of a gray-scale interpolation voltage period, a basic voltage period and a video signal voltage period, to perform writing of the video signals, and performing gray-scale interpolation on a light emission luminance level for each of the light emitting elements through setting the video signal voltage to a fundamental gray-scale voltage corresponding to one of a plurality of gray-scale values which are originally provided by the video signals, and through varying the gray-scale interpolation voltage over a plurality of voltage values.

13. A method of driving a display device, through driving a plurality of pixels each including a light-emitting element and each connected to both a scan line and a signal line, the method comprising steps of:

applying a selection pulse to each of the scan lines in succession, the selection pulse allowing a group of pixels to be selected from the plurality of pixels, writing video signals to respective pixels selected by the scan line drive circuit through switching a gray-scale interpolation voltage, a basic voltage, and a video signal voltage, one after another in this order, to apply each voltage selected by switching to each of the signal lines, starting an application of the selection pulse prior to a period of the gray-scale interpolation voltage, and completing the application of the selection pulse during a period of the basic voltage subsequent to a period of the gray-scale interpolation voltage, to perform writing of the video signals, and performing gray-scale interpolation on a light emission luminance level for each of the light emitting elements through setting the video signal voltage to a fundamental gray-scale voltage corresponding to one of a plurality of gray-scale values which are originally provided by the video signals, and through varying the gray-scale interpolation voltage over a plurality of voltage values.

14. A method of driving a display device, through driving a plurality of pixels each including a light-emitting element and each connected to both a scan line and a signal line, the method comprising steps of:

applying a selection pulse to each of the scan lines in succession, the selection pulse allowing a group of pixels to be selected from the plurality of pixels, writing video signals to respective pixels selected by the scan line drive circuit through switching a gray-scale interpolation voltage, a basic voltage, and a video signal voltage, one after another in this order, to apply each voltage selected by switching to each of the signal lines, starting an application of the selection pulse during a period of the gray-scale interpolation voltage, and completing the application of the selection pulse during a period of the video signal voltage subsequent to a period of the basic voltage, to perform writing of the video signals, and performing gray-scale interpolation on a light emission luminance level for each of the light emitting elements through setting the video signal voltage to a fundamental gray-scale voltage corresponding to one of a plurality of gray-scale values which are originally provided by the video signals, and through varying the gray-scale interpolation voltage over a plurality of voltage values.

15. A method of driving a display device, through driving a plurality of pixels each including a light-emitting element and each connected to both a scan line and a signal line, the method comprising steps of:

applying a selection pulse to each of the scan lines in succession, the selection pulse allowing a group of pixels to be selected from the plurality of pixels, writing video signals to respective pixels selected by the scan line drive circuit through switching a gray-scale interpolation voltage, a basic voltage, and a video signal voltage, one after another in this order, to apply each voltage selected by switching to each of the signal lines, starting an application of the selection pulse during a period of the gray-scale interpolation voltage, and completing the application of the selection pulse during a period of the basic voltage, to perform writing of the video signals, adjusting a period of the gray-scale interpolation voltage, in such a manner that the period of the gray-scale interpolation voltage gets shorter as a distance along the signal line from the signal line drive circuit to each of the pixels increases, and performing gray-scale interpolation on a light emission luminance level for each of the light emitting elements through setting the video signal voltage to a fundamental gray-scale voltage corresponding to one of a plurality of gray-scale values which are originally provided by the video signals, and through varying the gray-scale interpolation voltage over a plurality of voltage values.

* * * * *